US005780194A

United States Patent [19]

Katsukawa et al.

[11] Patent Number: 5,780,194

[45] Date of Patent: Jul. 14, 1998

[54] ELECTROPHOTOSENSITIVE MATERIAL

[75] Inventors: Masato Katsukawa; Akiyoshi Urano; Ayako Sugase; Mitsuo Ihara; Ichiro Yamazato; Yuka Nakamura, all of Osaka, Japan

[73] Assignee: Mita Industrial Co., Ltd., Osaka, Japan

[21] Appl. No.: 629,634

[22] Filed: Apr. 9, 1996

[30] Foreign Application Priority Data

Apr. 18, 1995 [JP] Japan ..... 7-092776
Apr. 18, 1995 [JP] Japan ..... 7-092777

[51] Int. Cl.[6] ..... G03G 5/09; G03G 5/05

[52] U.S. Cl. ..... 430/83; 430/56; 430/59; 430/96

[58] Field of Search ..... 430/96, 83, 56, 430/58, 59, 73

[56] References Cited

U.S. PATENT DOCUMENTS

| | | | |
|---|---|---|---|
| 3,615,406 | 10/1971 | Merrill | 430/74 |
| 3,647,431 | 3/1972 | Rossi | 430/74 |
| 3,658,520 | 4/1972 | Brantly et al. | 430/83 |
| 3,703,371 | 11/1972 | Merrill | 430/96 |
| 3,703,372 | 11/1972 | Merrill | 430/96 |
| 3,865,789 | 2/1975 | Wyhof | 430/96 |
| 3,865,869 | 2/1975 | Kuehn et al. | 430/96 |
| 4,769,304 | 9/1988 | Kondo et al. | 430/96 |
| 4,772,526 | 9/1988 | Kan et al. | 430/58 |
| 4,996,124 | 2/1991 | Buettner | 430/59 |
| 5,436,100 | 7/1995 | Shimada et al. | 430/83 |
| 5,521,044 | 5/1996 | Muto et al. | 430/83 |
| 5,578,405 | 11/1996 | Ikegami et al. | 430/59 |

FOREIGN PATENT DOCUMENTS

| | | |
|---|---|---|
| 0011980 | 6/1980 | European Pat. Off. . |
| 0 506 387 | 9/1992 | European Pat. Off. . |
| 0552740 | 7/1993 | European Pat. Off. . |
| 0 574 154 | 12/1993 | European Pat. Off. . |
| 2022016 | 7/1970 | France . |
| 2126764 | 10/1972 | France . |
| 2048135 | 4/1971 | Germany . |
| 3215646 | 11/1982 | Germany . |
| 60-172045 | 9/1985 | Japan . |
| 60-192950 | 10/1985 | Japan . |
| 61-62039 | 3/1986 | Japan . |
| 63-148263 | 6/1988 | Japan . |
| 1-273064 | 10/1989 | Japan . |
| 5-80548 | 4/1993 | Japan . |
| 5-88396 | 4/1993 | Japan . |
| 5-113671 | 5/1993 | Japan . |
| 5-158249 | 6/1996 | Japan . |

OTHER PUBLICATIONS

Annex to the European Search Report and Search Report (Sep. 29, 1997).

Patent Abstracts of Japan, of JP 06 180509A, Jun. 28, 1994.

Database WPI, Section Ch, Week 9422, Derwent Publications Ltd., Class E14, AN 94-179092, XP002038521 of JP 06 118 672 A (Mita Ind. Co., Ltd.), Apr. 28, 1994, (Abstract).

Database WPI, Section CH, Week 9329, Derwent Publications Ltd., Class A89, AN 93-229383 XP002038522 of JP 05 150 478 A (Mita Ind. Co., Ltd.), Jun. 18, 1993, (Abstract).

Database WPI, Section Ch, Week 9329, Derwent Publications Ltd., Class A89, AN 93-229382 XP002038097 of JP 05 150 477 A (Mita Ind. Co. Ltd.), Jun. 18, 1993, (Abstract).

Database WPI Section Ch, Week 9523, Derwent Publications Ltd., London, GB XP002028252, JP07092709, Apr. 1995, Abstract.

*Primary Examiner*—Janis L. Dote

*Attorney, Agent, or Firm*—Beveridge, DeGrandi, Weilacher & Young, LLP

[57] ABSTRACT

The present invention provides an electrophotosensitive material comprising a conductive substrate and a photosensitive layer provided on the conductive substrate, the photosensitive layer comprising a specific hole transferring material and/or electron transferring material and a binding resin of a polyester resin which is a substantially linear polymer obtained by using a specific dihydroxy compound represented by the general formula (1):

(1)

wherein $R^1$ is an alkylene group having 2 to 4 carbon atoms; and $R^2$, $R^3$, $R^4$ and $R^5$ are the same or different and indicate a hydrogen atom, an alkyl group having 1 to 4 carbon atoms, an aryl group or an aralkyl group or the like. This photosensitive material is improved in sensitivity, and is also superior in adhesion to conductive substrate as well as mechanical strength such as wear resistance, etc.

3 Claims, No Drawings

ELECTROPHOTOSENSITIVE MATERIAL

BACKGROUND OF THE INVENTION

The present invention relates to an electrophotosensitive material which is used for image forming apparatuses utilizing an electrophotography, such as electrostatic copying machine, laser beam printer, etc.

The electrophotograpy such as Carlson process includes a step of uniformly charging the surface of an electrophotosensitive material by a corona discharge; an exposure step of exposing the surface of the charged electrophotosensitive material to form an electrostatic latent image on the surface of the electrophotosensitive material; a developing step of bringing the formed electrostatic latent image into contact with a developer to visualize the electrostatic latent image due to a toner contained in the developer to form a toner image; a transferring step of transferring the toner image on a paper; a fixing step of fixing the transferred toner image; and a cleaning step of removing the toner remained on the photosensitive material.

As the electrophotosensitive material to be used for the above electrophotography, there have recently been suggested various organic photoconductors using an organic photoconductive compound having little toxicity in place of an inorganic photoconductive material (e.g. selenium, cadmium sulfide, etc.) whose handling is difficult because of it's toxicity. Such an organic photoconductor has an advantage such as good processability, easy manufacturing and great deal of freedom for design of performance.

As the organic photoconductor, a distributed function photosensitive layer containing an electric charge generating layer which generates an electric charge by light irradiation, and an electric charge transferring layer which transfer the generated electric charge is exclusively used.

A lot of studies about a binding resin which contains the above electric charge generating material and electron transferring material (consisting of hole transferring material and/or electron transferring material) and constitutes a photosensitive layer have been made so as to increase a mechanical strength (e.g. wear resistance, scratch resistance, etc.) of the photosensitive layer to prolong the life of the photoconductor. Particularly, polycarbonate resins (e.g. bisphenol A type, C type, Z type, fluorine-containing type, biphenyl copolymer type, etc.) have widely been utilized (Japanese Laid-Open Patent Publication Nos. 60-172045, 60-192950, 61-62039, 63-148263, 1-273064, 5-80548 and 5-88396).

In addition, it has also been known that the mechanical strength of the photosensitive layer is improved by increasing the molecular weight of the above polycarbonate resin (Japanese Laid-Open Patent Publication Nos. 5-113671 and 5-158249).

The mechanical strength of the photosensitive layer is improved by using the above-described polycarbonate resin as the binding resin, but the degree of the improvement is insufficient. In addition, the polycarbonate resin is inferior in compatibility with electric charge transferring material and dispersion properties and, therefore, characteristics thereof can not be sufficiently utilized even if a material having excellent hole transferring characteristics is used. Accordingly, the sensitivity becomes inferior.

Furthermore, regarding a single-layer type photoconductor containing an electric charge transferring material and an electric charge generating material in a single layer, when using the polycarbonate resin as the binding resin in the photosensitive layer, the photosensitive layer is peeled off from a conductive substrate while using because the polycarbonate resin is inferior in adhesion to the conductive substrate such as aluminum, etc.

SUMMARY OF THE INVENTION

It is a main object of the present invention is to provide an electrophotosensitive material comprising a photosensitive layer in which a charge transferring material is uniformly dispersed in a binding resin, the electrophotosensitive material being superior in sensitivity.

It is another object of the present invention to provide an electrophotosensitive material provided with a photosensitive layer having a high mechanical strength such as wear resistance, etc. and being superior in adhesion to substrate.

The present inventors have studied intensively in order to accomplish the above objects. As a result, it has been found that, by using a specific electric charge transferring material, i.e. hole transferring material or electron transferring material, in combination with a specific polyester resin, the compatibility and dispersion properties of the electric charge transferring material to polyester resin are improved and, therefore, high electric charge transferring characteristics of the electric charge transferring material are fully exhibited, thereby improving the sensitivity of the photosensitive material.

The above specific polyester resin is superior in adhesion to conductive substrate and, therefore, the photosensitive layer is not likely to peel off from the conductive substrate while using the photosensitive material for a long period of time. Furthermore, the above polyester resin is also superior in mechanical strength such as wear resistance, etc. and, therefore, it becomes possible to prolong the life of the photosensitive material.

That is, the present invention provides an electrophotosensitive material comprising a conductive substrate and a photosensitive layer provided on the conductive substrate, the photosensitive layer comprising a binding resin of a polyester resin which is a substantially linear polymer obtained by using dihydroxy compounds represented by the following general formulas (1), (2) and (3), an electric charge generating material, and at least one of a hole transferring material selected from the group consisting of compounds represented by the following general formulas (HT1) to (HT13) and/or at least one of an electron transferring material selected from the group consisting of compounds represented by the following general formulas (ET1) to (ET14).

<Dihydroxy compounds>

General formula (1):

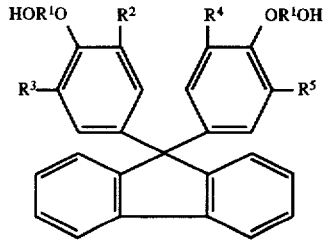

(1)

wherein $R^1$ is an alkylene group having 2 to 4 carbon atoms; and $R^2$, $R^3$, $R^4$ and $R^5$ are the same or different and indicate a hydrogen atom, an alkyl group having 1 to 4 carbon atoms, an aryl group or an aralkyl group General formula (2):

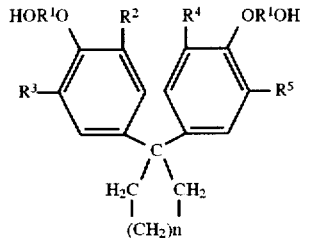

(2)

wherein $R^1$, $R^2$, $R^3$, $R^4$ and $R^5$ are as defined above; and n is an integer of not less than 2, preferably integer of 2 to 5

General formula (3):

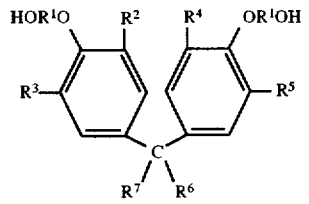

(3)

wherein $R^1$, $R^2$, $R^3$, $R^4$ and $R^5$ are as defined above; and $R^6$ and $R^7$ are the same or different and indicate an alkyl group having 1 to 10 carbon atoms <Hole transferring material>

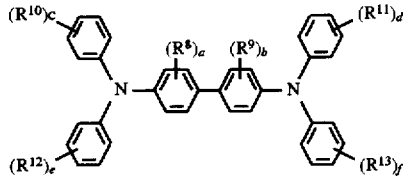

(HT1)

wherein $R^8$ $R^9$, $R^{10}$, $R^{11}$, $R^{12}$ and $R^{13}$ are the same or different and indicate a halogen atom, an alkyl group, an alkoxy group or an aryl group, and the alkyl group, alkoxy group and aryl group may have a substituent; and a, b, c, d, e and f are the same or different and indicate an integer of 0 to 5

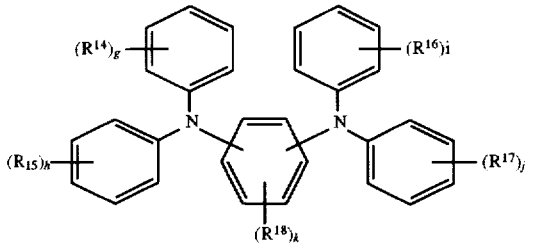

(HT2)

wherein $R^{14}$ $R^{15}$ $R^{160}$ $R^{17}$ and $R^{18}$ are the same or different and indicate a halogen atom, an alkyl group, an alkoxy group or an aryl group, and the alkyl group, alkoxy group and aryl group may have a substituent; and g, h, i, j and k are the same or different and indicate an integer of 0 to 5

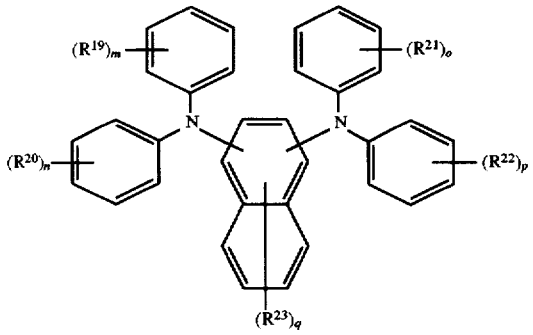

(HT3)

wherein $R^{19}$, $R^{20}$, $R^{21}$ and $R^{22}$ are the same or different and indicate a halogen atom, an alkyl group, an alkoxy group or an aryl group, and the alkyl group, alkoxy group and aryl group may have a substituent; $R^{23}$ are the same or different and indicate a halogen atom, a cyano group, a nitro group, an alkyl group, an alkoxy group or an aryl group, and the alkyl group, alkoxy group and aryl group may have a substituent; m, n, o and p are the same or different and indicate an integer of 0 to 5; and q is an integer of 0 to 6

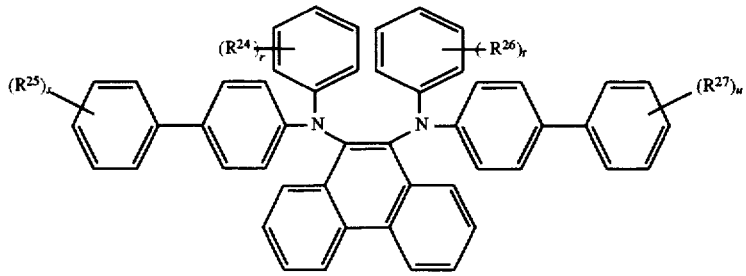

(HT4)

wherein $R^{24}$, $R^{25}$, $R^{26}$ and $R^{27}$ are the same or different and indicate a halogen atom, an alkyl group, an alkoxy group or an aryl group, and the alkyl group, alkoxy group and aryl group may have a substituent; and r, s, t and u are the same or different and indicate an integer of 0 to 5

(HT5)

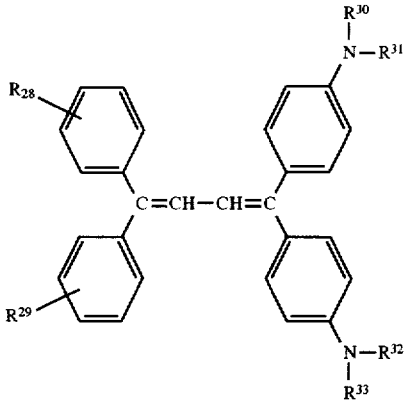

wherein $R^{28}$ and $R^{29}$ are the same or different and indicate a hydrogen atom, a halogen atom, an alkyl group or an alkoxy group; and $R^{30}$, $R^{31}$, $R^{32}$ and $R^{33}$ are the same or different and indicate a hydrogen atom, an alkyl group or an aryl group (HT6)

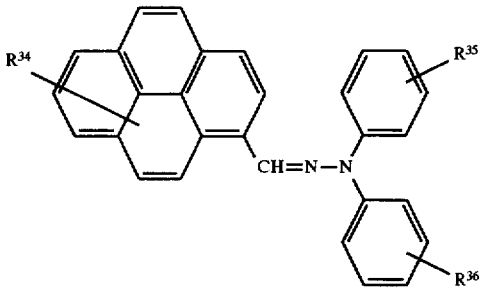

wherein $R^{34}$, $R^{35}$ and $R^{36}$ are the same or different and indicate a hydrogen atom, a halogen atom, an alkyl group or an alkoxy group (HT7)

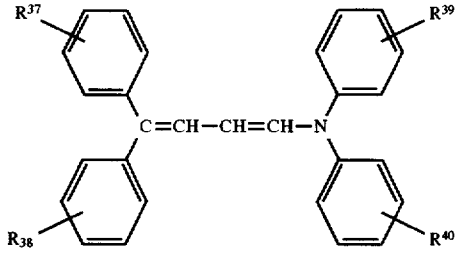

wherein $R^{37}$, $R^{38}$, $R^{39}$ and $R^{40}$ are the same or different and indicate a hydrogen atom, a halogen atom, an alkyl group or an alkoxy group (HT8)

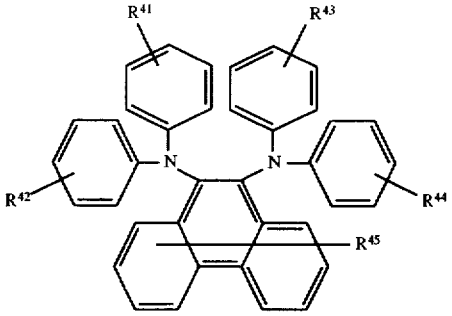

wherein $R^{41}$, $R^{42}$, $R^{43}$, $R^{44}$ and $R^{45}$ are the same or different and indicate a hydrogen atom, a halogen atom, an alkyl group or an alkoxy group (HT9)

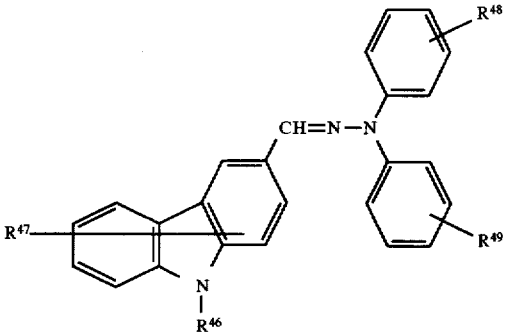

wherein $R^{46}$ is a hydrogen atom or an alkyl group; and $R^{47}$, $R^{48}$ and $R^{49}$ are the same or different and indicate a hydrogen atom, a halogen atom, an alkyl group or an alkoxy group (HT10)

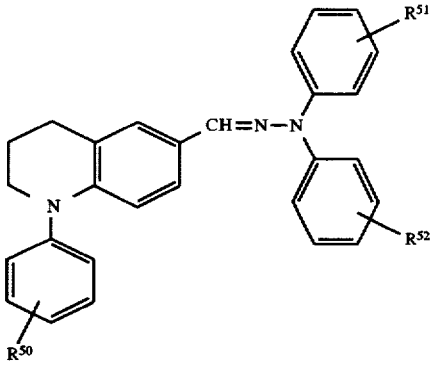

wherein $R^{50}$, $R^{51}$ and $R^{52}$ are the same or different and indicate a hydrogen atom, a halogen atom, an alkyl group or an alkoxy group (HT11)

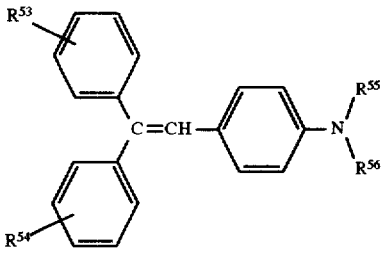

wherein $R^{53}$ and $R^{54}$ are the same or different and indicate a hydrogen atom, a halogen atom, an alkyl group or an alkoxy group; and $R^{55}$ and $R^{56}$ are the same or different and indicate a hydrogen atom, an alkyl group or an aryl group

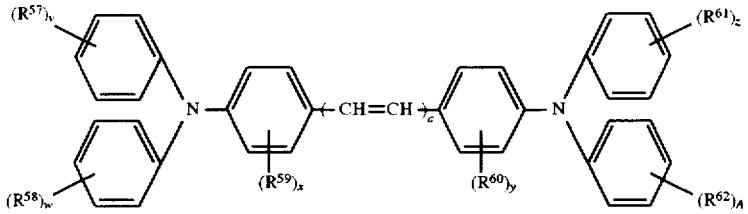

(HT12)

wherein $R^{57}$, $R^{58}$, $R^{59}$, $R^{60}$, $R^{61}$ and $R^{62}$ are the same or different and indicate an alkyl group, an alkoxy group or an aryl group; a is an integer of 1 to 10; and v, w, x, y, z and A are the same or different and indicate 0 to 2

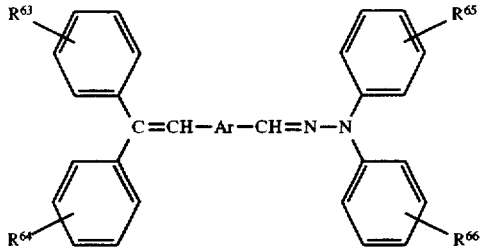

(HT13)

wherein $R^{63}$, $R^{64}$, $R^{65}$ and $R^{66}$ are the same or different and indicate a hydrogen atom, a halogen atom, an alkyl group or an alkoxy group; and Ar is a group (Ar1), (Ar2) or (Ar3) represented by the formulas:

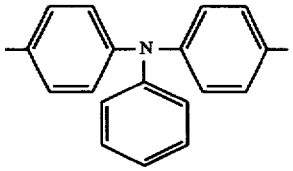

(Ar1)

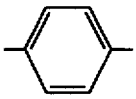

(Ar2)

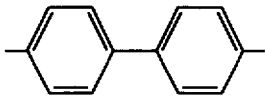

(Ar3)

<Electron transferring materials>

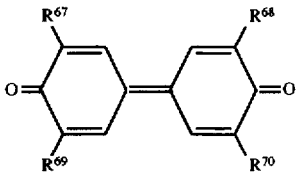

(ET1)

wherein $R^{67}$, $R^{68}$, $R^{69}$ and $R^{70}$ are the same or different and indicate a hydrogen atom, an alkyl group, an alkoxy group or an aryl group, and the alkyl group, alkoxy group and aryl group may have a substituent, provided that two of $R^{67}$, $R^{68}$, $R^{69}$ and $R^{70}$ are the same groups

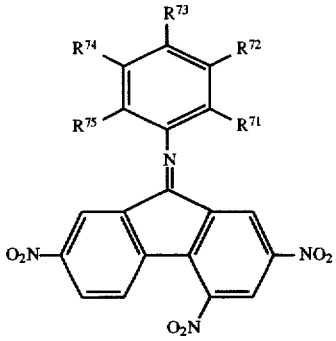

(ET2)

wherein $R^{71}$, $R^{72}$, $R^{73}$, $R^{74}$ and $R^{75}$ are the same or different and indicate a hydrogen atom, an alkyl group, an alkoxy group, an aryl group, an aralkyl group or a halogen atom

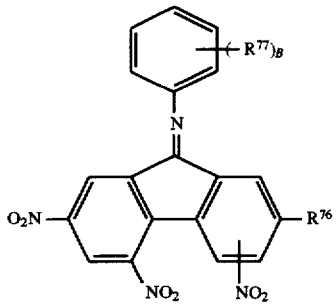

(ET3)

wherein $R^{76}$ is an alkyl group; $R^{77}$ is an alkyl group, an alkoxy group, an aryl group, an aralkyl group, a halogen atom or a halogen-substituted alkyl group; and B is an integer of 0 to 5

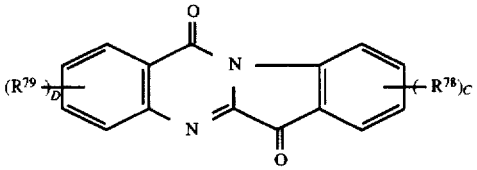

(ET4)

wherein $R^{78}$ and $R^{79}$ are the same or different and indicate an alkyl group; C is an integer of 1 to 4; and D is an integer of 0 to 4

(ET5)

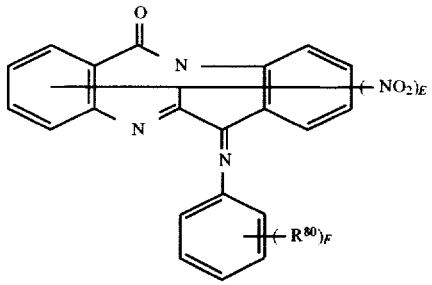

wherein $R^{80}$ is an alkyl group, an aryl group, an aralkyl group, an alkoxy group, a halogen-substituted alkyl group or a halogen atom; E is an integer of 0 to 4; and F is an integer of 0 to 5

(ET6)

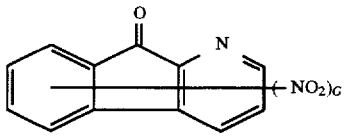

wherein G is an integer of 1 or 2

(ET7)

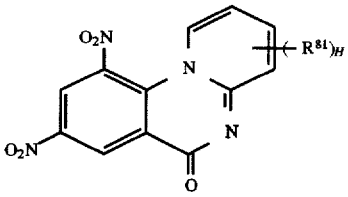

wherein $R^{81}$ is an alkyl group; and H is an integer of 1 to 4.

(ET8)

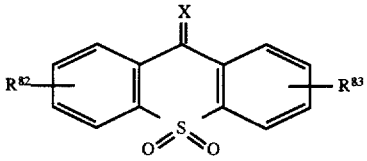

wherein $R^{82}$ and R83 are the same or different and indicate a hydrogen atom, a halogen atom, an alkyl group, an aryl group, an aralkyloxycarbonyl group, an alkoxy group, a hydroxyl group, a nitro group or a cyano group; and X indicates O, N—CN or $C(CN)_2$ (ET9)

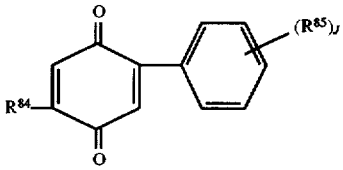

wherein $R^{84}$ is a hydrogen atom, a halogen atom, an alkyl group or a phenyl group which may have a substituent; $R^{85}$ is a hydrogen atom, a halogen atom, an alkyl group which may have a substituent, a phenyl group which may have a substituent, an alkoxycarbonyl group, a N-alkylcarbamoyl group, a cyano group or a nitro group; and J is an integer of 1 to 3

(ET10)

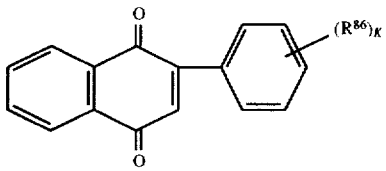

wherein $R^{86}$ is an alkyl group which may have a substituent, a phenyl group which may have a substituent, a halogen atom, an alkoxycarbonyl group, a N-alkylcarbamoyl group, a cyano group or a nitro group; and K is an integer of 0 to 3

(ET11)

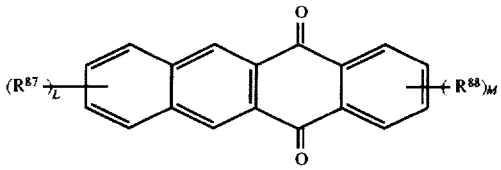

wherein $R^{87}$ and $R^{88}$ are the same or different and indicate a halogen atom, an alkyl group which may have a substituent, a cyano group, a nitro group or an alkoxycarbonyl group; and L and M indicate an integer of 0 to 3

(ET12)

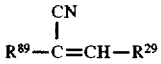

wherein $R^{89}$ and $R^{90}$ are the same or different and indicate a phenyl group, a polycyclic aromatic group or a heterocyclic group, and these groups may have a substituent (ET13)

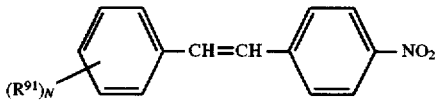

wherein $R^{91}$ is an amino group, a dialkylamino group, an alkoxy group, an alkyl group or a phenyl group; and N is an integer of 1 or 2

(ET14)

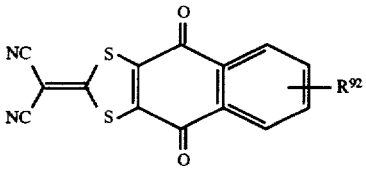

wherein $R^{92}$ is a hydrogen atom, an alkyl group, an aryl group, an alkoxy group or an aralkyl group As the above binding resin, the polyester resin which is the substantially linear polymer obtained by using at least one of dihydroxy compounds represented by the general formula (1), (2) and (3) may be used in combination with a polycarbonate resin. Thereby, the compatibility is improved by the polycarbonate resin even if the polyester resin is used in combination with a material which is inferior in compatibility with polycarbonate resin.

Since the polyester resin in the present invention is superior in adhesion to conductive substrate, as described above, the above organic photosensitive layer using the polyester resin as the binding resin is suitable for using in the form of the single layer.

DETAILED EXPLANATION OF THE INVENTION

Examples of the alkylene group having 2 to 4 carbon atoms include ethylene group, propylene group, tetramethylene group.

Examples of the alkyl group include alkyl groups having 1 to 6 carbon atoms, such as methyl group, ethyl group, propyl group, isopropyl group, butyl group, isobutyl group, t-butyl group, pentyl group or hexyl group. The above alkyl groups having 1 to 4 carbon atoms are alkyl groups having 1 to 6 carbon atoms excluding pentyl and hexyl groups. The alkyl groups having 1 to 10 carbon atoms are groups including octyl, nonyl and decyl groups, in addition to the above-described alkyl groups having 1 to 6 carbon atoms.

Examples of the aryl group include phenyl group, tolyl group, xylyl group, biphenylyl group, o-terphenyl group, naphthyl group, anthryl group or phenanthryl group.

Examples of the aralkyl group include aralkyl groups whose alkyl group moiety has 1 to 6 carbon atoms, such as benzyl group, phenethyl group, trityl group or benzhydryl group.

Examples of the alkoxy group include alkoxy groups having 1 to 6 carbon atoms, such as methoxy group, ethoxy group, propoxy group, isopropoxy group, butoxy group, isobutoxy group, t-butoxy group, pentyloxy group or hexyloxy group.

Examples of the halogen-substituted alkyl group include groups whose alkyl group moiety has 1 to 6 carbon atoms, such as chrolomethyl group, bromomethyl group, fluoromethyl group, iodomethyl group, 2-chloroethyl group, 1-fluoroethyl group, 3-chloropropyl group, 2-bromopropyl group, 1-chloropropyl group, 2-chloro-1-methylethyl group, 1-bromo-1-methylethyl group, 4-iodobutyl group, 3-fluorobutyl group, 3-chloro-2-methylpropyl group, 2-iodo-2-methylpropyl group, 1-fluoro-2-methylpropyl group, 2-chloro-1,1-dimethylethyl group, 2-bromo-1,1-dimethylethyl group, 5-bromopentyl group or 4-chlorohexyl group.

Examples of the polycyclic aromatic group include naphthyl group, phenanthryl group or anthryl group.

Examples of the heterocyclic group include thienyl group, pyrrolyl group, pyrrolidinyl group, oxazolyl group, isoxazolyl group, thiazolyl group, isothiazolyl group, imidazolyl group, 2H-imidazolyl group, pyrazolyl group, triazolyl group, tetrazolyl group, pyranyl group, pyridyl group, piperidyl group, piperidino group, 3-morpholinyl group, morpholino group or thiazolyl group. In addition, it may also be a heterocylic group condensed with an aromatic ring.

Examples of the substituent which may be substituted on the above groups include halogen atom, amino group, hydroxyl group, optionally esterified carboxyl group, cyano group, alkyl groups having 1 to 6 carbon atoms, alkoxy groups having 1 to 6 carbon atoms, or alkenyl groups having 2 to 6 carbon atoms which may have an aryl group.

Next, examples of the hole transferring material will be described.

Examples of the benzidine derivative represented by the general formula (HT1) include the following compounds (HT1-1) to (HT1-11).

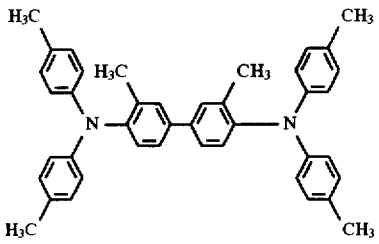

(HT1-1)

-continued

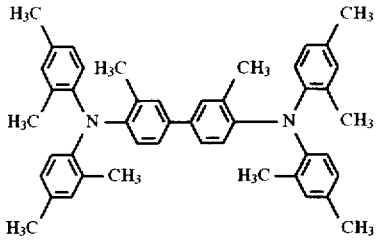

(HT1-2)

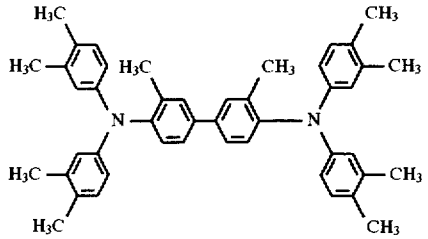

(HT1-3)

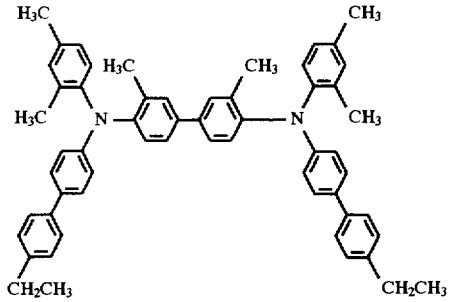

(HT1-4)

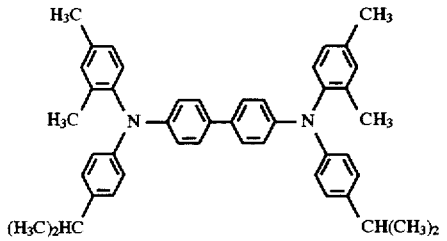

(HT1-5)

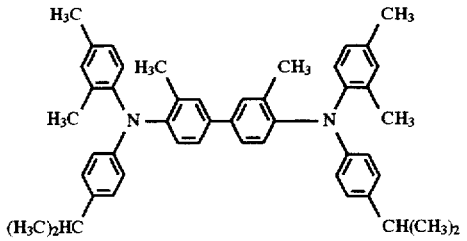

(HT1-6)

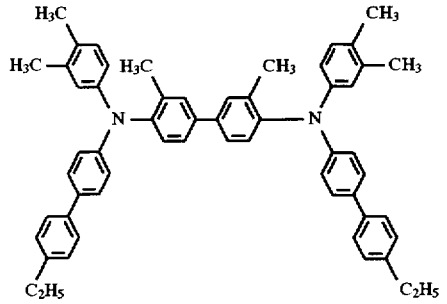

(HT1-7)

-continued
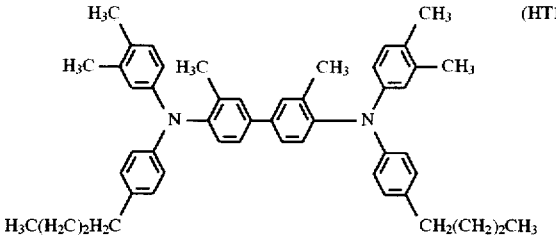
(HT1-8)
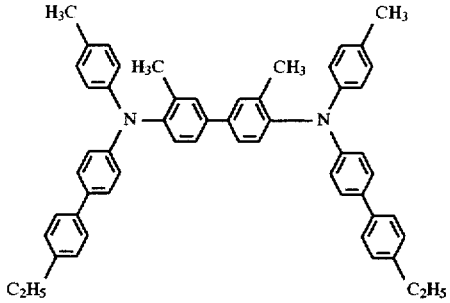
(HT1-9)
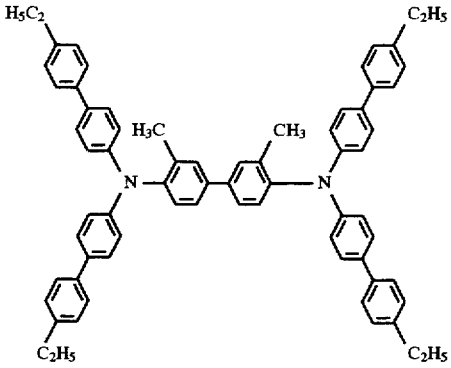
(HT1-10)
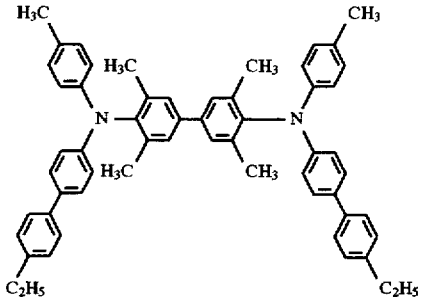
(HT1-11)
Examples of the phenylenediamine derivative represented by the general formula (HT2) include the following compounds (HT2-1) to (HT2-6).
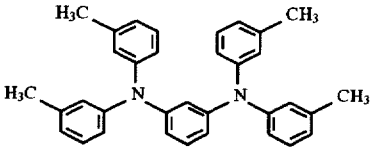
(HT2-1)
-continued
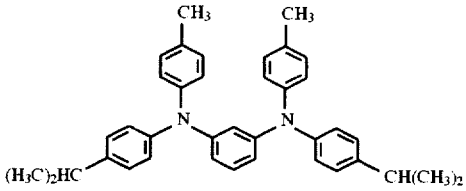
(HT2-2)
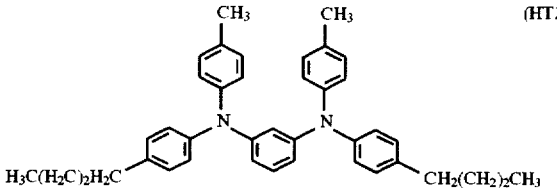
(HT2-3)
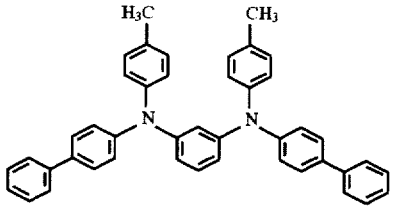
(HT2-4)
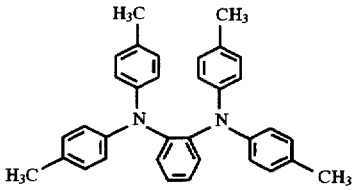
(HT2-5)
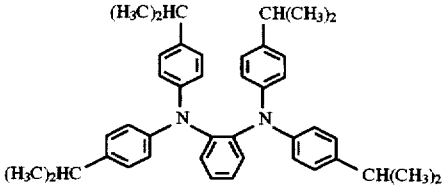
(HT2-6)
Examples of the naphthylenediamine derivative represented by the general formula (HT3) include the following compounds (HT3-1) to (HT3-5).
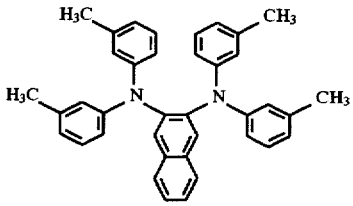
(HT3-1)
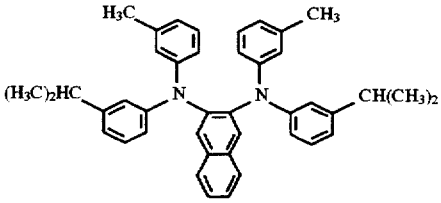
(HT3-2)

-continued (HT3-3)

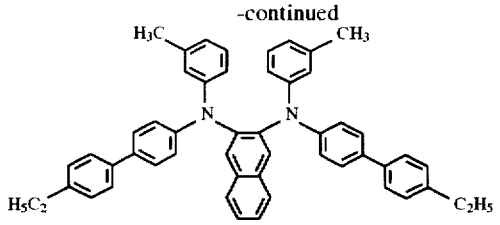

(HT3-4)

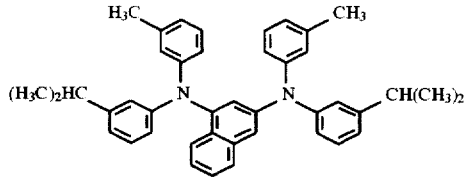

(HT3-5)

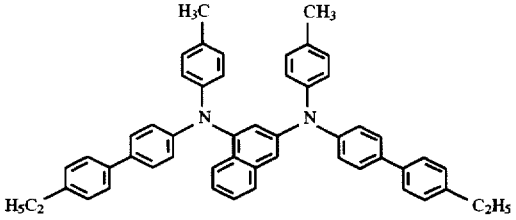

Examples of the phenythrenediamine derivative represented by the general formula (HT4) include the following compounds (HT4-1) to (HT4-3).

(HT4-1)

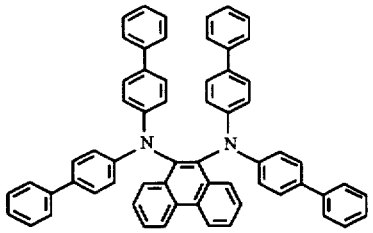

(HT4-2)

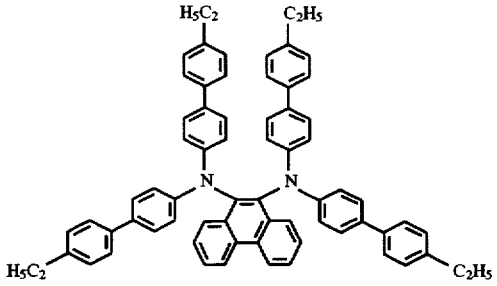

(HT4-3)

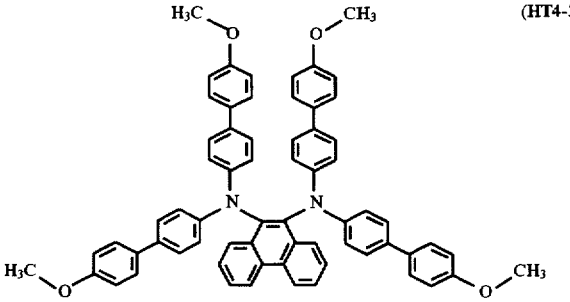

Examples of the butadiene derivative represented by the general formula (HT5) include the following compound (HT5-1).

(HT5-1)

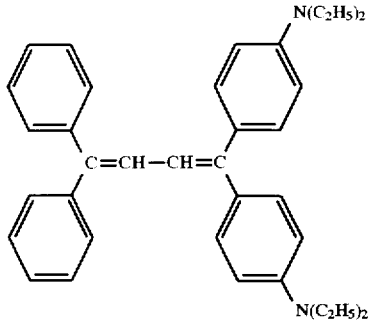

Examples of the pyrene-hydrazone derivative represented by the general formula (HT6) include the following compound (HT6-1).

(HT6-1)

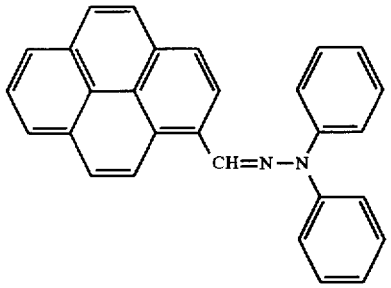

Examples of the acrolein derivative represented by the general formula (HT7) include the following compound (HT7-1).

(HT7-1)

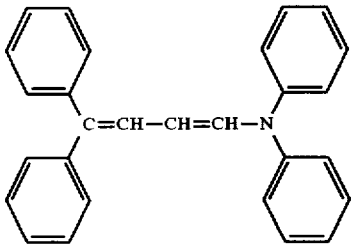

Examples of the phenanthrenediamine derivative represented by the general formula (HT8) include the following compounds (HT8-1) and (HT8-2).

(HT8-1)

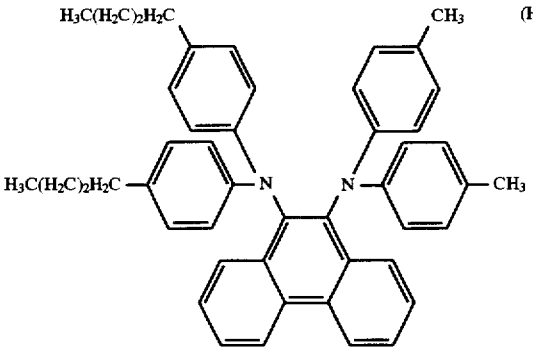

-continued (HT8-2)

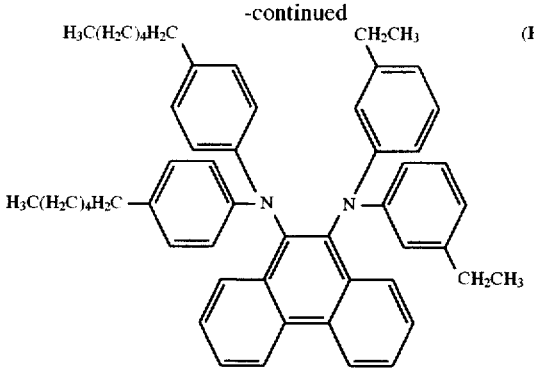

Examples of the carbazole-hydrazone derivative represented by the general formula (HT9) include the following compounds (HT9-1) and (HT9-2).

(HT9-1)

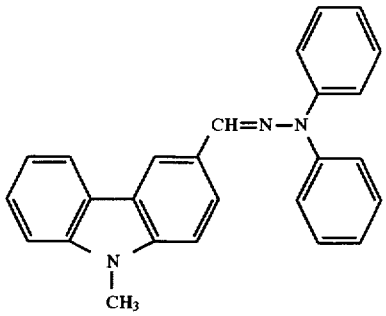

(HT9-2)

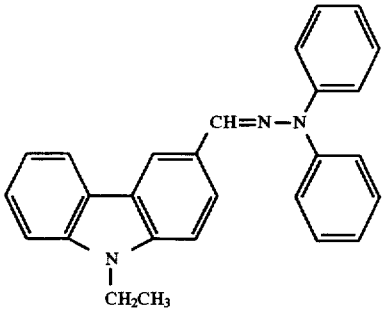

Examples of the quinoline-hydrazone derivative represented by the general formula (HT10) include the following compounds (HT10-1) and (HT10-2).

(HT10-1)

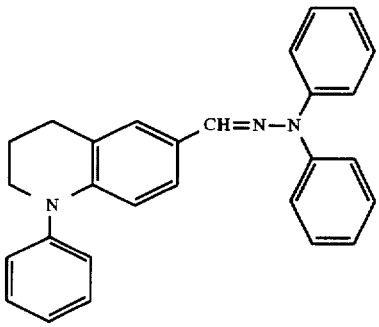

-continued (HT10-2)

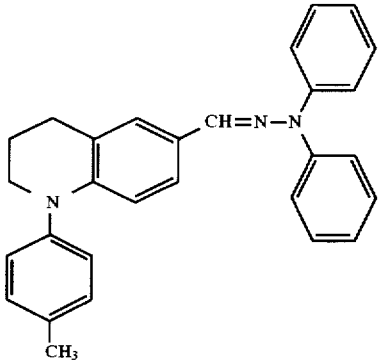

Examples of the stilbene derivative represented by the general formula (HT11) include the following compounds (HT11-1) and (HT11-2).

(HT11-1)

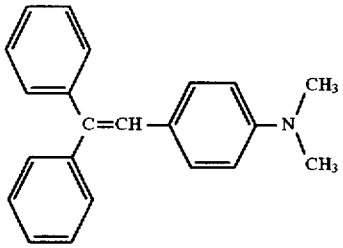

(HT11-2)

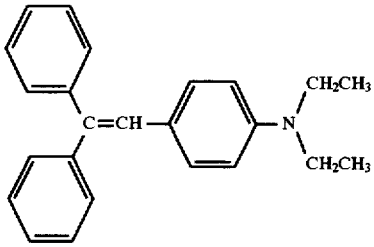

Examples of the compound represented by the general formula (HT12) include the following compounds (HT12-1) and (HT12-2).

(HT12-1)

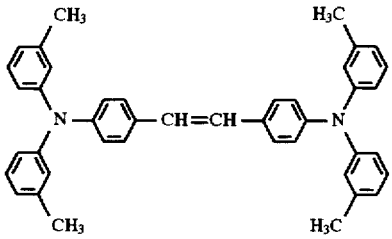

(HT12-2)

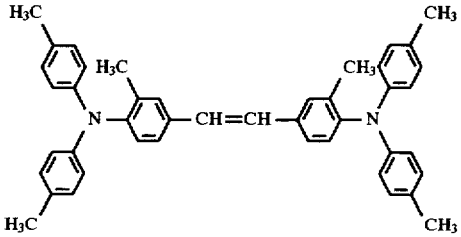

Examples of the compound represented by the general formula (HT13) include the following compounds (HT13-1) to (HT13-3).

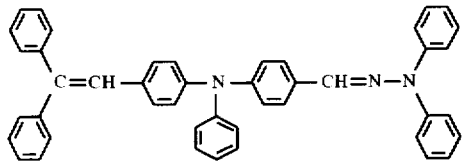
(HT13-1)
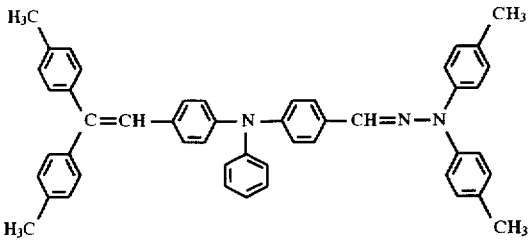
(HT13-2)
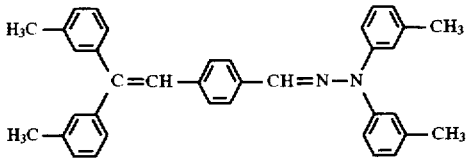
(HT13-3)
Next, examples of the electron transferring material will be described.
Examples of the diphenoquinone derivative represented by the general formula (ET1) include the following compounds (ET1-1) and (ET1-2).
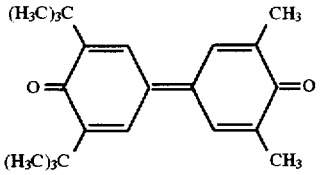
(ET1-1)
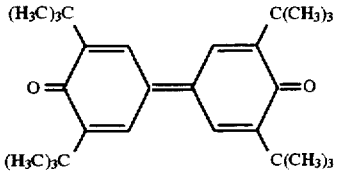
(ET1-2)
Examples of the compound represented by the general formula (ET2) include the following compounds (ET2-1) to (ET2-7).
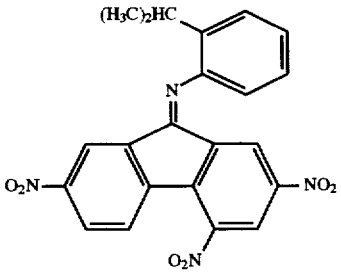
(ET2-1)
-continued
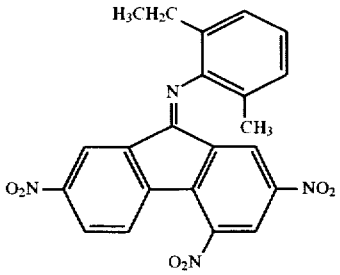
(ET2-2)
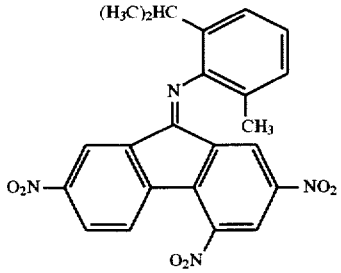
(ET2-3)
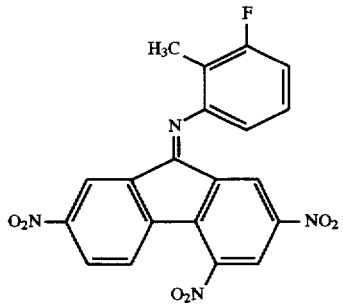
(ET2-4)
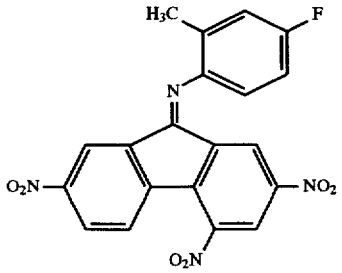
(ET2-5)
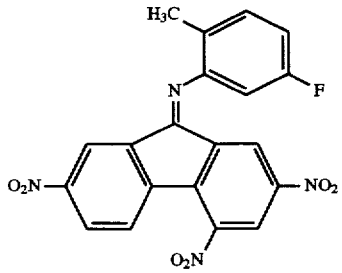
(ET2-6)

-continued
(ET2-7)
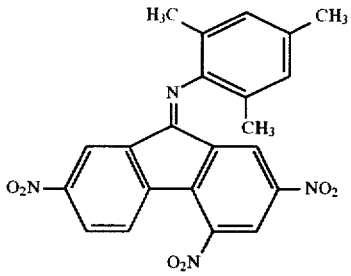
Examples of the compound represented by the general formula (ET3) include the following compounds (ET3-1) to (ET3-5).
(ET3-1)
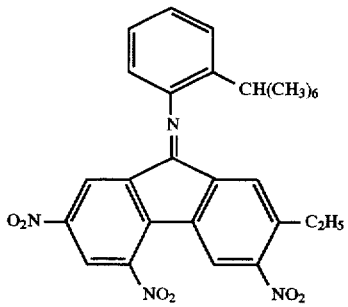
(ET3-2)
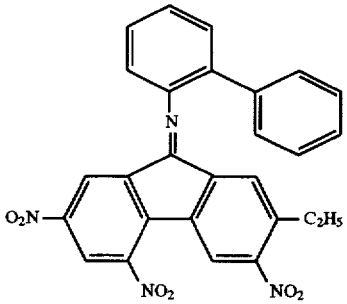
(ET3-3)
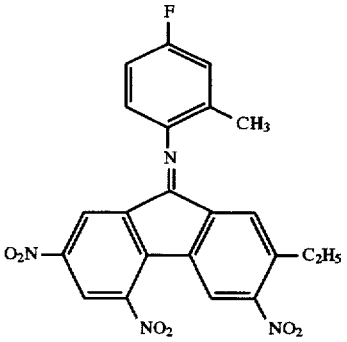
-continued
(ET3-4)
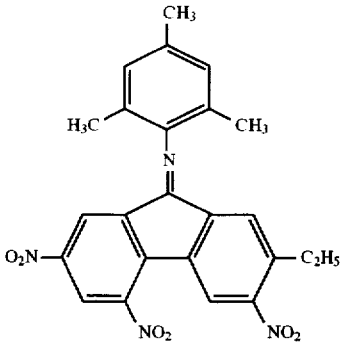
(ET3-5)
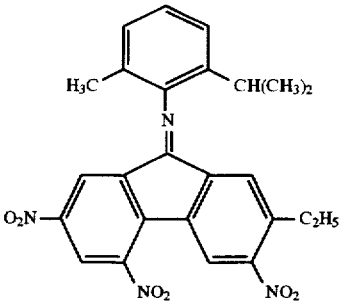
Examples of the compound represented by the general formula (ET4) include the following compounds (ET4-1) and (ET4-2).
(ET4-1)
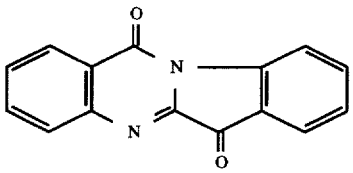
(ET4-2)
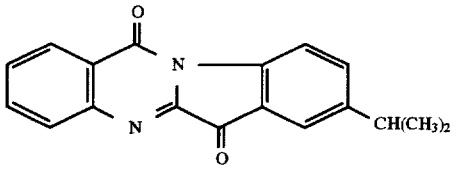
Examples of the compound represented by the general formula (ET5) include the following compounds (ET5-1) and (ET5-2).
(ET5-1)
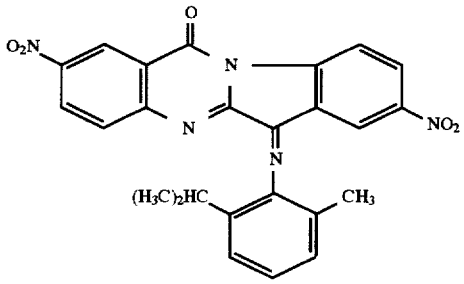

-continued (ET5-2)

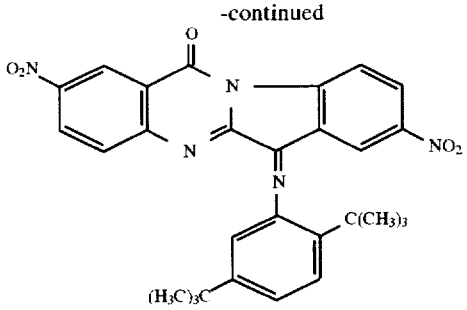

Examples of the compound represented by the general formula (ET6) include the following compounds (ET6-1) and (ET6-2).

(ET6-1)

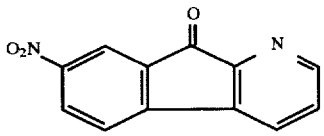

(ET6-2)

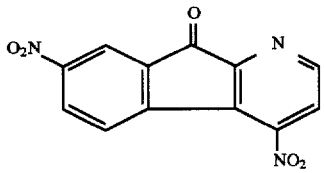

Examples of the compound represented by the general formula (ET7) include the following compounds (ET7-1) and (ET7-2).

(ET7-1)

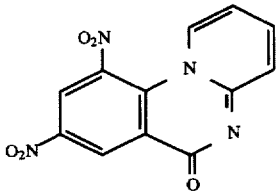

(ET7-2)

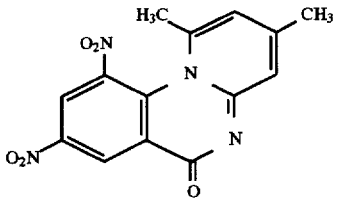

Examples of the compound represented by the general formula (ET8) include the following compounds (ET8-1) to (ET8-3).

(ET8-1)

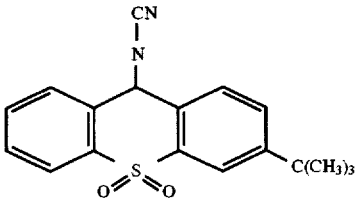

-continued (ET8-2)

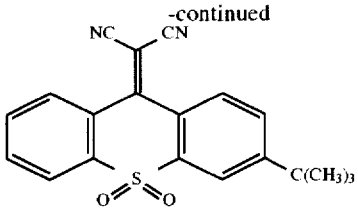

(ET8-3)

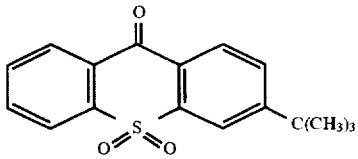

Examples of the compound represented by the general formula (ET9) include the following compound (ET9-1).

(ET9-1)

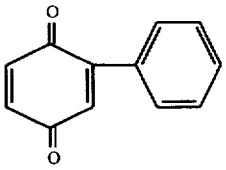

Examples of the compound resented by the general formula (ET10) include the following compound (ET10-1).

(ET10-1)

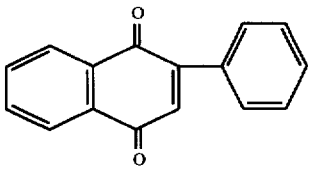

Examples of the compound represented by the general formula (ET11) include the following compound (ET11-1).

(ET11-1)

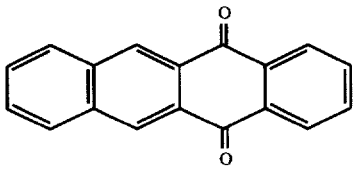

Examples of the compound represented by the general formula (ET12) include the following compound (ET12-1).

(ET12-1)

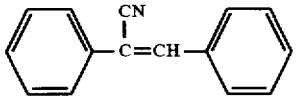

Examples of the compound represented by the general formula (ET13) include the following compound (ET13-1).

(ET13-1)

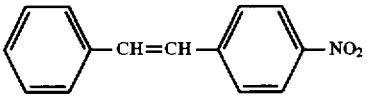

Examples of the compound represented by the general formula (ET14) include the following compound (ET14-1).

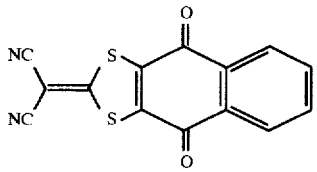

(ET14-1)

Next, the polyester resin to be used as the binding resin in the present invention will be explained.

The polyester resin in the present invention is a substantially linear polymer using the dihydroxy compound represented by the general formula (1), (2) or (3), as described above. That is, this polyester resin is a copolymer obtained by subjecting dicarboxylic acid or an ester-forming derivative thereof, at least one of the above dihydroxy compounds and other diol to polycondensation. The proportion of the above dihydroxy compound in the diol component is not less than 10 molar %, preferably not less than 30 molar %, more preferably not less than 50 molar %. When the proportion of the dihydroxy compound is lower than 10 molar %, the heat resistance is inferior and the molded article is liable to be deformed by heat. In addition, the dispersion properties and solubility to organic solvent of the colorant are liable to be deteriorated.

The polyester resin in the present invention has a limiting viscosity (measured in chloroform at 20° C.) of not less than 0.3 dl/g, preferably not less than 0.6 dl/g. When the limiting viscosity is less than 0.3 dl/g, mechanical characteristics (particularly, wear resistance, etc.) of the photosensitive material are deteriorated. On the other hand, when the limiting viscosity is more than 0.6 dl/g, the molded article having a sufficient mechanical characteristics can be obtained. However, it takes a longer time to dissolve the polyester resin in a solvent as the limiting viscosity becomes larger, and the viscosity of the solution is liable to increase. When the viscosity of the solution is too high, it becomes difficult to apply a coating solution for forming an organic photosensitive layer on a conductive substrate. Therefore, when the limiting viscosity increases two-fold or more, a problem on practical use arises. A polyester resin having an optimum limiting viscosity can be easily obtained by controlling melt polymerization conditions (e.g. molecular weight modifier, polymerization time, polymerization temperature, etc.) and conditions of the chain extending reaction of the postprocess).

The reason why the polyester resin is superior in compatibility and dispersion properties to the hole transferring material in the present invention is assumed that the solubility in solvent is improved by using the dihydroxy compound (1), (2) or (3) as the copolymerization component, without deteriorating the moldability of the polyester resin. In addition, the reason why the polyester resin is superior in adhesion to conductive substrate is considered that the ester bond moiety in the molecule of the polyester resin contributes to the adhesion to metal. Furthermore, the reason why the wear resistance of the photosensitive layer is improved is assumed that entanglement of polymer molecular chains is increased and the elasticity modulus is also increased by copolymerizing with the dihydroxy compound.

Examples of the dicarboxylic acid or ester-forming derivative thereof include aromatic dicarboxylic acids such as terephthalic acid, isophthalic acid, 2,6-naphthalenedicarboxylic acid, 1,8-naphthalenedicarboxylic acid, 1,4-naphthalenedicarboxylic acid, 1,2-naphthalenedicarboxylic acid, 1,3-naphthalenedicarboxylic acid, 1,5-naphthalenedicarboxylic acid, 1,6-naphthalenedicarboxylic acid, 1,7-naphthalenedicarboxylic acid, 2,3-naphthalenedicarboxylic acid, 2,7-naphthalenedicarboxylic acid, 2,2'-biphenyldicarboxylic acid, 3,3'-biphenyldicarboxylic acid, 4,4'-biphenyldicarboxylic acid, 9,9'-bis(4-carboxyphenylene) fluorene, etc.; aliphatic dicarboxylic acids such as maleic acid, adipic acid, sebacic acid, decamethylenedicarboxylic acid, etc.; and ester-forming derivatives thereof. These may be used alone or in combination thereof.

Examples of the fluorene dihydroxy compound represented by the above general formula (1) include 9,9-bis[4-(2-hydroxyethoxy)phenyl]fluorene, 9,9-bis[4-(2-hydroxyethoxy)-3-methylphenyl]fluorene,9,9-bis[4-(2-hydroxyethoxy)-3,5-dimethylphenyl]fluorene, 9,9-bis[4-(2-hydroxyethoxy)-3-ethylphenyl]fluorene, 9,9-bis[4-(2-hydroxyethoxy)-3,5-diethylphenyl]fluorene, 9,9-bis[4-(2-hydroxyethoxy)-3-propylphenyl]fluorene, 9,9-bis[4-(2-hydroxyethoxy)-3,5-dipropylphenyl]fluorene, 9,9-bis[4-(2-hydroxyethoxy)-3-isopropylphenyl]fluorene, 9,9-bis[4-(2-hydroxyethoxy)-3,5-diisopropylphenyl]fluorene, 9,9-bis[4-(2-hydroxyethoxy)-3-n-butylphenyl]fluorene, 9,9-bis[4-(2-hydroxyethoxy)-3,5-di-n-butylphenyl]fluorene, 9,9-bis[4-(2-hydroxyethoxy)-3-isobutylphenyl]fluorene, 9,9-bis[4-(2-hydroxyethoxy)-3,5-diisobutylphenyl]fluorene, 9,9-bis[4-(2-hydroxyethoxy)-3-(1-methylpropyl)phenyl]fluorene, 9,9-bis[4-(2-hydroxyethoxy)-3,5-bis(1-methylpropyl)phenyl]fluorene, 9,9-bis[4-(2-hydroxyethoxy)-3-phenylphenyl]fluorene, 9,9-bis[4-(2-hydroxyethoxy)-3,5-diphenylphenyl]fluorene, 9,9-bis[4-(2-hydroxyethoxy)-3-benzylphenyl]fluorene, 9,9-bis[4-(2-hydroxyethoxy)-3,5-dibenzylphenyl]fluorene, 9,9-bis[4-(3-hydroxypropoxy)phenyl]fluorene, 9,9-bis[4-(4-hydroxybutoxy)phenyl]fluorene, etc. These may be used alone or in combination thereof. Among them, 9,9-bis[4-(2-hydroxyethoxy)phenyl]fluorene is preferred in view of optical characteristics and moldability.

The cycloalkane dihydroxy compound represented by the above general formula (2) may be any one which is synthesized from cycloalkanone, and examples thereof include dihydroxy compounds to be derived from cyclohexanone, such as 1,1-bis[4-(2-hydroxyethoxy)phenyl]cyclohexane, 1,1-bis[4-(2-hydroxyethoxy)-3-methylphenyl]cyclohexane, 1,1-bis[4-(2-hydroxyethoxy)-3,5-dimethylphenyl]cyclohexane, 1,1-bis[4-(2-hydroxyethoxy)-3-ethylphenyl]cyclohexane, 1,1-bis[4-(2-hydroxyethoxy)-3,5-diethylphenyl]cyclohexane, 1,1-bis[4-(2-hydroxyethoxy)-3-propylphenyl]cyclohexane, 1,1-bis[4-(2-hydroxyethoxy)-3,5-dipropylphenyl]cyclohexane, 1,1-bis[4-(2-hydroxyethoxy)-3-isopropylphenyl]cyclohexane, 1,1-bis[4-(2-hydroxyethoxy)-3,5-diisopropylphenyl]cyclohexane, 1,1-bis[4-(2-hydroxyethoxy)-3-n-butylphenyl]cyclohexane, 1,1-bis[4-(2-hydroxyethoxy)-3,5-di-n-butylphenyl]cyclohexane, 1,1-bis[4-(2-hydroxyethoxy)-3-isobutylphenyl]cyclohexane, 1,1-bis[4-(2-hydroxyethoxy)-3,5-diisobutylphenyl]cyclohexane, 1,1-bis[4-(2-hydroxyethoxy)-3-(1-methylpropyl)phenyl]cyclohexane, 1,1-bis[4-(2-hydroxyethoxy)-3,5-bis(1-methylpropyl)phenyl]cyclohexane, 1,1-bis[4-(2-hydroxyethoxy)-3-phenylphenyl]cyclohexane, 1,1-bis[4-(2-hydroxyethoxy)-3,5-diphenylphenyl]cyclohexane, 1,1-bis[4-(2-hydroxyethoxy)-3-benzylphenyl]cyclohexane, 1,1-bis[4-(2-hydroxyethoxy)-3,5-dibenzylphenyl]cyclohexane, 1,1-bis[4-(2-hydroxyethoxy)phenyl]-4-methylcyclohexane, 1,1-bis[4-(2-hydroxyethoxy)phenyl]-2,4,6-trimethylcyclohexane, 1,1-bis[4-(2-hydroxypropoxy)phenyl]cyclohexane, 1,1-bis[4-(2-hydroxybutoxy)phenyl]cyclohexane, etc.;

dihydroxy compounds to be derived from cyclopentanone, such as 1,1-bis[4-(2-hydroxyethoxy)

phenyl|cyclopentane, 1,1-bis|4-(2-hydroxyethoxy)-3-methylphenyl|cyclopentane, 1,1-bis|4-(2-hydroxyethoxy)-3,5-dimethylphenyl|cyclopentane, 1,1-bis|4-(2-hydroxyethoxy)-3-ethylphenyl|cyclopentane, 1,1-bis|4-(2-hydroxyethoxy)-3,5-diethylphenyl|cyclopentane, 1,1-bis|4-(2-hydroxyethoxy)-3-propylphenyl|cyclopentane, 1,1-bis|4-(2-hydroxyethoxy)-3,5-dipropylphenyl|cyclopentane, 1,1-bis|4-(2-hydroxyethoxy)-3-isopropylphenyl|cyclopentane, 1,1-bis|4-(2-hydroxyethoxy)-3,5-diisopropylphenyl|cyclopentane, 1,1-bis|4-(2-hydroxyethoxy)-3-n-butylphenyl|cyclopentane, etc.;

dihydroxy compounds to be derived from cycloheptanone, such as 1,1-bis|4-(2-hydroxyethoxy)phenyl|cycloheptane, 1,1-bis|4-(2-hydroxyethoxy)-3-methylphenyl|cycloheptane, 1,1-bis|4-(2-hydroxyethoxy)-3,5-dimethylphenyl|cycloheptane, 1,1-bis|4-(2-hydroxyethoxy)-3-ethylphenyl|cycloheptane, 1,1-bis|4-(2-hydroxyethoxy)-3,5-diethylphenyl|cycloheptane, 1,1-bis|4-(2-hydroxyethoxy)-3-propylphenyl|cycloheptane, 1,1-bis|4-(2-hydroxyethoxy)-3,5-dipropylphenyl|cycloheptane, 1,1-bis|4-(2-hydroxyethoxy)-3-isopropylphenyl|cycloheptane, 1,1-bis|4-(2-hydroxyethoxy)-3,5-diisopropylphenyl|cycloheptane, 1,1-bis|4-(2-hydroxyethoxy)-3-n-butylphenyl|cycloheptane, etc.;

dihydroxy compounds to be derived from cyclooctanone, such as 1,1-bis|4-(2-hydroxyethoxy)phenyl|cyclooctane, 1,1-bis|4-(2-hydroxyethoxy)-3-methylphenyl|cyclooctane, 1,1-bis|4-(2-hydroxyethoxy)-3,5-dimethylphenyl|cyclooctane, 1,1-bis|4-(2-hydroxyethoxy)-3-ethylphenyl|cyclooctane, 1,1-bis|4-(2-hydroxyethoxy)-3,5-diethylphenyl|cyclooctane, 1,1-bis|4-(2-hydroxyethoxy)-3-propylphenyl|cyclooctane, 1,1-bis|4-(2-hydroxyethoxy)-3,5-dipropylphenyl|cyclooctane, 1,1-bis|4-(2-hydroxyethoxy)-3-isopropylphenyl|cyclooctane, 1,1-bis|4-(2-hydroxyethoxy)-3,5-diisopropylphenyl|cyclooctane, 1,1-bis|4-(2-hydroxyethoxy)-3-n-butylphenyl|cyclooctane, etc.; but are not limited in these compounds.

These cycloalkane dihydroxy compounds synthesized from cycloalkanone can be used alone or in combination thereof.

Among them, 1,1-bis|4-(2-hydroxyethoxy)phenyl|cyclohexane, 1,1-bis|4-(2-hydroxyethoxy)-3-methylphenyl|cyclohexane, 1,1-bis|4-(2-hydroxyethoxy)-3,5-dimethylphenyl|cyclohexane, 1,1-bis|4-(2-hydroxyethoxy)phenyl|cyclopentane, 1,1-bis|4-(2-hydroxyethoxy)-3-methylphenyl|cyclopentane, 1,1-bis|4-(2-hydroxyethoxy)-3,5-dimethylphenyl|cyclopentane, 1,1-bis|4-(2-hydroxyethoxy)phenyl|cyclooctane, 1,1-bis|4-(2-hydroxyethoxy)-3-methylphenyl|cyclooctane and 1,1-bis|4-(2-hydroxyethoxy)-3,5-dimethylphenyl|cyclooctane are preferred in view of moldability.

The dihydroxy compound represented by the above general formula (3) may be any one which can be synthesized from alkanone, that is, dihydroxy compound represented by the general formula $C_mH_{2m}O$ (m is an integer) which is derived from a straight-chain alkanone including a branched alkanone. Examples of the dihydroxy compound (3) include dihydroxy compounds to be derived from 4-methyl-2-pentanone, such as 2,2-bis|4-(2-hydroxyethoxy)phenyl|-4-methylpentane, 2,2-bis|4-(2-hydroxyethoxy)-3-methylphenyl|-4-methylpentane, 2,2-bis|4-(2-hydroxyethoxy)-3,5-dimethylphenyl|-4-methylpentane, 2,2-bis|4-(2-hydroxyethoxy)-3-ethylphenyl|-4-methylpentane, 2,2-bis|4-(2-hydroxyethoxy)-3,5-diethylphenyl|-4-methylpentane, 2,2-bis|4-(2-hydroxyethoxy)-3-propylphenyl|-4-methylpentane, 2,2-bis|4-(2-hydroxyethoxy)-3,5-dipropylphenyl|-4-methylpentane, 2,2-bis|4-(2-hydroxyethoxy)-3-isopropylphenyl|-4-methylpentane, 2,2-bis|4-(2-hydroxyethoxy)-3,5-diisopropylphenyl|-4-methylpentane, etc.;

dihydroxy compounds to be derived from 3-methyl-2-butanone, such as 2,2-bis|4-(2-hydroxyethoxy)phenyl|-3-methylbutane, 2,2-bis|4-(2-hydroxyethoxy)-3-methylphenyl|-3-methylbutane, 2,2-bis|4-(2-hydroxyethoxy)-3,5-dimethylphenyl|-3-methylbutane, 2,2-bis|4-(2-hydroxyethoxy)-3-ethylphenyl|-3-methylbutane, 2,2-bis|4-(2-hydroxyethoxy)-3,5-diethylphenyl|-3-methylbutane, etc.;

dihydroxy compounds to be derived from 3-pentanone, such as 3,3-bis|4-(2-hydroxyethoxy)phenyl|pentane, 3,3-bis|4-(2-hydroxyethoxy)-3-methylphenyl|pentane, 3,3-bis|4-(2-hydroxyethoxy)-3,5-dimethylphenyl|pentane, 3,3-bis|4-(2-hydroxyethoxy)-3-ethylphenyl|pentane, 3,3-bis|4-(2-hydroxyethoxy)-3,5-diethylphenyl|pentane, etc.;

dihydroxy compounds to be derived from 2,4-dimethyl-3-pentanone, such as 3,3-bis|4-(2-hydroxyethoxy)phenyl|-2,4-dimethylpentane, 3,3-bis|4-(2-hydroxyethoxy)-3-methylphenyl|-2,4-dimethylpentane, 3,3-bis|4-(2-hydroxyethoxy)-3,5-dimethylphenyl|-2,4-dimethylpentane, 3,3-bis|4-(2-hydroxyethoxy)-3-ethylphenyl|-2,4-dimethylpentane, 3,3-bis|4-(2-hydroxyethoxy)-3,5-diethylphenyl|-2,4-dimethylpentane, etc.;

dihydroxy compounds to be derived from 2,4-dimethyl-3-hexanone, such as 3,3-bis|4-(2-hydroxyethoxy)phenyl|-2,4-dimethylhexane, 3,3-bis|4-(2-hydroxyethoxy)-3-methylphenyl|-2,4-dimethylhexane, 3,3-bis|4-(2-hydroxyethoxy)-3,5-dimethylphenyl|-2,4-dimethylhexane, 3,3-bis|4-(2-hydroxyethoxy)-3-ethylphenyl|-2,4-dimethylhexane, 3,3-bis|4-(2-hydroxyethoxy)-3,5-diethylphenyl|-2,4-dimethylhexane, etc.;

dihydroxy compounds to be derived from 2,5-dimethyl-3-hexanone, such as 3,3-bis|4-(2-hydroxyethoxy)phenyl|-2,5-dimethylhexane, 3,3-bis|4-(2-hydroxyethoxy)-3-methylphenyl|-2,5-dimethylhexane, 3,3-bis|4-(2-hydroxyethoxy)-3,5-dimethylphenyl|-2,5-dimethylhexane, 3,3-bis|4-(2-hydroxyethoxy)-3-ethylphenyl|-2,5-dimethylhexane, 3,3-bis|4-(2-hydroxyethoxy)-3,5-diethylphenyl|-2,5-dimethylhexane, etc. These compounds can be used alone or in combination thereof.

As the other diol, there can be used aliphatic glycols such as ethylene glycol, 1,3-propanediol, 1,2-propanediol, 1,4-butanediol, 1,2-butanediol, 1,3-butanediol, 1,5-pentanediol, 1,4-pentanediol, 1,3-pentanediol, etc.; diols having an aromatic ring at the main or side chain, such as 1,1-bis|4-(2-hydroxyethoxy)phenyl|-1-phenylethane, etc; compounds having an aromatic ring and sulfur at the main chain, such as bis|4-(2-hydroxyethoxy)phenyl|sulfon, etc.: or other hydroxy compounds such as bis|4-(2-hydroxyethoxy)phenyl|-sulfon, tricyclodecanedimethylol, etc.

The polyester resin in the present invenion can be produced by selecting a suitable method from known methods such as melt polymerization method (e.g. interesterification method and direct polymerization method), solution polymerization method and interfacial polymerization method. In that case, a conventional known method can also be used with respect to the reaction condition such as polymerization catalyst.

In order to produce the polyester resin in the present invention by the interesterfication method of the melt polymerization method, it is preferred that the proportion of at least one sort of the dihydroxy compound selected from the dihydroxy compounds of the general formulas (1), (2) and (3) is 10 to 95 molar % for the glycol component in the resin. When the proportion exceeds 95 molar %, there is a problem that the melt polymerization reaction does not proceed and the polymerization time becomes drastically long. Even when it is more than 95 molar %, the polyester resin can be easily produced by the solution polymerization method or interfacial polymerization method.

In the polyester resin (amorphous) produced by copolymerizing dicarboxylic acid or a derivative thereof with the above dihydroxy compound (1), (2) or (3), the weight-average molecular weight on the polystyrene basis of 100,000 (limiting viscosity in chloroform: 0.6 dl/g) is a critical value which can be easily obtained by a conventional known polymerization method.

In order to obtain a polymeric polyester resin having an limiting viscosity of not less than 0.6 dl/g, it is preferred to react with a diisocyanate after polymerizing by the above-described method. The molecular chain of the polyester can be extended to easily increase the limiting viscosity in chloroform to 0.6 dl/g or more by this post treatment, thereby improving mechanical characteristics such as wear resistance, etc.

All compounds having two isocyanate groups in the same molecule are included in the diisocyanate to be used in the present invention. More specifically, examples thereof include hexamethylene diisocyanate, 2,4-tolylene diisocyanate, 2,6-tolylene diisocyanate, methylene-4,4'-bisphenyl diisocyanate, xylylene diisocyanate, 3-isocyanatemethyl-3,5,5-trimethycyclohexyl isocyanate, etc. These may be used alone or in combination thereof. Among them, methylene-4,4'-bisphenyl diisocyanate is particularly preferred.

The amount of the diisocyanate to be reacted with the polyester polymer is normally within a range of 0.5- to 1.3-fold amount, preferably 0.8- to 1.1-fold amount, based on the mol numbers calculated on the basis of the number-average molecular weight. The terminal end of the polyester molecule is alcoholic OH, and the diisocyanate reacts with alcohol to form an urethane bond, thereby accomplishing the chain extending of the polyester. At this time, the amount of the urethane bond to be introduced into the polyester becomes not more than 1 % (molar fraction) and, therefore, physical properties (e.g. refractive index, birefringence, glass transition point, transparency, etc.) of the whole resin are the same as those of the polyester resin before treatment.

In the above-described chain extending reaction, a suitable catalyst may be optionally used. Preferred examples of the catalyst include metal catalysts (e.g. tin octylate, dibutyltin dilaurate, lead naphthenate, etc.), diazobiscyclo[2,2,2]octane, tri-N-butylamine, etc. The amount of the catalyst to be added varies depending on the temperature of the chain extending reaction, and is normally not more than 0.01 mol, preferably not more than 0.001 mol, based on 1 mol of the diisocyanate.

The reaction proceeds by adding a suitable amount of the catalyst and diisocyanate to the above-described polyester at the molten state, followed by stirring under a dry nitrogen current.

The reaction temperature of the chain extending reaction varies depending on the condition. When the reaction is conducted in an organic solvent, the reaction temperature is preferably set at a temperature lower than a boiling point of a solvent. When using no organic solvent, it is preferably set at a temperature higher than a glass transition point of the polyester. Since the obtainable molecular weight and degree of coloring due to the side reaction are decided by the reaction temperature, the optimum reaction system and reaction temperature suitable for the system can be selected, taking the objective molecular weight and that of the polyester before reaction into consideration. For example, when using trichlorobenzene as the organic solvent, it becomes possible to conduct the reaction within a range of 130° to 150° C., and the coloring due to the side reaction is scarcely observed.

The molecular weight is drastically increased by the above-described chain extending reaction of the polyester and the limiting viscosity is increased. The final molecular weight varies depending on the molecular weight before the reaction, but the molecular weight of the chain-extended polyester can be increased to the objective value by changing the amount of the diisocyanate, in addition to the reaction temperature and reaction time. It is difficult to specify the reaction temperature and reaction time. However, the higher the temperature, or the longer the reaction time, the higher the resulting molecular weight is. In addition, when the amount of diisocyanate is the same amount or 1.1-fold amount of the mol numbers of polyester calculated from the number-average molecular weight, the effect of the chain extending is the highest.

The molecular weight of the polyester obtained by copolymerizing dicarboxylic acid or an ester-forming derivative thereof with the dihydroxy compound (1), (2) or (3) is normally about 50,000 (limiting viscosity: 0.4 dl/g), and the maximum value thereof is about 100,000 (limiting viscosity: 0.6 dl/g). For example, a polymeric polyester having the limiting viscosity of 0.7 to 1.5 dl/g can be obtained by subjecting polyester having a molecular weight of about 50,000, which can be produced most easily, as the raw material to the chain extending reaction.

The molecular weight distribution of the chain-extended polyester is normally widened. The molecular weight distribution of the amorphous polyester obtained by copolymerizing the above-described special dihydroxy compound produced by the melt polymerization varies depending on various reaction conditions, but is normally about 2 (in ratio of weight-average molecular weight to number-average molecular weight). After the chain extending reaction, it normally become 4 or more. When it is not preferred that the molecular weight distribution exists, the molecular weight distribution can be optionally controlled using a molecular weight fractionation method which is normally known. As the molecular weight fractionation method, there can be used reprecipitation method due to poor solvent, method of passing through a column filled with gel to sift by the size of the molecule, method described in Analysis of Polymers, T. R. Crompton, Pergamon Press, etc.

In the present invention, a polycarbonate resin having a repeating unit represented by the following general formula (A) can be contained as the binding resin, in addition to the above polyester resin.

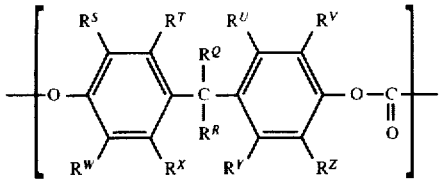

(A)

wherein $R^Q$ and $R^R$ are the same or different and indicate a hydrogen atom, an alkyl group having 1 to 3 carbon atoms or an aryl group which may have a substituent, and $R^Q$ and $R^R$ may bond each other to form a ring; and $R^S$, $R^T$, $R^U$, $R^V$, $R^W$, $R^X$, $R^Y$ and $R^Z$ are the same or different and indicate a hydrogen atom, an alkyl having 1 to 3 carbon atoms, an aryl group which may have a substituent, or a halogen atom.

Such a polycarbonate resin may be a homopolymer using single monomers, or a copolymer using two or more sorts of monomers represented by the above repeating unit.

Examples of the polycarbonate resin represented by the general formula (A) will be descried hereinafter.

positive charging type. On the other hand, the electric charge generating layer may be formed after the electron transferring layer was formed on the conductive substrate. When the electric charge transferring layer contains the electron transferring material, the electric charge generating layer may contain the hole transferring material. On the other hand, when the electric charge transferring layer contains the hole transferring material, the electric charge generating layer may contain the electron transferring material.

Examples of the electric charge generating material include electric charge generating materials which have hitherto been known, such as metal-free phthalocyanine, titanyl phthalocyanine, perylene pigments, bis-azo pigments, dithioketopyrrolopyrrole pigments, metal-free naphthalocyanine pigments, metal naphthalocyanine pigments, squaline pigments, tris-azo pigments, indigo pigments, azulenium pigments, cyanine pigments, etc. Various electric charge generating materials which have hitherto been known can be used in combination for the purpose of widening a sensitivity range of the electrophotosensitive material so as to present an absorption wavelength within a desired range.

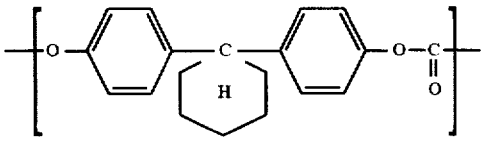

(A-1)

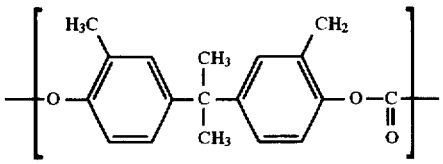

(A-2)

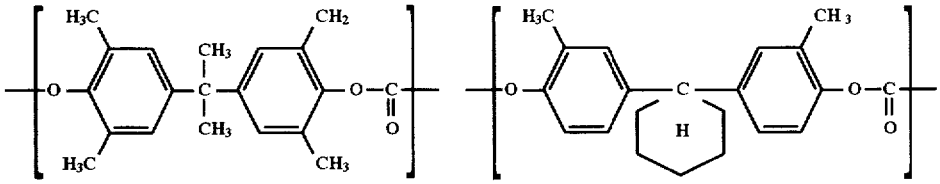

(A-3)

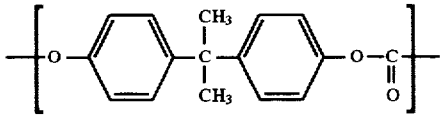

(A-4)

Regarding the blending proportion of the polycarbonate resin (A) to the polyester resin, the amount of the polycarbonate resin (A) is preferably 1 to 99 parts by weight, based on 100 parts by weight of the polyester resin.

The photosensitive material of the present invention can be applied to both cases where the photosensitive layer include single-layer and multi-layer types.

In order to obtain the single-layer type photosensitive material, a photosensitive layer containing an electric charge generating material, a hole transferring material, an electron transferring material and the above polyester resin as a binding resin may be formed on a conductive substrate by means such as application, etc.

In order to obtain the multi-layer type photosensitive material, an electric charge generating layer containing an electric charge generating material and a binding resin is firstly formed on a conductive substrate, and then an electric charge transferring layer containing any one of a hole transferring material and an electron transferring material and a binding resin may be formed on this electric charge generating layer, according to a negative charging type or a When using any one of compounds represented by the formulas (HT1) to (HT13) as the hole transferring material, the compounds represented by the formulas (ET1) to (ET14) may be used as the electron transferring material to be used in combination with the hole transferring material, but other known electron transferring materials may also be used.

Examples of the known electron transferring material include diphenoquinone derivatives other than compounds represented by the general formula (ET1), malononitrile, thiopyran compounds, tetracyanoethylene, 2,4,8-trinitrothioxanthone, fluorenone compounds (e.g. 3,4,5,7-tetranitro-9-fluorenone), dinitrobenzene, dinitroanthracene, dinitroacridine, nitroanthraquinone, dinitroanthraquinone, succinic anhydride, maleic anhydride, dibromomaleic anhydride, etc.

When using any one of compounds represented by the formulas (ET1) to (ET14) as the electron transferring material, the compounds represented by the formulas (HT1) to (HT13) may be used as the hole transferring material to be used in combination with the electron transferring material, but other known electron transferring materials may also be used.

Examples of the known hole transferring material include nitrogen-containing cyclic compounds and condensed polycyclic compounds, for example, benzidine derivatives other than compound represented by the general formula (HT1); phenylenediamine derivatives other than compounds represented by the formula (HT2); styryl compounds such as 9-(4-diethylaminostyryl)anthracene, etc.; carbazole compounds such as polyvinyl carbazole, etc.; pyrazoline compounds such as 1-phenyl-3-(p-dimethylaminophenyl) pyrazoline, etc.; hydrazone compounds; triphenylamine compounds; indol compounds; oxazole compounds; isooxazole compounds; thiazole compounds; thiadiazole compounds; imidazole compounds; pyrazole compounds; triazole compounds, etc.

The above-described polyester resin to be used as the binding resin is preferably used as the binding resin for single-layer photosensitive material because of it's high adhesion to the conductive substrate. In case of the multi-layer photosensitive material, the wear resistance of the photosensitive layer is improved when using the polyester resin as the binding resin for surface layer. In that case, the polyester resin may be used for the layer of the substrate side, or other binding resin may also be used.

Examples of the other binding resin include above-described polycarbonate resin, styrene polymer, styrene-butadiene copolymer, styrene-acrylonitrile copolymer, styrene-acrylic acid copolymer, polyethylene, ethylene-vinyl acetate copolymer, chlorinated polyethylene, polyvinyl chloride, alkyd resin, polyvinyl butyral, polyamide, etc.

Additives such as deterioration inhibitors (e.g. sensitizers, antioxidants, ultraviolet absorbers, etc.) and plasticizers can be contained in the respective organic photosensitive layers of single-layer type and multi-layer type.

In order to improve the sensitivity of the electric charge generating layer, known sensitizers such as terphenyl, halonaphthoquinones, acenaphthylene, etc. may be used in combination with the electric charge generating material.

In the multi-layer photosensitive material, the electric charge generating material and binding resin, which constitute the electric charge generating layer, may be used in various proportions. It is preferred that the electric charge generating material is used in the amount of 5 to 1000 parts by weight, particularly 30 to 500 parts by weight, based on 100 parts by weight of the binding resin.

The hole transferring material or electron transferring material and binding resin, which constitute the electric charge transferring layer, can be used in various proportions within such a range as not to prevent the electron transfer and to prevent the crystallization. It is preferred that the hole transferring material is used in the amount of 10 to 500 parts by weight, particularly 25 to 200 parts by weight, based on 100 parts by weight of the binding resin, so as to easily transfer holes or electrons generated by light irradiation in the electric charge generating layer.

Furthermore, in the multi-layer type photosensitive layer, the electric charge generating layer is formed in the thickness of preferably about 0.01 to 10 μm, particularly about 0.1 to 5 μm, and the electric charge transferring layer is formed in the thickness of preferably about 2 to 100 μm, particularly about 5 to 50 μm.

In the single-layer type photosensitive material, it is preferred that the amount of the electric charge generating material is 0.1 to 50 parts by weight, particularly 0.5 to 30 parts by weight, based on 100 parts by weight of the binding resin. It is preferred that the amount of the hole transferring material is 20 to 500 parts by weight, particularly 30 to 200 parts by weight, based on 100 parts by weight of the binding resin. In addition, it is preferred that the single-layer type photosensitive layer is formed in the thickness of 5 to 100 μm, preferably about 10 to 50 μm.

A barrier layer may be formed, in such a range as not to injure the characteristics of the photosensitive material, between the conductive substrate and photosensitive layer in the single-layer type photosensitive material, or between the conductive substrate and electric charge generating layer or between the conductive substrate layer and electric charge transferring layer in the multi-layer type photosensitive material. Furthermore, a protective layer may be formed on the surface of the photosensitive layer.

As the conductive substrate on which the above respective layer are formed, various materials having a conductivity can be used, and examples thereof include metals such as aluminum, copper, tin, platinum, silver, vanadium, molybdenum, chromium, cadmium, titanium, nickel, palladium, indium, stainless steel, brass, etc.; plastic materials vapor-deposited or laminated with the above metal; glass materials coated with aluminum iodide, tin oxide, indium oxide, etc.

The conductive substrate may be made in the form of a sheet or a drum. The substrate itself may have a conductivity or only the surface of the substrate may have a conductivity. It is preferred that the conductive substrate has a sufficient mechanical strength when used.

When the above respective layers are formed by the application method, the above-described electric charge generating material, hole transferring material, electric charge transferring material and binding resin may be dispersed and mixed with a suitable solvent using roll mill, ball mill, atriter, paint shaker, ultrasonic dispersion device, etc., and the resulting solution may be applied using known means, followed by drying.

As the solvent, there can be used various organic solvents, and examples thereof include alcohols such as methanol, ethanol, isopropanol, butanol, etc.; aliphatic hydrocarbons such as n-hexane, octane, cyclohexane, etc.; aromatic hydrocarbons such as benzene, toluene, xylene, etc.; hydrocarbon halides such as dichloromethane, dichloroethane, carbon tetrachloride, chlorobenzene, etc.; ethers such as dimethyl ether, diethyl ether, tetrahydrofuran, ethylene glycol dimethyl ether, diethylene glycol dimethyl ether, etc.; ketones such as acetone, methyl ethyl ketone, cyclohexanone, etc.; esters such as ethyl acetate, methyl acetate, etc.; dimethylformaldehyde, dimethylformamide, dimethyl sulfoxide, etc. These solvents may be used alone or in combination thereof.

In order to improve dispersion properties of the hole transferring material and electric charge generating material as well as a smoothness of the surface of the photosensitive layer, surfactants, leveling agents, etc. may be used.

EXAMPLES

The following Reference Examples, Examples and Comparative Examples further illustrate the present invention in detail.

Reference Example 1

Dimethyl terephthalate (10.68 kg, 55 mol), 9,9-bis[4-(2-hydroxyethoxy)phenyl]fluorene (16.88 kg, 38.5 mol) and ethylene glycol (7.2 kg, 116 mol) were used as the raw material, and calcium acetate (15.99 g, 0.091 mol) was used as the catalyst. They were introduced in a reaction tank and the interesterification reaction was conducted by heating slowly from 190° to 230° C. with stirring according to a normal method. After drawing out a predetermined amount of ethanol from the system, germanium oxide (6.9 g, 0.066 mol) as the polymerization catalyst and trimethyl phosphate (14 g, 0.1 mol) as the agent for preventing coloring were introduced. Then, the heating tank was heated slowly to 280° C. and, at the same time, the pressure was reduced slowly to 1 Torr or less while drawing out ethylene glycol to be formed. This condition was maintained until the viscosity was increased and, after reaching a predetermined stirring torque (after about 2 hours), the reaction was terminated and the reaction product was extruded into water to obtain a pellet.

The limiting viscosity of this copolymer was 0.38 dl/g. The weight-average molecular weight determined by GPC was 55,000 and number-average molecular weight was 25,000. In addition, the glass transition temperature was 145° C.

The above polyester copolymer (30 g) was dissolved in trichlorobenzene to prepare a 40% (by weight) solution. Then, methylene-bis(4-phenylisocyanate) (0.337 g) whose mol numbers are 1.1 times as those of the polyester copolymer calculated by the number-average molecular weight, and diazobiscyclo[2,2,2]octane (0.175 mg) were added to the above solution, and the mixture was heated with stirring under a nitrogen gas current at 150° C. for 10 hours. The resulting reaction product was reprecipitated in methanol, and then washed with a large amount of methanol and distilled water to obtain a chain-extended polyester resin (1-1).

The limiting viscosity of this polyester resin was 0.76 dl/g. The weight-average molecular weight determined by GPC was 120,000 and number-average molecular weight was 38,000. The glass transition temperature was 145 ° C.

Reference Example 2

According to the same manner as that described in Reference Example 1 except for using 2,6-naphthalenedicarboxylic acid as the acid component and using ethylene glycol and bis[4-(2-hydroxyethoxy)phenyl] fluorene as the diol component, a chain-extended polyester resin (1-2) was obtained. The limiting viscosity of this polyester resin was 0.7 dl/g.

Reference Example 3

According to the same manner as that described in Reference Example 1 except for using succinic acid as the acid component and using ethylene glycol, bis[4-(2-hydroxyethoxy)phenyl]fluorene and 1,1-bis[4-(2-hydroxyethoxy)phenyl]cyclohexane as the diol component, a chain-extended polyester resin (1-3) was obtained. The limiting viscosity of this polyester resin was 0.8 dl/g.

Reference Example 4

Dimethyl terephthalate (10.68 kg, 55 mol), 1,1-bis[4-(2-hydroxyethoxy)phenyl]cyclohexane (13.71 kg, 38.5 mol) and ethylene glycol (7.2 kg, 116 mol) were used as the raw material and calcium acetate (15.99 g, 0.091 mol) was used as the catalyst. They were introduced in a reaction tank and the interesterification reaction was conducted by heating slowly from 190° to 230° C. with stirring according to a normal method. After drawing out a predetermined amount of ethanol from the system, germanium oxide (6.9 g, 0.066 mol) as the polymerization catalyst and trimethyl phosphate (14 g, 0.1 mol) as the agent for preventing coloring were introduced. Then, the heating tank was heated slowly to 280° C. and, at the same time, the pressure was reduced slowly to 1 Torr or less while drawing out ethylene glycol to be formed. This condition was maintained until the viscosity was increased and, after reaching a predetermined stirring torque (after about 2 hours), the reaction was terminated and the reaction product was extruded into water to obtain a pellet.

The limiting viscosity of this copolymer was 0.39 dl/g. The weight-average molecular weight determined by GPC was 55,000 and number-average molecular weight was 25,000. The glass transition temperature was 145° C.

The above polyester copolymer (30 g) was dissolved in trichlorobenzene to prepare a 40% (by weight) solution. Then, methylene-bis(4-phenylisocyanate) (0.337 g) whose mol numbers are 1.1 times as those of the polyester copolymer calculated by the number-average molecular weight, and diazobiscyclo[2,2,2]octane (0.175 mg) were added to the above solution, and the mixture was heated with stirring under a nitrogen gas current at 150° C. for 10 hours. The resulting reaction product was reprecipitated in methanol, and then washed with a large amount of methanol and distilled water to obtain a chain-extended polyester resin (2-1).

The limiting viscosity of this polyester resin was 0.76 dl/g. The weight-average molecular weight determined by GPC was 120,000 and number-average molecular weight was 38,000. The glass transition temperature was 115° C.

Reference Example 5

According to the same manner as that described in Reference Example 4 except for using 2,6-naphthalenedicarboxylic acid as the acid component and using ethylene glycol and 1,1-bis[4-(2-hydroxyethoxy) phenyl]cyclohexane as the diol component, a chain-extended polyester resin (2-2) was obtained. The limiting viscosity of this polyester resin was 0.8 dl/g.

Reference Example 6

According to the same manner as that described in Reference Example 4 except for using 2,6-naphthalenedicarboxylic acid as the acid component and using ethylene glycol and 1,1-bis[4-(2-hydroxyethoxy)-3,5-dimethylphenyl]cyclohexane as the diol component, a chain-extended polyester resin (2-3) was obtained. The limiting viscosity of this polyester resin was 0.8 dl/g.

Reference Example 7

Dimethyl terephthalate (10.68 kg, 55 mol), 2,2-bis[4-(2-hydroxyethoxy)phenyl]-4-methylpentane (13.60 kg, 38.5 mol) and ethylene glycol (7.2 kg, 116 mol) were used as the raw material and calcium acetate (15.99 g, 0.091 mol) was used as the catalyst. They were introduced in a reaction tank and the interesterification reaction was conducted by heating slowly from 190° to 230° C. with stirring according to a normal method. After drawing out a predetermined amount of ethanol from the system, germanium oxide (6.9 g, 0.066 mol) as the polymerization catalyst and trimethyl phosphate (14 g, 0.1 mol) as the agent for preventing coloring were introduced. Then, the heating tank was heated slowly to 280° C. and, at the same time, the pressure was reduced slowly to 1 Torr or less while drawing out ethylene glycol to be formed. This condition was maintained until the viscosity was increased and, after reaching a predetermined stirring torque (after about 2 hours), the reaction was terminated and the reaction product was extruded into water to obtain a pellet.

The limiting viscosity of this copolymer was 0.39 dl/g. The weight-average molecular weight determined by GPC was 55,000 and number-average molecular weight was 25,000. The glass transition temperature was 145° C.

The above polyester copolymer (30 g) was dissolved in trichlorobenzene to prepare a 40% (by weight) solution. Then, methylene-bis(4-phenylisocyanate) (0.337 g) whose mol numbers are 1.1 times as those of the polyester copolymer calculated by the number-average molecular weight, and diazobiscyclo[2,2,2]octane (0.175 mg) were added to the above solution, and the mixture was heated with stirring under a nitrogen gas current at 150° C. for 10 hours. The resulting reaction product was reprecipitated in methanol, and then washed with a large amount of methanol and distilled water to obtain a chain-extended polyester resin (3-1).

The limiting viscosity of this polyester resin was 0.76 dl/g. The weight-average molecular weight determined by GPC was 120,000 and number-average molecular weight was 38,000. The glass transition temperature was 105° C.

Reference Example 8

According to the same manner as that described in Reference Example 7 except for using 2,6-naphthalenedicarboxylic acid as the acid component and using ethylene glycol and 2,2-bis[4-(2-hydroxyethoxy)-3-methylphenyl]-4-methylpentane as the diol component, a chain-extended polyester resin (3-2) was obtained. The limiting viscosity of this polyester resin was 0.8 dl/g.

Reference Example 9

According to the same manner as that described in Reference Example 7 except for using succinic acid as the acid component and using ethylene glycol and 2,2-bis[4-(2-hydroxyethoxy)phenyl]-4-methylpentane as the diol component, a chain-extended polyester resin (3-3) was obtained. The limiting viscosity of this polyester resin was 0.8 dl/g.

Examples 1 to 387

[Single-layer photosensitive material for digital light source (positive charging type)]

A metal-free phthalocyanine pigment represented by the following general formula (CG1) and a diphenoquinone compound represented by the following general formula (ET1-1) were used as the electric charge generating material and electron transferring material, respectively. In addition, the compound represented by any one of the above formulas (HT1) to (HT13) was used as the hole transferring material, respectively. Furthermore, any one of the polyester resins (1-1) to (1-3), (2-1) to (2-3) and (3-1) to (3-3) obtained in Reference Examples 1 to 9, or a mixture of this polyester resin and a polycarbonate resin was used as the binding resin, furthermore, tetrahydrofuran was used as the solvent in which these components are dissolved.

(CG1)

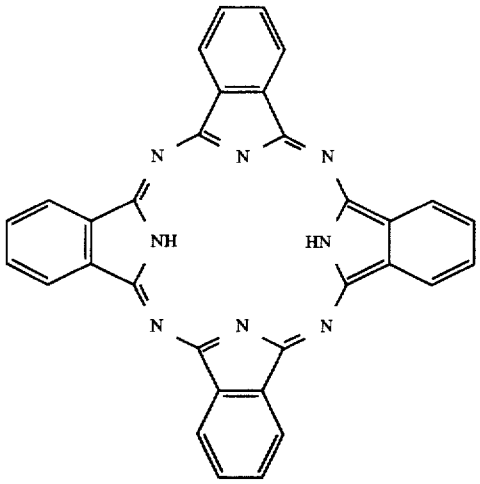

(ET1-1)

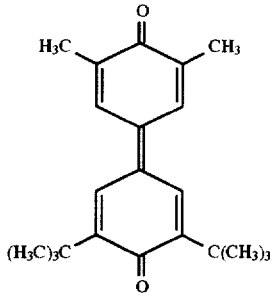

The electric charge generating material and binding resin used were shown using the above compound number.

The amount of the respective materials to be blended is as follows:

| Components | Amount (parts by weight) |
|---|---|
| Electric charge generating material | 5 |
| Hole transferring material | 50 |
| Electron transferring material | 30 (or 0) |
| Binding resin | 90 |
| Solvent | 800 |

When the binding resin is the above mixture, the mixing proportion of the polyester resin to polycarbonate was 70 parts by weight: 20 parts by weight.

The above respective components were mixed and dispersed with a ball mill to prepare a coating solution for single-layer type photosensitive layer. Then, this coating solution was applied on an aluminum tube by a dip coating method, followed by hot-air drying at 100° C. for 60 minutes to obtain a single-layer type photosensitive material for digital light source, which has a single-layer type photosensitive layer of 15 to 20 am in film thickness, respectively.

Comparative Example 1

According to the same manner as that described in Example 1 except for using the polycarbonate resin having a repeating unit of the above formula (A-4) alone as the binding resin, a single-layer photosensitive material was produced.

Comparative Example 2

According to the same manner as that described in Examples 1 except for using a compound represented by the following formula (HT14-1) as the hole transferring material, a single-layer photosensitive material was produced.

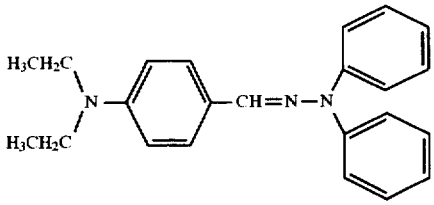

(HT14-1)

The resulting electrophotosensitive materials of the respective Examples and Comparative Examples were subjected to the following tests and their characteristics were evaluated.

<Evaluation of positive charging photosensitive material for digital light source>

Photosensitivity test

By using a drum sensitivity tester manufactured by GENTEC Co., a voltage was applied on the surface of a photosensitive material obtained in the respective Examples and Comparative Examples to charge the surface at +700 V, respectively. Then, monochromatic light [wavelength: 780 nm (half-width: 20 nm), light intensity: 16 μW/cm$^2$] from white light of a halogen lamp as an exposure light source through a band-pass filter was irradiated on the surface of the photosensitive material (irradiation time: 80 msec.). Furthermore, a surface potential at the time at which 330 msec. has passed since the beginning of exposure was measured as a potential after exposure $V_L$ (V).

Wear resistance test

A photosensitive material obtained in the respective Examples and Comparative Examples was fit with an imaging unit of a facsimile for normal paper (Model LDC-650, manufactured by Mita Industrial Co., Ltd.) and, after rotating 150,000 times without passing a paper through it, a change in thickness of a photosensitive layer before and after rotation was determined.

Adhesion test

The adhesion of the photosensitive layer was evaluated according to a checkers test described in JIS K5400 (Normal Testing Method of Paint). The adhesion (%) was determined by the following equation.

Adhesion (%)={Number of checkers which were not peeled off }/{Total numbers of checkers}×100

These test results are shown in Tables 1 to 18, together with the above-described compound No. of the binding resin and hole transferring material (HTM) used.

TABLE 1

| | Binding resin | | | VL | Wear | Adhesion |
|---|---|---|---|---|---|---|
| Ex. | Main | Blend | HTM | (V) | (μm) | (%) |
| 1 | 1-1 | — | HT1-1 | 128 | 2.3 | 100 |
| 2 | 1-1 | — | HT1-2 | 128 | 2.0 | 100 |
| 3 | 1-1 | — | HT1-3 | 130 | 2.8 | 100 |
| 4 | 1-1 | — | HT1-4 | 134 | 2.5 | 100 |
| 5 | 1-1 | — | HT1-5 | 131 | 2.4 | 100 |
| 6 | 1-1 | — | HT1-6 | 130 | 3.0 | 100 |
| 7 | 1-1 | — | HT1-7 | 130 | 2.7 | 100 |
| 8 | 1-1 | — | HT1-8 | 133 | 2.1 | 100 |
| 9 | 1-1 | — | HT1-9 | 131 | 2.5 | 100 |
| 10 | 1-1 | — | HT1-10 | 129 | 2.9 | 100 |
| 11 | 1-1 | — | HT1-11 | 132 | 2.5 | 100 |
| 12 | 1-1 | — | HT2-1 | 151 | 1.4 | 100 |

TABLE 1-continued

| | Binding resin | | | VL | Wear | Adhesion |
|---|---|---|---|---|---|---|
| Ex. | Main | Blend | HTM | (V) | (μm) | (%) |
| 13 | 1-1 | — | HT2-2 | 148 | 1.9 | 100 |
| 14 | 1-1 | — | HT2-3 | 141 | 1.6 | 100 |
| 15 | 1-1 | — | HT2-4 | 155 | 2.0 | 100 |
| 16 | 1-1 | — | HT2-5 | 150 | 1.8 | 100 |
| 17 | 1-1 | — | HT2-6 | 140 | 2.2 | 100 |
| 18 | 1-1 | — | HT3-1 | 143 | 1.5 | 100 |
| 19 | 1-1 | — | HT3-2 | 143 | 2.0 | 100 |
| 20 | 1-1 | — | HT3-3 | 147 | 1.9 | 100 |
| 21 | 1-1 | — | HT3-4 | 152 | 2.2 | 100 |
| 22 | 1-1 | — | HT3-5 | 145 | 1.6 | 100 |
| 23 | 1-1 | — | HT4-1 | 148 | 2.1 | 100 |
| 24 | 1-1 | — | HT4-2 | 150 | 1.8 | 100 |
| 25 | 1-1 | — | HT4-3 | 150 | 2.1 | 100 |
| 26 | 1-1 | — | HT5-1 | 158 | 2.5 | 100 |
| 27 | 1-1 | — | HT6-1 | 160 | 2.7 | 100 |
| 28 | 1-1 | — | HT7-1 | 159 | 3.0 | 100 |

TABLE 2

| | Binding resin | | | VL | Wear | Adhesion |
|---|---|---|---|---|---|---|
| Ex. | Main | Blend | HTM | (V) | (μm) | (%) |
| 29 | 1-1 | — | HT8-1 | 161 | 2.6 | 100 |
| 30 | 1-1 | — | HT8-2 | 155 | 3.0 | 100 |
| 31 | 1-1 | — | HT9-1 | 151 | 2.9 | 100 |
| 32 | 1-1 | — | HT9-2 | 160 | 2.5 | 100 |
| 33 | 1-1 | — | HT10-1 | 161 | 2.4 | 100 |
| 34 | 1-1 | — | HT10-2 | 152 | 2.4 | 100 |
| 35 | 1-1 | — | HT11-1 | 155 | 2.6 | 100 |
| 36 | 1-1 | — | HT11-2 | 163 | 2.6 | 100 |
| 37 | 1-1 | — | HT12-1 | 159 | 2.3 | 100 |
| 38 | 1-1 | — | HT12-2 | 150 | 2.4 | 100 |
| 39 | 1-1 | — | HT13-1 | 158 | 2.9 | 100 |
| 40 | 1-1 | — | HT13-2 | 151 | 2.7 | 100 |
| 41 | 1-1 | — | HT13-3 | 156 | 2.2 | 100 |
| 42* | 1-1 | — | HT1-1 | 163 | 2.6 | 100 |
| 43 | 1-1 | A-1 | HT1-1 | 132 | 2.2 | 100 |

TABLE 3

| | Binding resin | | | VL | Wear | Adhesion |
|---|---|---|---|---|---|---|
| Ex. | Main | Blend | HTM | (V) | (μm) | (%) |
| 44 | 1-2 | — | HT1-1 | 130 | 2.9 | 100 |
| 45 | 1-2 | — | HT1-2 | 129 | 2.5 | 100 |
| 46 | 1-2 | — | HT1-3 | 128 | 2.2 | 100 |
| 47 | 1-2 | — | HT1-4 | 130 | 2.0 | 100 |
| 48 | 1-2 | — | HT1-5 | 129 | 2.4 | 100 |
| 49 | 1-2 | — | HT1-6 | 132 | 2.4 | 100 |
| 50 | 1-2 | — | HT1-7 | 130 | 3.0 | 100 |
| 51 | 1-2 | — | HT1-8 | 129 | 2.6 | 100 |
| 52 | 1-2 | — | HT1-9 | 128 | 2.9 | 100 |
| 53 | 1-2 | — | HT1-10 | 131 | 2.3 | 100 |
| 54 | 1-2 | — | HT1-11 | 130 | 2.8 | 100 |
| 55 | 1-2 | — | HT2-1 | 143 | 1.8 | 100 |
| 56 | 1-2 | — | HT2-2 | 149 | 1.4 | 100 |
| 57 | 1-2 | — | HT2-3 | 150 | 1.6 | 100 |
| 58 | 1-2 | — | HT2-4 | 155 | 2.0 | 100 |
| 59 | 1-2 | — | HT2-5 | 146 | 1.4 | 100 |
| 60 | 1-2 | — | HT2-6 | 152 | 1.9 | 100 |
| 61 | 1-2 | — | HT3-1 | 145 | 1.5 | 100 |
| 62 | 1-2 | — | HT3-2 | 143 | 1.5 | 100 |
| 63 | 1-2 | — | HT3-3 | 147 | 1.9 | 100 |
| 64 | 1-2 | — | HT3-4 | 154 | 2.1 | 100 |
| 65 | 1-2 | — | HT3-5 | 150 | 1.7 | 100 |

TABLE 3-continued

| Ex. | Binding resin Main | Binding resin Blend | HTM | VL (V) | Wear (μm) | Adhesion (%) |
|---|---|---|---|---|---|---|
| 66 | 1-2 | — | HT4-1 | 146 | 2.0 | 100 |
| 67 | 1-2 | — | HT4-2 | 149 | 2.1 | 100 |
| 68 | 1-2 | — | HT4-3 | 141 | 1.9 | 100 |
| 69 | 1-2 | — | HT5-1 | 154 | 2.5 | 100 |
| 70 | 1-2 | — | HT6-1 | 160 | 2.4 | 100 |
| 71 | 1-2 | — | HT7-1 | 165 | 2.1 | 100 |

TABLE 4

| Ex. | Binding resin Main | Binding resin Blend | HTM | VL (V) | Wear (μm) | Adhesion (%) |
|---|---|---|---|---|---|---|
| 72 | 1-2 | — | HT8-1 | 163 | 3.0 | 100 |
| 73 | 1-2 | — | HT8-2 | 159 | 2.8 | 100 |
| 74 | 1-2 | — | HT9-1 | 165 | 2.4 | 100 |
| 75 | 1-2 | — | HT9-2 | 154 | 2.7 | 100 |
| 76 | 1-2 | — | HT10-1 | 158 | 2.3 | 100 |
| 77 | 1-2 | — | HT10-2 | 161 | 2.8 | 100 |
| 78 | 1-2 | — | HT11-1 | 150 | 2.0 | 100 |
| 79 | 1-2 | — | HT11-2 | 157 | 2.2 | 100 |
| 80 | 1-2 | — | HT12-1 | 162 | 2.5 | 100 |
| 81 | 1-2 | — | HT12-2 | 153 | 2.1 | 100 |
| 82 | 1-2 | — | HT13-1 | 150 | 2.4 | 100 |
| 83 | 1-2 | — | HT13-2 | 155 | 2.9 | 100 |
| 84 | 1-2 | — | HT13-3 | 160 | 2.0 | 100 |
| 85* | 1-2 | — | HT1-1 | 161 | 2.3 | 100 |
| 86 | 1-2 | A-1 | HT1-1 | 128 | 2.5 | 100 |

TABLE 5

| Ex. | Binding resin Main | Binding resin Blend | HTM | VL (V) | Wear (μm) | Adhesion (%) |
|---|---|---|---|---|---|---|
| 87 | 1-3 | — | HT1-1 | 132 | 2.4 | 100 |
| 88 | 1-3 | — | HT1-2 | 131 | 2.3 | 100 |
| 89 | 1-3 | — | HT1-3 | 129 | 2.0 | 100 |
| 90 | 1-3 | — | HT1-4 | 132 | 2.7 | 100 |
| 91 | 1-3 | — | HT1-5 | 128 | 2.9 | 100 |
| 92 | 1-3 | — | HT1-6 | 130 | 2.8 | 100 |
| 93 | 1-3 | — | HT1-7 | 127 | 2.1 | 100 |
| 94 | 1-3 | — | HT1-8 | 129 | 2.6 | 100 |
| 95 | 1-3 | — | HT1-9 | 130 | 2.6 | 100 |
| 96 | 1-3 | — | HT1-10 | 132 | 2.2 | 100 |
| 97 | 1-3 | — | HT1-11 | 131 | 3.0 | 100 |
| 98 | 1-3 | — | HT2-1 | 155 | 1.8 | 100 |
| 99 | 1-3 | — | HT2-2 | 149 | 2.2 | 100 |
| 100 | 1-3 | — | HT2-3 | 140 | 1.5 | 100 |
| 101 | 1-3 | — | HT2-4 | 155 | 2.1 | 100 |
| 102 | 1-3 | — | HT2-5 | 147 | 1.4 | 100 |
| 103 | 1-3 | — | HT2-6 | 154 | 2.0 | 100 |
| 104 | 1-3 | — | HT3-1 | 141 | 1.7 | 100 |
| 105 | 1-3 | — | HT3-2 | 152 | 2.2 | 100 |
| 106 | 1-3 | — | HT3-3 | 147 | 1.5 | 100 |
| 107 | 1-3 | — | HT3-4 | 153 | 1.6 | 100 |
| 108 | 1-3 | — | HT3-5 | 143 | 1.6 | 100 |
| 109 | 1-3 | — | HT4-1 | 150 | 2.0 | 100 |
| 110 | 1-3 | — | HT4-2 | 148 | 1.9 | 100 |
| 111 | 1-3 | — | HT4-3 | 146 | 1.6 | 100 |
| 112 | 1-3 | — | HT5-1 | 159 | 2.9 | 100 |
| 113 | 1-3 | — | HT6-1 | 151 | 2.5 | 100 |
| 114 | 1-3 | — | HT7-1 | 163 | 2.5 | 100 |

TABLE 6

| Ex. | Binding resin Main | Binding resin Blend | HTM | VL (V) | Wear (μm) | Adhesion (%) |
|---|---|---|---|---|---|---|
| 115 | 1-3 | — | HT8-1 | 155 | 2.1 | 100 |
| 116 | 1-3 | — | HT8-2 | 151 | 2.9 | 100 |
| 117 | 1-3 | — | HT9-1 | 159 | 2.3 | 100 |
| 118 | 1-3 | — | HT9-2 | 156 | 2.4 | 100 |
| 119 | 1-3 | — | HT10-1 | 160 | 2.8 | 100 |
| 120 | 1-3 | — | HT10-2 | 164 | 2.5 | 100 |
| 121 | 1-3 | — | HT11-1 | 158 | 2.7 | 100 |
| 122 | 1-3 | — | HT11-2 | 160 | 2.1 | 100 |
| 123 | 1-3 | — | HT12-1 | 157 | 2.2 | 100 |
| 124 | 1-3 | — | HT12-2 | 165 | 3.0 | 100 |
| 125 | 1-3 | — | HT13-1 | 163 | 2.4 | 100 |
| 126 | 1-3 | — | HT13-2 | 160 | 2.5 | 100 |
| 127 | 1-3 | — | HT13-3 | 158 | 2.8 | 100 |
| 128 | 1-3 | — | HT1-1 | 158 | 2.6 | 100 |
| 129 | 1-3 | A-1 | HT1-1 | 130 | 2.8 | 100 |

TABLE 7

| Ex. | Binding resin Main | Binding resin Blend | HTM | VL (V) | Wear (μm) | Adhesion (%) |
|---|---|---|---|---|---|---|
| 130 | 2-1 | — | HT1-1 | 129 | 2.0 | 100 |
| 131 | 2-1 | — | HT1-2 | 128 | 2.2 | 100 |
| 132 | 2-1 | — | HT1-3 | 131 | 1.8 | 100 |
| 133 | 2-1 | — | HT1-4 | 130 | 1.7 | 100 |
| 134 | 2-1 | — | HT1-5 | 132 | 1.5 | 100 |
| 135 | 2-1 | — | HT1-6 | 121 | 1.9 | 100 |
| 136 | 2-1 | — | HT1-7 | 130 | 1.6 | 100 |
| 137 | 2-1 | — | HT1-8 | 128 | 2.0 | 100 |
| 138 | 2-1 | — | HT1-9 | 129 | 1.5 | 100 |
| 139 | 2-1 | — | HT1-10 | 128 | 2.1 | 100 |
| 140 | 2-1 | — | HT1-11 | 130 | 1.8 | 100 |
| 141 | 2-1 | — | HT2-1 | 152 | 1.7 | 100 |
| 142 | 2-1 | — | HT2-2 | 155 | 1.6 | 100 |
| 143 | 2-1 | — | HT2-3 | 141 | 1.4 | 100 |
| 144 | 2-1 | — | HT2-4 | 146 | 1.0 | 100 |
| 145 | 2-1 | — | HT2-5 | 150 | 1.7 | 100 |
| 146 | 2-1 | — | HT2-6 | 140 | 1.4 | 100 |
| 147 | 2-1 | — | HT3-1 | 151 | 1.0 | 100 |
| 148 | 2-1 | — | HT3-2 | 148 | 1.2 | 100 |
| 149 | 2-1 | — | HT3-3 | 153 | 1.6 | 100 |
| 150 | 2-1 | — | HT3-4 | 149 | 1.4 | 100 |
| 151 | 2-1 | — | HT3-5 | 142 | 1.3 | 100 |
| 152 | 2-1 | — | HT4-1 | 150 | 1.1 | 100 |
| 153 | 2-1 | — | HT4-2 | 147 | 1.4 | 100 |
| 154 | 2-1 | — | HT4-3 | 154 | 1.5 | 100 |
| 155 | 2-1 | — | HT5-1 | 154 | 1.7 | 100 |
| 156 | 2-1 | — | HT6-1 | 151 | 1.5 | 100 |
| 157 | 2-1 | — | HT7-1 | 155 | 2.0 | 100 |

TABLE 8

| Ex. | Binding resin Main | Binding resin Blend | HTM | VL (V) | Wear (μm) | Adhesion (%) |
|---|---|---|---|---|---|---|
| 158 | 2-1 | — | HT8-1 | 151 | 1.7 | 100 |
| 159 | 2-1 | — | HT8-2 | 160 | 2.0 | 100 |
| 160 | 2-1 | — | HT9-1 | 155 | 1.6 | 100 |
| 161 | 2-1 | — | HT9-2 | 164 | 1.7 | 100 |
| 162 | 2-1 | — | HT10-1 | 162 | 1.9 | 100 |
| 163 | 2-1 | — | HT10-2 | 157 | 1.6 | 100 |
| 164 | 2-1 | — | HT11-1 | 155 | 2.1 | 100 |
| 165 | 2-1 | — | HT11-2 | 152 | 2.2 | 100 |
| 166 | 2-1 | — | HT12-1 | 150 | 1.6 | 100 |
| 167 | 2-1 | — | HT12-2 | 158 | 1.8 | 100 |

TABLE 8-continued

| Ex. | Binding resin Main | Blend | HTM | VL (V) | Wear (μm) | Adhesion (%) |
|---|---|---|---|---|---|---|
| 168 | 2-1 | — | HT13-1 | 165 | 2.0 | 100 |
| 169 | 2-1 | — | HT13-2 | 163 | 2.2 | 100 |
| 170 | 2-1 | — | HT13-3 | 160 | 1.9 | 100 |
| 171* | 2-1 | — | HT1-1 | 160 | 2.3 | 100 |
| 172 | 2-1 | A-1 | HT1-1 | 129 | 2.3 | 100 |

TABLE 9

| Ex. | Binding resin Main | Blend | HTM | VL (V) | Wear (μm) | Adhesion (%) |
|---|---|---|---|---|---|---|
| 173 | 2-2 | — | HT1-1 | 129 | 1.7 | 100 |
| 174 | 2-2 | — | HT1-2 | 131 | 1.9 | 100 |
| 175 | 2-2 | — | HT1-3 | 130 | 1.5 | 100 |
| 176 | 2-2 | — | HT1-4 | 129 | 2.1 | 100 |
| 177 | 2-2 | — | HT1-5 | 128 | 1.7 | 100 |
| 178 | 2-2 | — | HT1-6 | 131 | 1.7 | 100 |
| 179 | 2-2 | — | HT1-7 | 131 | 1.8 | 100 |
| 180 | 2-2 | — | HT1-8 | 129 | 2.2 | 100 |
| 181 | 2-2 | — | HT1-9 | 130 | 1.6 | 100 |
| 182 | 2-2 | — | HT1-10 | 132 | 2.0 | 100 |
| 183 | 2-2 | — | HT1-11 | 129 | 1.8 | 100 |
| 184 | 2-2 | — | HT2-1 | 150 | 1.1 | 100 |
| 185 | 2-2 | — | HT2-2 | 149 | 1.6 | 100 |
| 186 | 2-2 | — | HT2-3 | 154 | 1.5 | 100 |
| 187 | 2-2 | — | HT2-4 | 142 | 1.8 | 100 |
| 188 | 2-2 | — | HT2-5 | 152 | 1.9 | 100 |
| 189 | 2-2 | — | HT2-6 | 154 | 1.2 | 100 |
| 190 | 2-2 | — | HT3-1 | 143 | 1.7 | 100 |
| 191 | 2-2 | — | HT3-2 | 151 | 1.1 | 100 |
| 192 | 2-2 | — | HT3-3 | 148 | 1.0 | 100 |
| 193 | 2-2 | — | HT3-4 | 147 | 1.6 | 100 |
| 194 | 2-2 | — | HT3-5 | 143 | 1.3 | 100 |
| 195 | 2-2 | — | HT4-1 | 150 | 1.4 | 100 |
| 196 | 2-2 | — | HT4-2 | 146 | 1.0 | 100 |
| 197 | 2-2 | — | HT4-3 | 141 | 1.7 | 100 |
| 198 | 2-2 | — | HT5-1 | 160 | 1.6 | 100 |
| 199 | 2-2 | — | HT6-1 | 163 | 1.9 | 100 |
| 200 | 2-2 | — | HT7-1 | 154 | 2.0 | 100 |

TABLE 10

| Ex. | Binding resin Main | Blend | HTM | VL (V) | Wear (μm) | Adhesion (%) |
|---|---|---|---|---|---|---|
| 201 | 2-2 | — | HT8-1 | 163 | 1.5 | 100 |
| 202 | 2-2 | — | HT8-2 | 150 | 2.2 | 100 |
| 203 | 2-2 | — | HT9-1 | 161 | 1.7 | 100 |
| 204 | 2-2 | — | HT9-2 | 154 | 1.5 | 100 |
| 205 | 2-2 | — | HT10-1 | 159 | 2.0 | 100 |
| 206 | 2-2 | — | HT10-2 | 155 | 1.9 | 100 |
| 207 | 2-2 | — | HT11-1 | 162 | 1.6 | 100 |
| 208 | 2-2 | — | HT11-2 | 165 | 2.1 | 100 |
| 209 | 2-2 | — | HT12-1 | 160 | 2.2 | 100 |
| 210 | 2-2 | — | HT12-2 | 157 | 1.8 | 100 |
| 211 | 2-2 | — | HT13-1 | 155 | 2.0 | 100 |
| 212 | 2-2 | — | HT13-2 | 151 | 1.5 | 100 |
| 213 | 2-2 | — | HT13-3 | 156 | 1.7 | 100 |
| 214* | 2-2 | — | HT1-1 | 157 | 2.4 | 100 |
| 215 | 2-2 | A-1 | HT1-1 | 130 | 2.0 | 100 |

TABLE 11

| Ex. | Binding resin Main | Blend | HTM | VL (V) | Wear (μm) | Adhesion (%) |
|---|---|---|---|---|---|---|
| 216 | 2-3 | — | HT1-1 | 128 | 2.3 | 100 |
| 217 | 2-3 | — | HT1-2 | 133 | 2.0 | 100 |
| 218 | 2-3 | — | HT1-3 | 130 | 2.1 | 100 |
| 219 | 2-3 | — | HT1-4 | 131 | 1.7 | 100 |
| 220 | 2-3 | — | HT1-5 | 129 | 1.9 | 100 |
| 221 | 2-3 | — | HT1-6 | 130 | 2.2 | 100 |
| 222 | 2-3 | — | HT1-7 | 127 | 1.8 | 100 |
| 223 | 2-3 | — | HT1-8 | 131 | 2.1 | 100 |
| 224 | 2-3 | — | HT1-9 | 128 | 1.6 | 100 |
| 225 | 2-3 | — | HT1-10 | 128 | 1.8 | 100 |
| 226 | 2-3 | — | HT1-11 | 129 | 2.0 | 100 |
| 227 | 2-3 | — | HT2-1 | 147 | 1.0 | 100 |
| 228 | 2-3 | — | HT2-2 | 140 | 1.3 | 100 |
| 229 | 2-3 | — | HT2-3 | 154 | 1.8 | 100 |
| 230 | 2-3 | — | HT2-4 | 150 | 1.0 | 100 |
| 231 | 2-3 | — | HT2-5 | 142 | 1.5 | 100 |
| 232 | 2-3 | — | HT2-6 | 143 | 1.7 | 100 |
| 233 | 2-3 | — | HT3-1 | 150 | 1.2 | 100 |
| 234 | 2-3 | — | HT3-2 | 153 | 1.0 | 100 |
| 235 | 2-3 | — | HT3-3 | 149 | 1.1 | 100 |
| 236 | 2-3 | — | HT3-4 | 142 | 1.6 | 100 |
| 237 | 2-3 | — | HT3-5 | 143 | 1.5 | 100 |
| 238 | 2-3 | — | HT4-1 | 152 | 1.0 | 100 |
| 239 | 2-3 | — | HT4-2 | 148 | 1.2 | 100 |
| 240 | 2-3 | — | HT4-3 | 151 | 1.6 | 100 |
| 241 | 2-3 | — | HT5-1 | 163 | 1.8 | 100 |
| 242 | 2-3 | — | HT6-1 | 165 | 2.0 | 100 |
| 243 | 2-3 | — | HT7-1 | 159 | 2.1 | 100 |

TABLE 12

| Ex. | Binding resin Main | Blend | HTM | VL (V) | Wear (μm) | Adhesion (%) |
|---|---|---|---|---|---|---|
| 244 | 2-3 | — | HT8-1 | 159 | 1.5 | 100 |
| 245 | 2-3 | — | HT8-2 | 156 | 2.0 | 100 |
| 246 | 2-3 | — | HT9-1 | 151 | 1.7 | 100 |
| 247 | 2-3 | — | HT9-2 | 162 | 2.1 | 100 |
| 248 | 2-3 | — | HT10-1 | 158 | 1.6 | 100 |
| 249 | 2-3 | — | HT10-2 | 160 | 1.7 | 100 |
| 250 | 2-3 | — | HT11-1 | 153 | 2.0 | 100 |
| 251 | 2-3 | — | HT11-2 | 163 | 1.9 | 100 |
| 252 | 2-3 | — | HT12-1 | 154 | 2.0 | 100 |
| 253 | 2-3 | — | HT12-2 | 161 | 1.5 | 100 |
| 254 | 2-3 | — | HT13-1 | 160 | 2.1 | 100 |
| 255 | 2-3 | — | HT13-2 | 157 | 1.9 | 100 |
| 256 | 2-3 | — | HT13-3 | 164 | 1.8 | 100 |
| 257* | 2-3 | — | HT1-1 | 162 | 1.7 | 100 |
| 258 | 2-3 | A-1 | HT1-1 | 130 | 2.2 | 100 |

TABLE 13

| Ex. | Binding resin Main | Blend | HTM | VL (V) | Wear (μm) | Adhesion (%) |
|---|---|---|---|---|---|---|
| 259 | 3-1 | — | HT1-1 | 120 | 2.5 | 100 |
| 260 | 3-1 | — | HT1-2 | 118 | 2.1 | 100 |
| 261 | 3-1 | — | HT1-3 | 121 | 2.6 | 100 |
| 262 | 3-1 | — | HT1-4 | 119 | 2.3 | 100 |
| 263 | 3-1 | — | HT1-5 | 122 | 2.5 | 100 |
| 264 | 3-1 | — | HT1-6 | 121 | 2.2 | 100 |
| 265 | 3-1 | — | HT1-7 | 123 | 2.4 | 100 |
| 266 | 3-1 | — | HT1-8 | 119 | 2.9 | 100 |
| 267 | 3-1 | — | HT1-9 | 120 | 2.8 | 100 |
| 268 | 3-1 | — | HT1-10 | 120 | 2.0 | 100 |

TABLE 13-continued

| Ex. | Binding resin Main | Blend | HTM | VL (V) | Wear (μm) | Adhesion (%) |
|---|---|---|---|---|---|---|
| 269 | 3-1 | — | HT1-11 | 123 | 2.7 | 100 |
| 270 | 3-1 | — | HT2-1 | 140 | 1.8 | 100 |
| 271 | 3-1 | — | HT2-2 | 145 | 1.6 | 100 |
| 272 | 3-1 | — | HT2-3 | 139 | 1.4 | 100 |
| 273 | 3-1 | — | HT2-4 | 130 | 1.8 | 100 |
| 274 | 3-1 | — | HT2-5 | 135 | 2.1 | 100 |
| 275 | 3-1 | — | HT2-6 | 144 | 1.4 | 100 |
| 276 | 3-1 | — | HT3-1 | 132 | 2.2 | 100 |
| 277 | 3-1 | — | HT3-2 | 141 | 1.7 | 100 |
| 278 | 3-1 | — | HT3-3 | 133 | 1.5 | 100 |
| 279 | 3-1 | — | HT3-4 | 140 | 1.9 | 100 |
| 280 | 3-1 | — | HT3-5 | 138 | 2.0 | 100 |
| 281 | 3-1 | — | HT4-1 | 142 | 2.2 | 100 |
| 282 | 3-1 | — | HT4-2 | 139 | 1.6 | 100 |
| 283 | 3-1 | — | HT4-3 | 131 | 2.0 | 100 |
| 284 | 3-1 | — | HT5-1 | 141 | 2.5 | 100 |
| 285 | 3-1 | — | HT6-1 | 152 | 2.4 | 100 |
| 286 | 3-1 | — | HT7-1 | 150 | 2.4 | 100 |

TABLE 14

| Ex. | Binding resin Main | Blend | HTM | VL (V) | Wear (μm) | Adhesion (%) |
|---|---|---|---|---|---|---|
| 287 | 3-1 | — | HT8-1 | 153 | 2.2 | 100 |
| 288 | 3-1 | — | HT8-2 | 144 | 3.0 | 100 |
| 289 | 3-1 | — | HT9-1 | 150 | 2.8 | 100 |
| 290 | 3-1 | — | HT9-2 | 150 | 2.9 | 100 |
| 291 | 3-1 | — | HT10-1 | 146 | 2.4 | 100 |
| 292 | 3-1 | — | HT10-2 | 145 | 2.4 | 100 |
| 293 | 3-1 | — | HT11-1 | 141 | 2.5 | 100 |
| 294 | 3-1 | — | HT11-2 | 155 | 2.1 | 100 |
| 295 | 3-1 | — | HT12-1 | 154 | 2.3 | 100 |
| 296 | 3-1 | — | HT12-2 | 142 | 2.1 | 100 |
| 297 | 3-1 | — | HT13-1 | 148 | 2.4 | 100 |
| 298 | 3-1 | — | HT13-2 | 151 | 2.4 | 100 |
| 299 | 3-1 | — | HT13-3 | 150 | 2.0 | 100 |
| 300* | 3-1 | — | HT1-1 | 151 | 2.8 | 100 |
| 301 | 3-1 | A-1 | HT1-1 | 118 | 2.1 | 100 |

TABLE 15

| Ex. | Binding resin Main | Blend | HTM | VL (V) | Wear (μm) | Adhesion (%) |
|---|---|---|---|---|---|---|
| 302 | 3-2 | — | HT1-1 | 121 | 2.6 | 100 |
| 303 | 3-2 | — | HT1-2 | 120 | 2.5 | 100 |
| 304 | 3-2 | — | HT1-3 | 120 | 3.0 | 100 |
| 305 | 3-2 | — | HT1-4 | 118 | 2.2 | 100 |
| 306 | 3-2 | — | HT1-5 | 119 | 2.2 | 100 |
| 307 | 3-2 | — | HT1-6 | 120 | 2.5 | 100 |
| 308 | 3-2 | — | HT1-7 | 122 | 2.9 | 100 |
| 309 | 3-2 | — | HT1-8 | 122 | 2.6 | 100 |
| 310 | 3-2 | — | HT1-9 | 121 | 2.1 | 100 |
| 311 | 3-2 | — | HT1-10 | 120 | 2.3 | 100 |
| 312 | 3-2 | — | HT1-11 | 121 | 2.4 | 100 |
| 313 | 3-2 | — | HT2-1 | 138 | 1.4 | 100 |
| 314 | 3-2 | — | HT2-2 | 135 | 1.8 | 100 |
| 315 | 3-2 | — | HT2-3 | 135 | 1.5 | 100 |
| 316 | 3-2 | — | HT2-4 | 144 | 1.5 | 100 |
| 317 | 3-2 | — | HT2-5 | 140 | 2.1 | 100 |
| 318 | 3-2 | — | HT2-6 | 142 | 1.8 | 100 |
| 319 | 3-2 | — | HT3-1 | 135 | 2.0 | 100 |
| 320 | 3-2 | — | HT3-2 | 136 | 2.1 | 100 |
| 321 | 3-2 | — | HT3-3 | 130 | 1.6 | 100 |

TABLE 15-continued

| Ex. | Binding resin Main | Blend | HTM | VL (V) | Wear (μm) | Adhesion (%) |
|---|---|---|---|---|---|---|
| 222 | 3-2 | — | HT3-4 | 141 | 1.7 | 100 |
| 323 | 3-2 | — | HT3-5 | 132 | 1.9 | 100 |
| 324 | 3-2 | — | HT4-1 | 142 | 1.5 | 100 |
| 325 | 3-2 | — | HT4-2 | 140 | 1.9 | 100 |
| 326 | 3-2 | — | HT4-3 | 139 | 1.5 | 100 |
| 327 | 3-2 | — | HT5-1 | 142 | 2.0 | 100 |
| 328 | 3-2 | — | HT6-1 | 151 | 2.4 | 100 |
| 329 | 3-2 | — | HT7-1 | 151 | 2.3 | 100 |

TABLE 16

| Ex. | Binding resin Main | Blend | HTM | VL (V) | Wear (μm) | Adhesion (%) |
|---|---|---|---|---|---|---|
| 331 | 3-2 | — | HT8-2 | 148 | 2.1 | 100 |
| 332 | 3-2 | — | HT9-1 | 150 | 3.0 | 100 |
| 333 | 3-2 | — | HT9-2 | 146 | 2.4 | 100 |
| 334 | 3-2 | — | HT10-1 | 141 | 2.2 | 100 |
| 335 | 3-2 | — | HT10-2 | 150 | 2.2 | 100 |
| 336 | 3-2 | — | HT11-1 | 152 | 2.8 | 100 |
| 337 | 3-2 | — | HT11-2 | 152 | 2.9 | 100 |
| 338 | 3-2 | — | HT12-1 | 155 | 2.6 | 100 |
| 339 | 3-2 | — | HT12-2 | 154 | 2.1 | 100 |
| 340 | 3-2 | — | HT13-1 | 147 | 2.2 | 100 |
| 341 | 3-2 | — | HT13-2 | 149 | 2.7 | 100 |
| 342 | 3-2 | — | HT13-3 | 147 | 2.8 | 100 |
| 343* | 3-2 | — | HT1-1 | 150 | 2.9 | 100 |
| 344 | 3-2 | A-1 | HT1-1 | 120 | 2.4 | 100 |

TABLE 17

| Ex. | Binding resin Main | Blend | HTM | VL (V) | Wear (μm) | Adhesion (%) |
|---|---|---|---|---|---|---|
| 345 | 3-2 | — | HT1-1 | 118 | 2.9 | 100 |
| 346 | 3-2 | — | HT1-2 | 117 | 2.3 | 100 |
| 347 | 3-2 | — | HT1-3 | 120 | 2.3 | 100 |
| 348 | 3-2 | — | HT1-4 | 123 | 2.4 | 100 |
| 349 | 3-2 | — | HT1-5 | 119 | 2.5 | 100 |
| 350 | 3-2 | — | HT1-6 | 119 | 3.0 | 100 |
| 351 | 3-2 | — | HT1-7 | 121 | 2.8 | 100 |
| 352 | 3-2 | — | HT1-8 | 118 | 2.6 | 100 |
| 353 | 3-2 | — | HT1-9 | 122 | 2.2 | 100 |
| 354 | 3-2 | — | HT1-10 | 120 | 2.9 | 100 |
| 355 | 3-2 | — | HT1-11 | 122 | 2.2 | 100 |
| 356 | 3-2 | — | HT2-1 | 131 | 2.0 | 100 |
| 357 | 3-2 | — | HT2-2 | 140 | 2.2 | 100 |
| 358 | 3-2 | — | HT2-3 | 144 | 1.9 | 100 |
| 359 | 3-2 | — | HT2-4 | 142 | 1.6 | 100 |
| 360 | 3-2 | — | HT2-5 | 133 | 1.4 | 100 |
| 361 | 3-2 | — | HT2-6 | 140 | 1.4 | 100 |
| 362 | 3-2 | — | HT3-1 | 142 | 1.7 | 100 |
| 363 | 3-2 | — | HT3-2 | 138 | 1.8 | 100 |
| 364 | 3-2 | — | HT3-3 | 144 | 2.0 | 100 |
| 265 | 3-2 | — | HT3-4 | 137 | 1.9 | 100 |
| 366 | 3-2 | — | HT3-5 | 141 | 1.5 | 100 |
| 367 | 3-2 | — | HT4-1 | 132 | 1.9 | 100 |
| 368 | 3-2 | — | HT4-2 | 139 | 2.1 | 100 |
| 369 | 3-2 | — | HT4-3 | 139 | 1.5 | 100 |
| 370 | 3-2 | — | HT5-1 | 142 | 2.0 | 100 |
| 371 | 3-2 | — | HT6-1 | 150 | 2.4 | 100 |
| 372 | 3-2 | — | HT7-1 | 147 | 2.4 | 100 |

TABLE 18

| Ex. | Binding resin Main | Blend | HTM | VL (V) | Wear (μm) | Adhesion (%) |
|---|---|---|---|---|---|---|
| 373 | 3-3 | — | HT8-1 | 151 | 3.0 | 100 |
| 374 | 3-3 | — | HT8-2 | 149 | 2.1 | 100 |
| 375 | 3-3 | — | HT9-1 | 140 | 2.4 | 100 |
| 376 | 3-3 | — | HT9-2 | 150 | 2.0 | 100 |
| 377 | 3-3 | — | HT10-1 | 150 | 2.9 | 100 |
| 378 | 3-3 | — | HT10-2 | 141 | 2.6 | 100 |
| 379 | 3-3 | — | HT11-1 | 143 | 2.3 | 100 |
| 380 | 3-3 | — | HT11-2 | 155 | 2.7 | 100 |
| 381 | 3-3 | — | HT12-1 | 146 | 2.2 | 100 |
| 382 | 3-3 | — | HT12-2 | 153 | 2.5 | 100 |
| 383 | 3-3 | — | HT13-1 | 148 | 2.1 | 100 |
| 384 | 3-3 | — | HT13-2 | 154 | 2.5 | 100 |
| 385 | 3-3 | — | HT13-3 | 152 | 2.4 | 100 |
| 386 | 3-3 | — | HT1-1 | 149 | 2.1 | 100 |
| 387 | 3-3 | A-1 | HT1-1 | 120 | 2.4 | 100 |
| Comp. Ex. 1 | A-4 | — | HT1-1 | 191 | 6.4 | 30 |
| Comp. Ex. 2 | 1-1 | — | HT14-1 | 239 | 2.6 | 100 |

In Tables 1 to 18, the photosensitive material having a mark (*) means that in which no electron transferring material is added.

Examples 388 to 759

[Single-layer photosensitive material for analog light source (positive charging type)]

According to the same manner as that described in Examples 1 to 387 except for using a bisazo pigment represented by the following formula (CG2) in place of the electric charge generating material (CG1) used in Examples 1 to 387, a single-layer photosensitive material for analog light source was produced, respectively.

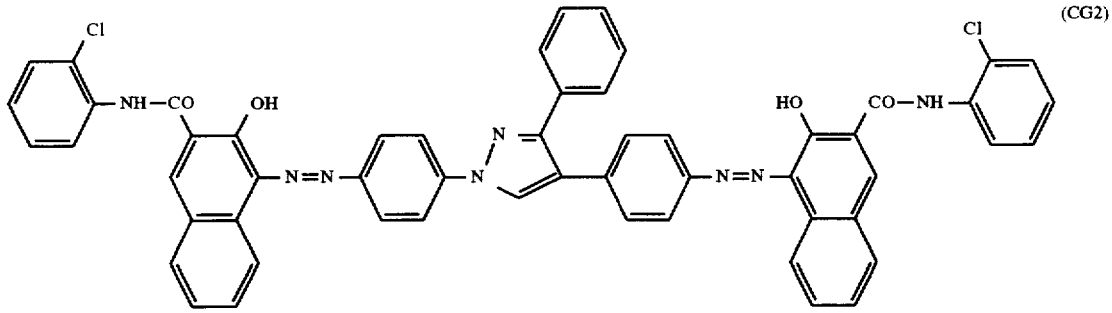

(CG2)

Comparative Example 3

According to the same manner as that described in Example 388 except for using 90 parts by weight of the polycarbonate resin having a repeating unit of the above formula (A-4) as the binding resin, a single-layer photosensitive material was produced.

Comparative Example 4

According to the same manner as that described in Examples 388 except for using the compound represented by the above formula (HT14-1) as the hole transfering material, a single-layer photosensitive material was produced.

The resulting electrophotosensitive materials of the respective Examples and Comparative Examples were subjected to the following tests and their characteristics were evaluated.

<Evaluation of positive charging photosensitive material for analog light source>

Photosensitivity test

By using a drum sensitivity tester manufactured by GENTEC Co., a voltage was applied on the surface of a photosensitive material obtained in the respective Examples and Comparative Examples to charge the surface at +700 V, respectively. Then, white light (light intensity: 147 lux second) of a halogen lamp as an exposure light source was irradiated on the surface of the photosensitive material (irradiation time: 50 msec.). Furthermore, a surface potential at the time at which 330 msec. has passed since the beginning of exposure was measured as a potential after exposure $V_L$ (V).

Wear resistance test

A photosensitive material obtained in the respective Examples and Comparative Examples was fit with an electrostatic copying machine (Model DC-2556, manufactured by Mita Industrial Co., Ltd.) and, after rotating 150,000 times without passing a paper through it, a change in film thickness of a photosensitive layer before and after rotation was determined, respectively.

Adhesion test

It was measured according to the same manner as that described above.

These test results are shown in Tables 19 to 36, together with the above-described compound No. of the binding resin and the hole transferring material (HTM) used.

TABLE 19

| Ex. | Binding resin Main | Blend | HTM | VL (V) | Wear (μm) | Adhesion (%) |
|---|---|---|---|---|---|---|
| 388 | 1-1 | — | HT1-1 | 195 | 1.7 | 100 |
| 389 | 1-1 | — | HT1-2 | 180 | 1.5 | 100 |
| 390 | 1-1 | — | HT1-3 | 177 | 2.0 | 100 |
| 391 | 1-1 | — | HT1-4 | 181 | 1.6 | 100 |
| 392 | 1-1 | — | HT1-5 | 181 | 1.6 | 100 |
| 393 | 1-1 | — | HT1-6 | 180 | 1.7 | 100 |
| 394 | 1-1 | — | HT1-7 | 179 | 1.2 | 100 |
| 395 | 1-1 | — | HT1-8 | 180 | 1.0 | 100 |
| 396 | 1-1 | — | HT1-9 | 180 | 1.8 | 100 |
| 397 | 1-1 | — | HT1-10 | 181 | 2.0 | 100 |
| 398 | 1-1 | — | HT1-11 | 178 | 1.3 | 100 |
| 399 | 1-1 | — | HT2-1 | 195 | 1.0 | 100 |
| 400 | 1-1 | — | HT2-2 | 209 | 0.8 | 100 |
| 401 | 1-1 | — | HT2-3 | 194 | 0.8 | 100 |

TABLE 19-continued

| Ex. | Binding resin Main | Blend | HTM | VL (V) | Wear (μm) | Adhesion (%) |
|---|---|---|---|---|---|---|
| 402 | 1-1 | — | HT2-4 | 198 | 0.7 | 100 |
| 403 | 1-1 | — | HT2-5 | 202 | 0.9 | 100 |
| 404 | 1-1 | — | HT2-6 | 193 | 1.1 | 100 |
| 405 | 1-1 | — | HT3-1 | 206 | 1.2 | 100 |
| 406 | 1-1 | — | HT3-2 | 195 | 0.6 | 100 |
| 407 | 1-1 | — | HT3-3 | 210 | 0.7 | 100 |
| 408 | 1-1 | — | HT3-4 | 194 | 0.7 | 100 |
| 409 | 1-1 | — | HT3-5 | 200 | 0.9 | 100 |
| 410 | 1-1 | — | HT4-1 | 207 | 1.2 | 100 |
| 411 | 1-1 | — | HT4-2 | 192 | 1.1 | 100 |
| 412 | 1-1 | — | HT4-3 | 192 | 1.0 | 100 |
| 413 | 1-1 | — | HT5-1 | 203 | 1.4 | 100 |
| 414 | 1-1 | — | HT6-1 | 208 | 1.3 | 100 |
| 415 | 1-1 | — | HT7-1 | 218 | 1.9 | 100 |

TABLE 20

| Ex. | Binding resin Main | Blend | HTM | VL (V) | Wear (μm) | Adhesion (%) |
|---|---|---|---|---|---|---|
| 416 | 1-1 | — | HT8-1 | 204 | 1.3 | 100 |
| 417 | 1-1 | — | HT8-2 | 216 | 1.7 | 100 |
| 418 | 1-1 | — | HT9-1 | 203 | 1.9 | 100 |
| 419 | 1-1 | — | HT9-2 | 215 | 1.6 | 100 |
| 420 | 1-1 | — | HT10-1 | 211 | 1.6 | 100 |
| 421 | 1-1 | — | HT10-2 | 211 | 2.0 | 100 |
| 422 | 1-1 | — | HT11-1 | 200 | 1.4 | 100 |
| 423 | 1-1 | — | HT11-2 | 219 | 1.9 | 100 |
| 424 | 1-1 | — | HT12-1 | 204 | 1.2 | 100 |
| 425 | 1-1 | — | HT12-2 | 218 | 1.8 | 100 |
| 426 | 1-1 | — | HT13-1 | 214 | 1.5 | 100 |
| 427 | 1-1 | — | HT13-2 | 212 | 1.1 | 100 |
| 428 | 1-1 | — | HT13-3 | 207 | 1.0 | 100 |
| 429 | 1-1 | — | HT1-1 | 192 | 1.3 | 100 |
| 430 | 1-1 | A-1 | HT1-1 | 180 | 1.8 | 100 |

TABLE 21

| Ex. | Binding resin Main | Blend | HTM | VL (V) | Wear (μm) | Adhesion (%) |
|---|---|---|---|---|---|---|
| 431 | 1-2 | — | HT1-1 | 203 | 1.3 | 100 |
| 432 | 1-2 | — | HT1-2 | 178 | 1.7 | 100 |
| 433 | 1-2 | — | HT1-3 | 185 | 1.7 | 100 |
| 434 | 1-2 | — | HT1-4 | 182 | 2.0 | 100 |
| 435 | 1-2 | — | HT1-5 | 182 | 1.2 | 100 |
| 436 | 1-2 | — | HT1-6 | 179 | 1.6 | 100 |
| 437 | 1-2 | — | HT1-7 | 178 | 1.9 | 100 |
| 438 | 1-2 | — | HT1-8 | 183 | 1.8 | 100 |
| 439 | 1-2 | — | HT1-9 | 177 | 1.5 | 100 |
| 440 | 1-2 | — | HT1-10 | 181 | 1.3 | 100 |
| 441 | 1-2 | — | HT1-11 | 180 | 1.0 | 100 |
| 442 | 1-2 | — | HT2-1 | 200 | 0.8 | 100 |
| 443 | 1-2 | — | HT2-2 | 200 | 1.2 | 100 |
| 444 | 1-2 | — | HT2-3 | 206 | 0.6 | 100 |
| 445 | 1-2 | — | HT2-4 | 203 | 1.1 | 100 |
| 446 | 1-2 | — | HT2-5 | 199 | 1.0 | 100 |
| 447 | 1-2 | — | HT2-6 | 210 | 0.7 | 100 |
| 448 | 1-2 | — | HT3-1 | 208 | 0.9 | 100 |
| 449 | 1-2 | — | HT3-2 | 201 | 0.9 | 100 |
| 450 | 1-2 | — | HT3-3 | 202 | 0.9 | 100 |
| 451 | 1-2 | — | HT3-4 | 194 | 1.2 | 100 |
| 452 | 1-2 | — | HT3-5 | 192 | 0.6 | 100 |
| 453 | 1-2 | — | HT4-1 | 195 | 0.7 | 100 |
| 454 | 1-2 | — | HT4-2 | 199 | 0.9 | 100 |
| 455 | 1-2 | — | HT4-3 | 195 | 0.8 | 100 |
| 456 | 1-2 | — | HT5-1 | 207 | 1.8 | 100 |

TABLE 21-continued

| Ex. | Binding resin Main | Blend | HTM | VL (V) | Wear (μm) | Adhesion (%) |
|---|---|---|---|---|---|---|
| 457 | 1-2 | — | HT6-1 | 215 | 1.6 | 100 |
| 458 | 1-2 | — | HT7-1 | 212 | 1.6 | 100 |

TABLE 22

| Ex. | Binding resin Main | Blend | HTM | VL (V) | Wear (μm) | Adhesion (%) |
|---|---|---|---|---|---|---|
| 459 | 1-2 | — | HT8-1 | 217 | 1.9 | 100 |
| 460 | 1-2 | — | HT8-2 | 208 | 2.0 | 100 |
| 461 | 1-2 | — | HT9-1 | 215 | 1.3 | 100 |
| 462 | 1-2 | — | HT9-2 | 205 | 1.2 | 100 |
| 463 | 1-2 | — | HT10-1 | 210 | 1.3 | 100 |
| 464 | 1-2 | — | HT10-2 | 210 | 1.4 | 100 |
| 465 | 1-2 | — | HT11-1 | 214 | 1.4 | 100 |
| 466 | 1-2 | — | HT11-2 | 206 | 1.0 | 100 |
| 467 | 1-2 | — | HT12-1 | 217 | 1.5 | 100 |
| 468 | 1-2 | — | HT12-2 | 200 | 2.0 | 100 |
| 469 | 1-2 | — | HT13-1 | 205 | 1.7 | 100 |
| 470 | 1-2 | — | HT13-2 | 203 | 1.4 | 100 |
| 471 | 1-2 | — | HT13-3 | 219 | 1.1 | 100 |
| 472 | 1-2 | — | HT1-1 | 197 | 1.1 | 100 |
| 473 | 1-2 | A-1 | HT1-1 | 179 | 1.6 | 100 |

TABLE 23

| Ex. | Binding resin Main | Blend | HTM | VL (V) | Wear (μm) | Adhesion (%) |
|---|---|---|---|---|---|---|
| 474 | 1-3 | — | HT1-1 | 197 | 1.8 | 100 |
| 475 | 1-3 | — | HT1-2 | 183 | 1.5 | 100 |
| 476 | 1-3 | — | HT1-3 | 180 | 2.0 | 100 |
| 477 | 1-3 | — | HT1-4 | 178 | 1.1 | 100 |
| 478 | 1-3 | — | HT1-5 | 184 | 1.8 | 100 |
| 479 | 1-3 | — | HT1-6 | 180 | 1.9 | 100 |
| 480 | 1-3 | — | HT1-7 | 182 | 1.2 | 100 |
| 481 | 1-3 | — | HT1-8 | 177 | 1.3 | 100 |
| 482 | 1-3 | — | HT1-9 | 179 | 1.6 | 100 |
| 483 | 1-3 | — | HT1-10 | 179 | 1.4 | 100 |
| 484 | 1-3 | — | HT1-11 | 182 | 1.0 | 100 |
| 485 | 1-3 | — | HT2-1 | 193 | 1.2 | 100 |
| 486 | 1-3 | — | HT2-2 | 209 | 0.6 | 100 |
| 487 | 1-3 | — | HT2-3 | 211 | 0.8 | 100 |
| 488 | 1-3 | — | HT2-4 | 215 | 0.8 | 100 |
| 489 | 1-3 | — | HT2-5 | 193 | 0.7 | 100 |
| 490 | 1-3 | — | HT2-6 | 208 | 1.0 | 100 |
| 491 | 1-3 | — | HT3-1 | 208 | 0.9 | 100 |
| 492 | 1-3 | — | HT3-2 | 200 | 1.1 | 100 |
| 493 | 1-3 | — | HT3-3 | 190 | 1.2 | 100 |
| 494 | 1-3 | — | HT3-4 | 191 | 0.9 | 100 |
| 495 | 1-3 | — | HT3-5 | 204 | 0.8 | 100 |
| 496 | 1-3 | — | HT4-1 | 207 | 1.0 | 100 |
| 497 | 1-3 | — | HT4-2 | 192 | 0.8 | 100 |
| 498 | 1-3 | — | HT4-3 | 200 | 0.6 | 100 |
| 499 | 1-3 | — | HT5-1 | 204 | 1.8 | 100 |
| 500 | 1-3 | — | HT6-1 | 212 | 1.0 | 100 |
| 501 | 1-3 | — | HT7-1 | 210 | 1.2 | 100 |

TABLE 24

| Ex. | Binding resin Main | Blend | HTM | VL (V) | Wear (μm) | Adhesion (%) |
|---|---|---|---|---|---|---|
| 502 | 1-3 | — | HT8-1 | 210 | 1.8 | 100 |
| 503 | 1-3 | — | HT8-2 | 215 | 1.2 | 100 |

TABLE 24-continued

| Ex. | Binding resin Main | Blend | HTM | VL (V) | Wear (μm) | Adhesion (%) |
|---|---|---|---|---|---|---|
| 504 | 1–3 | — | HT9-1 | 214 | 1.6 | 100 |
| 505 | 1–3 | — | HT9-2 | 217 | 1.0 | 100 |
| 506 | 1–3 | — | HT10-1 | 208 | 1.4 | 100 |
| 507 | 1–3 | — | HT10-2 | 215 | 1.9 | 100 |
| 508 | 1–3 | — | HT11-1 | 209 | 1.1 | 100 |
| 509 | 1–3 | — | HT11-2 | 210 | 1.5 | 100 |
| 510 | 1–3 | — | HT12-1 | 210 | 1.6 | 100 |
| 511 | 1–3 | — | HT12-2 | 218 | 1.6 | 100 |
| 512 | 1–3 | — | HT13-1 | 212 | 1.1 | 100 |
| 513 | 1–3 | — | HT13-2 | 207 | 1.8 | 100 |
| 514 | 1–3 | — | HT13-3 | 206 | 1.4 | 100 |
| 515 | 1–3 | — | HT1-1 | 195 | 1.5 | 100 |
| 516 | 1–3 | A-1 | HT1-1 | 180 | 1.2 | 100 |

TABLE 25

| Ex. | Binding resin Main | Blend | HTM | VL (V) | Wear (μm) | Adhesion (%) |
|---|---|---|---|---|---|---|
| 517 | 2–1 | — | HT1-1 | 200 | 0.8 | 100 |
| 518 | 2–1 | — | HT1-2 | 180 | 0.7 | 100 |
| 519 | 2–1 | — | HT1-3 | 178 | 1.4 | 100 |
| 520 | 2–1 | — | HT1-4 | 179 | 0.8 | 100 |
| 521 | 2–1 | — | HT1-5 | 182 | 1.0 | 100 |
| 522 | 2–1 | — | HT1-6 | 181 | 0.9 | 100 |
| 523 | 2–1 | — | HT1-7 | 181 | 1.2 | 100 |
| 524 | 2–1 | — | HT1-8 | 179 | 1.2 | 100 |
| 525 | 2–1 | — | HT1-9 | 182 | 0.9 | 100 |
| 526 | 2–1 | — | HT1-10 | 183 | 0.7 | 100 |
| 527 | 2–1 | — | HT1-11 | 180 | 1.3 | 100 |
| 528 | 2–1 | — | HT2-1 | 198 | 0.8 | 100 |
| 529 | 2–1 | — | HT2-2 | 204 | 0.7 | 100 |
| 530 | 2–1 | — | HT2-3 | 218 | 0.6 | 100 |
| 531 | 2–1 | — | HT2-4 | 195 | 0.4 | 100 |
| 532 | 2–1 | — | HT2-5 | 218 | 0.6 | 100 |
| 533 | 2–1 | — | HT2-6 | 200 | 0.7 | 100 |
| 534 | 2–1 | — | HT3-1 | 200 | 0.5 | 100 |
| 535 | 2–1 | — | HT3-2 | 198 | 0.5 | 100 |
| 536 | 2–1 | — | HT3-3 | 212 | 0.5 | 100 |
| 537 | 2–1 | — | HT3-4 | 209 | 0.8 | 100 |
| 538 | 2–1 | — | HT3-5 | 206 | 0.7 | 100 |
| 539 | 2–1 | — | HT4-1 | 193 | 0.4 | 100 |
| 540 | 2–1 | — | HT4-2 | 197 | 0.6 | 100 |
| 541 | 2–1 | — | HT4-3 | 216 | 0.6 | 100 |
| 542 | 2–1 | — | HT5-1 | 216 | 0.9 | 100 |
| 543 | 2–1 | — | HT6-1 | 215 | 0.8 | 100 |
| 544 | 2–1 | — | HT7-1 | 218 | 0.9 | 100 |

TABLE 26

| Ex. | Binding resin Main | Blend | HTM | VL (V) | Wear (μm) | Adhesion (%) |
|---|---|---|---|---|---|---|
| 545 | 2–1 | — | HT8-1 | 192 | 0.9 | 100 |
| 546 | 2–1 | — | HT8-2 | 205 | 1.3 | 100 |
| 547 | 2–1 | — | HT9-1 | 203 | 0.7 | 100 |
| 548 | 2–1 | — | HT9-2 | 208 | 1.2 | 100 |
| 549 | 2–1 | — | HT10-1 | 216 | 0.8 | 100 |
| 550 | 2–1 | — | HT10-2 | 210 | 1.4 | 100 |
| 551 | 2–1 | — | HT11-1 | 212 | 1.0 | 100 |
| 552 | 2–1 | — | HT11-2 | 215 | 1.0 | 100 |
| 553 | 2–1 | — | HT12-1 | 208 | 0.9 | 100 |
| 554 | 2–1 | — | HT12-2 | 208 | 0.9 | 100 |
| 555 | 2–1 | — | HT13-1 | 217 | 0.8 | 100 |
| 556 | 2–1 | — | HT13-2 | 214 | 1.3 | 100 |
| 557 | 2–1 | — | HT13-3 | 209 | 1.1 | 100 |
| 558 | 2–1 | — | HT1-1 | 193 | 0.5 | 100 |

TABLE 26-continued

| Ex. | Binding resin Main | Blend | HTM | VL (V) | Wear (μm) | Adhesion (%) |
|---|---|---|---|---|---|---|
| 559 | 2–1 | A-1 | HT1-1 | 179 | 0.7 | 100 |

TABLE 27

| Ex. | Binding resin Main | Blend | HTM | VL (V) | Wear (μm) | Adhesion (%) |
|---|---|---|---|---|---|---|
| 560 | 2–2 | — | HT1-1 | 179 | 0.7 | 100 |
| 561 | 2–2 | — | HT1-2 | 176 | 1.1 | 100 |
| 562 | 2–2 | — | HT1-3 | 181 | 1.2 | 100 |
| 563 | 2–2 | — | HT1-4 | 180 | 1.4 | 100 |
| 564 | 2–2 | — | HT1-5 | 178 | 0.8 | 100 |
| 565 | 2–2 | — | HT1-6 | 181 | 0.7 | 100 |
| 566 | 2–2 | — | HT1-7 | 177 | 1.3 | 100 |
| 567 | 2–2 | — | HT1-8 | 177 | 1.2 | 100 |
| 568 | 2–2 | — | HT1-9 | 182 | 0.9 | 100 |
| 569 | 2–2 | — | HT1-10 | 179 | 0.9 | 100 |
| 570 | 2–2 | — | HT1-11 | 180 | 1.0 | 100 |
| 571 | 2–2 | — | HT2-1 | 193 | 0.7 | 100 |
| 572 | 2–2 | — | HT2-2 | 208 | 0.8 | 100 |
| 573 | 2–2 | — | HT2-3 | 200 | 0.5 | 100 |
| 574 | 2–2 | — | HT2-4 | 197 | 0.6 | 100 |
| 575 | 2–2 | — | HT2-5 | 202 | 0.6 | 100 |
| 576 | 2–2 | — | HT2-6 | 202 | 0.6 | 100 |
| 577 | 2–2 | — | HT3-1 | 196 | 0.7 | 100 |
| 578 | 2–2 | — | HT3-2 | 200 | 0.5 | 100 |
| 579 | 2–2 | — | HT3-3 | 195 | 0.4 | 100 |
| 580 | 2–2 | — | HT3-4 | 197 | 0.8 | 100 |
| 581 | 2–2 | — | HT3-5 | 206 | 0.6 | 100 |
| 582 | 2–2 | — | HT4-1 | 197 | 0.8 | 100 |
| 583 | 2–2 | — | HT4-2 | 197 | 0.7 | 100 |
| 584 | 2–2 | — | HT4-3 | 190 | 0.7 | 100 |
| 585 | 2–2 | — | HT5-1 | 218 | 0.7 | 100 |
| 586 | 2–2 | — | HT6-1 | 218 | 0.9 | 100 |
| 587 | 2–2 | — | HT7-1 | 203 | 1.0 | 100 |

TABLE 28

| Ex. | Binding resin Main | Blend | HTM | VL (V) | Wear (μm) | Adhesion (%) |
|---|---|---|---|---|---|---|
| 588 | 2-2 | — | HT8-1 | 204 | 1.3 | 100 |
| 589 | 2-2 | — | HT8-2 | 208 | 0.9 | 100 |
| 590 | 2-2 | — | HT9-1 | 210 | 1.1 | 100 |
| 591 | 2-2 | — | HT9-2 | 216 | 1.0 | 100 |
| 592 | 2-2 | — | HT10-1 | 207 | 1.0 | 100 |
| 593 | 2-2 | — | HT10-2 | 200 | 1.0 | 100 |
| 594 | 2-2 | — | HT11-1 | 219 | 1.2 | 100 |
| 595 | 2-2 | — | HT11-2 | 216 | 1.3 | 100 |
| 596 | 2-2 | — | HT12-1 | 220 | 0.9 | 100 |
| 597 | 2-2 | — | HT12-2 | 213 | 0.8 | 100 |
| 598 | 2-2 | — | HT13-1 | 217 | 0.8 | 100 |
| 599 | 2-2 | — | HT13-2 | 205 | 0.7 | 100 |
| 500 | 2-2 | — | HT13-3 | 204 | 1.4 | 100 |
| 501 | 2-2 | — | HT1-1 | 200 | 0.6 | 100 |
| 502 | 2-2 | — | HT1-1 | 182 | 0.7 | 100 |

TABLE 29

| Ex. | Binding resin Main | Blend | HTM | VL (V) | Wear (μm) | Adhesion (%) |
|---|---|---|---|---|---|---|
| 603 | 2–3 | — | HT1-1 | 198 | 0.6 | 100 |
| 604 | 2–3 | — | HT1-2 | 177 | 1.4 | 100 |
| 605 | 2–3 | — | HT1-3 | 180 | 0.7 | 100 |

TABLE 29-continued

| Ex. | Binding resin Main | Blend | HTM | VL (V) | Wear (μm) | Adhesion (%) |
|---|---|---|---|---|---|---|
| 606 | 2-3 | — | HT1-4 | 179 | 0.9 | 100 |
| 607 | 2-3 | — | HT1-5 | 177 | 1.3 | 100 |
| 608 | 2-3 | — | HT1-6 | 180 | 0.7 | 100 |
| 609 | 2-3 | — | HT1-7 | 180 | 1.4 | 100 |
| 610 | 2-3 | — | HT1-8 | 182 | 0.9 | 100 |
| 611 | 2-3 | — | HT1-9 | 178 | 0.9 | 100 |
| 612 | 2-3 | — | HT1-10 | 179 | 1.0 | 100 |
| 613 | 2-3 | — | HT1-11 | 183 | 0.8 | 100 |
| 614 | 2-3 | — | HT2-1 | 208 | 0.7 | 100 |
| 615 | 2-3 | — | HT2-2 | 195 | 0.8 | 100 |
| 616 | 2-3 | — | HT2-3 | 192 | 0.5 | 100 |
| 617 | 2-3 | — | HT2-4 | 200 | 0.5 | 100 |
| 618 | 2-3 | — | HT2-5 | 200 | 0.4 | 100 |
| 619 | 2-3 | — | HT2-6 | 210 | 0.6 | 100 |
| 620 | 2-3 | — | HT3-1 | 206 | 0.6 | 100 |
| 621 | 2-3 | — | HT3-2 | 191 | 0.6 | 100 |
| 622 | 2-3 | — | HT3-3 | 198 | 0.7 | 100 |
| 623 | 2-3 | — | HT3-4 | 200 | 0.5 | 100 |
| 624 | 2-3 | — | HT3-5 | 207 | 0.8 | 100 |
| 625 | 2-3 | — | HT4-1 | 204 | 0.4 | 100 |
| 626 | 2-3 | — | HT4-2 | 210 | 0.8 | 100 |
| 627 | 2-3 | — | HT4-3 | 199 | 0.5 | 100 |
| 628 | 2-3 | — | HT5-1 | 212 | 1.3 | 100 |
| 629 | 2-3 | — | HT6-1 | 200 | 1.0 | 100 |
| 630 | 2-3 | — | HT7-1 | 200 | 1.0 | 100 |

TABLE 30

| Ex. | Binding resin Main | Blend | HTM | VL (V) | Wear (μm) | Adhesion (%) |
|---|---|---|---|---|---|---|
| 631 | 2-3 | — | HT8-1 | 203 | 0.7 | 100 |
| 632 | 2-3 | — | HT8-2 | 216 | 1.3 | 100 |
| 633 | 2-3 | — | HT9-1 | 220 | 1.0 | 100 |
| 634 | 2-3 | — | HT9-2 | 219 | 0.9 | 100 |
| 635 | 2-3 | — | HT10-1 | 216 | 0.9 | 100 |
| 636 | 2-3 | — | HT10-2 | 200 | 1.2 | 100 |
| 637 | 2-3 | — | HT11-1 | 210 | 0.8 | 100 |
| 638 | 2-3 | — | HT11-2 | 215 | 1.2 | 100 |
| 639 | 2-3 | — | HT12-1 | 207 | 1.0 | 100 |
| 640 | 2-3 | — | HT12-2 | 207 | 1.4 | 100 |
| 641 | 2-3 | — | HT13-1 | 218 | 0.9 | 100 |
| 642 | 2-3 | — | HT13-2 | 204 | 1.3 | 100 |
| 643 | 2-3 | — | HT13-3 | 208 | 1.0 | 100 |
| 644 | 2-3 | — | HT1-1 | 201 | 0.9 | 100 |
| 645 | 2-3 | A-1 | HT1-1 | 179 | 1.2 | 100 |

TABLE 31

| Ex. | Binding resin Main | Blend | HTM | VL (V) | Wear (μm) | Adhesion (%) |
|---|---|---|---|---|---|---|
| 646 | 3-1 | — | HT1-1 | 195 | 1.9 | 100 |
| 647 | 3-1 | — | HT1-2 | 170 | 1.0 | 100 |
| 648 | 3-1 | — | HT1-3 | 170 | 1.7 | 100 |
| 649 | 3-1 | — | HT1-4 | 168 | 1.4 | 100 |
| 650 | 3-1 | — | HT1-5 | 170 | 1.4 | 100 |
| 651 | 3-1 | — | HT1-6 | 167 | 1.8 | 100 |
| 652 | 3-1 | — | HT1-7 | 169 | 1.5 | 100 |
| 653 | 3-1 | — | HT1-8 | 173 | 1.0 | 100 |
| 654 | 3-1 | — | HT1-9 | 172 | 1.6 | 100 |
| 655 | 3-1 | — | HT1-10 | 170 | 1.2 | 100 |
| 656 | 3-1 | — | HT1-11 | 171 | 1.2 | 100 |
| 657 | 3-1 | — | HT2-1 | 176 | 1.2 | 100 |
| 658 | 3-1 | — | HT2-2 | 179 | 0.7 | 100 |
| 659 | 3-1 | — | HT2-3 | 179 | 1.9 | 100 |
| 660 | 3-1 | — | HT2-4 | 180 | 1.1 | 100 |
| 661 | 3-1 | — | HT2-5 | 184 | 0.8 | 100 |

TABLE 31-continued

| Ex. | Binding resin Main | Blend | HTM | VL (V) | Wear (μm) | Adhesion (%) |
|---|---|---|---|---|---|---|
| 662 | 3-1 | — | HT2-6 | 175 | 0.7 | 100 |
| 663 | 3-1 | — | HT3-1 | 176 | 1.0 | 100 |
| 664 | 3-1 | — | HT3-2 | 184 | 0.6 | 100 |
| 665 | 3-1 | — | HT3-3 | 180 | 1.2 | 100 |
| 666 | 3-1 | — | HT3-4 | 185 | 0.8 | 100 |
| 667 | 3-1 | — | HT3-5 | 180 | 1.1 | 100 |
| 668 | 3-1 | — | HT4-1 | 183 | 1.0 | 100 |
| 669 | 3-1 | — | HT4-2 | 181 | 1.0 | 100 |
| 670 | 3-1 | — | HT4-3 | 179 | 0.9 | 100 |
| 671 | 3-1 | — | HT5-1 | 193 | 1.5 | 100 |
| 672 | 3-1 | — | HT6-1 | 181 | 1.4 | 100 |
| 673 | 3-1 | — | HT7-1 | 189 | 1.4 | 100 |

TABLE 32

| Ex. | Binding resin Main | Blend | HTM | VL (V) | Wear (μm) | Adhesion (%) |
|---|---|---|---|---|---|---|
| 674 | 3-1 | — | HT8-1 | 194 | 1.0 | 100 |
| 675 | 3-1 | — | HT8-2 | 190 | 1.1 | 100 |
| 676 | 3-1 | — | HT9-1 | 181 | 1.6 | 100 |
| 677 | 3-1 | — | HT9-2 | 181 | 1.9 | 100 |
| 678 | 3-1 | — | HT10-1 | 192 | 1.4 | 100 |
| 679 | 3-1 | — | HT10-2 | 185 | 1.0 | 100 |
| 680 | 3-1 | — | HT11-1 | 193 | 1.3 | 100 |
| 681 | 3-1 | — | HT11-2 | 186 | 1.3 | 100 |
| 682 | 3-1 | — | HT12-1 | 180 | 1.4 | 100 |
| 683 | 3-1 | — | HT12-2 | 185 | 1.8 | 100 |
| 684 | 3-1 | — | HT13-1 | 188 | 1.5 | 100 |
| 685 | 3-1 | — | HT13-2 | 182 | 2.0 | 100 |
| 686 | 3-1 | — | HT13-3 | 195 | 1.2 | 100 |
| 687 | 3-1 | — | HT1-1 | 188 | 1.3 | 100 |
| 688 | 3-1 | — | HT1-1 | 170 | 1.8 | 100 |

TABLE 33

| Ex. | Binding resin Main | Blend | HTM | VL (V) | Wear (μm) | Adhesion (%) |
|---|---|---|---|---|---|---|
| 689 | 3-2 | — | HT1-1 | 185 | 1.1 | 100 |
| 690 | 3-2 | — | HT1-2 | 170 | 1.0 | 100 |
| 691 | 3-2 | — | HT1-3 | 170 | 1.9 | 100 |
| 692 | 3-2 | — | HT1-4 | 171 | 1.1 | 100 |
| 693 | 3-2 | — | HT1-5 | 173 | 1.8 | 100 |
| 694 | 3-2 | — | HT1-6 | 173 | 1.7 | 100 |
| 695 | 3-2 | — | HT1-7 | 170 | 1.5 | 100 |
| 696 | 3-2 | — | HT1-8 | 169 | 1.2 | 100 |
| 697 | 3-2 | — | HT1-9 | 168 | 1.6 | 100 |
| 698 | 3-2 | — | HT1-10 | 170 | 1.6 | 100 |
| 699 | 3-2 | — | HT1-11 | 170 | 1.3 | 100 |
| 700 | 3-2 | — | HT2-1 | 175 | 0.7 | 100 |
| 701 | 3-2 | — | HT2-2 | 185 | 0.7 | 100 |
| 702 | 3-2 | — | HT2-3 | 181 | 0.6 | 100 |
| 703 | 3-2 | — | HT2-4 | 182 | 1.0 | 100 |
| 704 | 3-2 | — | HT2-5 | 175 | 1.1 | 100 |
| 705 | 3-2 | — | HT2-6 | 177 | 0.9 | 100 |
| 706 | 3-2 | — | HT3-1 | 177 | 1.2 | 100 |
| 707 | 3-2 | — | HT3-2 | 180 | 0.8 | 100 |
| 708 | 3-2 | — | HT3-3 | 180 | 0.7 | 100 |
| 709 | 3-2 | — | HT3-4 | 183 | 0.8 | 100 |
| 710 | 3-2 | — | HT3-5 | 176 | 1.0 | 100 |
| 711 | 3-2 | — | HT4-1 | 179 | 1.0 | 100 |
| 712 | 3-2 | — | HT4-2 | 185 | 1.2 | 100 |
| 713 | 3-2 | — | HT4-3 | 178 | 0.9 | 100 |
| 714 | 3-2 | — | HT5-1 | 180 | 1.8 | 100 |
| 715 | 3-2 | — | HT6-1 | 180 | 2.0 | 100 |
| 716 | 3-2 | — | HT7-1 | 190 | 1.1 | 100 |

TABLE 34

| Ex. | Binding resin Main | Blend | HTM | VL (V) | Wear (μm) | Adhesion (%) |
|---|---|---|---|---|---|---|
| 717 | 3–2 | — | HT8-1 | 196 | 1.5 | 100 |
| 718 | 3–2 | — | HT8-2 | 184 | 0.9 | 100 |
| 719 | 3–2 | — | HT9-1 | 182 | 0.8 | 100 |
| 720 | 3–2 | — | HT9-2 | 184 | 1.2 | 100 |
| 721 | 3–2 | — | HT10-1 | 195 | 0.7 | 100 |
| 722 | 3–2 | — | HT10-2 | 189 | 1.0 | 100 |
| 723 | 3–2 | — | HT11-1 | 191 | 1.0 | 100 |
| 724 | 3–2 | — | HT11-2 | 180 | 1.3 | 100 |
| 725 | 3–2 | — | HT12-1 | 188 | 0.9 | 100 |
| 726 | 3–2 | — | HT12-2 | 188 | 1.3 | 100 |
| 727 | 3–2 | — | HT13-1 | 193 | 0.7 | 100 |
| 728 | 3–2 | — | HT13-2 | 184 | 1.1 | 100 |
| 729 | 3–2 | — | HT13-3 | 185 | 1.4 | 100 |
| 730 | 3–2 | — | HT1-1 | 190 | 1.2 | 100 |
| 731 | 3–2 | A-1 | HT1-1 | 168 | 1.3 | 100 |

TABLE 35

| Ex. | Binding resin Main | Blend | HTM | VL (V) | Wear (μm) | Adhesion (%) |
|---|---|---|---|---|---|---|
| 717 | 3–3 | — | HT1-1 | 168 | 2.0 | 100 |
| 718 | 3–3 | — | HT1-2 | 166 | 1.4 | 100 |
| 719 | 3–3 | — | HT1-3 | 170 | 2.0 | 100 |
| 720 | 3–3 | — | HT1-4 | 170 | 1.7 | 100 |
| 721 | 3–3 | — | HT1-5 | 168 | 1.5 | 100 |
| 722 | 3–3 | — | HT1-6 | 167 | 1.5 | 100 |
| 723 | 3–3 | — | HT1-7 | 173 | 1.6 | 100 |
| 724 | 3–3 | — | HT1-8 | 172 | 1.5 | 100 |
| 725 | 3–3 | — | HT1-9 | 171 | 1.0 | 100 |
| 726 | 3–3 | — | HT1-10 | 169 | 1.8 | 100 |
| 727 | 3–3 | — | HT1-11 | 169 | 1.8 | 100 |
| 728 | 3–3 | — | HT2-1 | 175 | 1.2 | 100 |
| 729 | 3–3 | — | HT2-2 | 180 | 1.1 | 100 |
| 730 | 3–3 | — | HT2-3 | 180 | 1.1 | 100 |
| 731 | 3–3 | — | HT2-4 | 177 | 0.8 | 100 |
| 732 | 3–3 | — | HT2-5 | 181 | 0.7 | 100 |
| 733 | 3–3 | — | HT2-6 | 178 | 0.7 | 100 |
| 734 | 3–3 | — | HT3-1 | 184 | 1.0 | 100 |
| 735 | 3–3 | — | HT3-2 | 184 | 0.6 | 100 |
| 736 | 3–3 | — | HT3-3 | 176 | 1.2 | 100 |
| 737 | 3–3 | — | HT3-4 | 181 | 0.9 | 100 |
| 738 | 3–3 | — | HT3-5 | 179 | 0.6 | 100 |
| 739 | 3–3 | — | HT4-1 | 180 | 0.7 | 100 |
| 740 | 3–3 | — | HT4-2 | 182 | 1.0 | 100 |
| 741 | 3–3 | — | HT4-3 | 182 | 1.2 | 100 |
| 742 | 3–3 | — | HT5-1 | 180 | 1.8 | 100 |
| 743 | 3–3 | — | HT6-1 | 181 | 1.8 | 100 |
| 744 | 3–3 | — | HT7-1 | 190 | 1.5 | 100 |

TABLE 36

| Ex. | Binding resin Main | Blend | HTM | VL (V) | Wear (μm) | Adhesion (%) |
|---|---|---|---|---|---|---|
| 745 | 3-3 | — | HT8-1 | 182 | 1.2 | 100 |
| 746 | 3-3 | — | HT8-2 | 185 | 1.4 | 100 |
| 747 | 3-3 | — | HT9-1 | 185 | 2.0 | 100 |
| 748 | 3-3 | — | HT9-2 | 190 | 1.3 | 100 |
| 749 | 3-3 | — | HT10-1 | 193 | 1.3 | 100 |
| 750 | 3-3 | — | HT10-2 | 188 | 1.4 | 100 |
| 751 | 3-3 | — | HT11-1 | 184 | 1.9 | 100 |
| 752 | 3-3 | — | HT11-2 | 190 | 1.0 | 100 |
| 753 | 3-3 | — | HT12-1 | 192 | 1.1 | 100 |
| 754 | 3-3 | — | HT12-2 | 188 | 1.4 | 100 |
| 755 | 3-3 | — | HT13-1 | 195 | 1.9 | 100 |
| 756 | 3-3 | — | HT13-2 | 193 | 1.7 | 100 |

TABLE 36-continued

| Ex. | Binding resin Main | Blend | HTM | VL (V) | Wear (μm) | Adhesion (%) |
|---|---|---|---|---|---|---|
| 757 | 3-3 | — | HT13-3 | 190 | 1.7 | 000 |
| 758* | 3-3 | — | HT1-1 | 185 | 1.6 | 100 |
| 759 | 3-3 | A-1 | HT1-1 | 172 | 1.9 | 100 |
| Comp. Ex. 3 | A-4 | — | HT1-1 | 242 | 5.5 | 30 |
| Comp. Ex. 4 | 1-1 | — | HT14-1 | 305 | 1.4 | 100 |

In Tables 19 to 36, the photosensitive material having a mark (*) means that in which no electron transferring material is added.

Examples 760 to 795

[Multi-layer photosensitive material for digital light source (negative charging type)]

2 Parts by weight of the pigment represented by the above formula (CG1) as the electric charge generating material and 1 part by weight of a polyvinyl butyral as the binding resin were mixed and dispersed, together with 120 parts by weight of dichloromethane as the solvent, by using a ball mill to prepare a coating solution for electric charge generating layer. Then, this coating solution was applied on an aluminum tube by a dip coating method, followed by hot-air drying at 100° C. for 60 minutes to give an electric charge generating layer having a thickness of 0.5 μm.

Then, 80 parts by weight of the hole transferring material represented by the above formula (HT1), (HT2) or (HT3) and 90 parts by weight of any one of polyester resins (1-1) to (1-3), (2-1) to (2-3) and (3-1) to (3-3) obtained in Reference Examples 1 to 9 or a mixture of this polyester resin and a polycarbonate resin as the binding resin were mixed and dispersed, together with 800 parts by weight of tetrahydrofuran, by using a ball mill to prepare a coating solution for electric charge transferring layer. Then, this coating solution was applied on the above electric charge generating layer by a dip coating method, followed by hot-air drying at 100° C. for 60 minutes to form an electric charge transferring layer having a thickness of 15 μm, thereby producing a negative charging type multi-layer photosensitive material for digital light source, respectively.

When using a mixture of the polyester resin and polycarbonate resin as the binding resin, 70 parts by weight of the polyester resin and 20 parts by weight of the polycarbonate resin were used in combination.

Comparative Example 5

According to the same manner as that described in Example 760 except for using 90 parts by weight of the polycarbonate resin having a repeating unit of the above formula (A-4) as the binding resin of the electric charge transferring material, a negative charging type multi-layer photosensitive material for digital light source was produced.

Comparative Example 6

According to the same manner as that described in Examples 760 except for using the compound represented by the above formula (HT14-1) as the hole transferring material, a negative charging type multi-layer photosensitive material for digital light source was produced.

The resulting electrophotosensitive materials of the respective Examples and Comparative Examples were subjected to the following tests and their characteristics were evaluated.

<Evaluation of negative charging photosensitive material for digital light source>

Photosensitivity test

By using a drum sensitivity tester manufactured by GEN-TEC Co., a voltage was applied on the surface of a photosensitive material obtained in the respective Examples and Comparative Examples to charge the surface at −700 V, respectively. Then, monochromatic light [wavelength: 780 nm (half-width: 20 nm), light intensity: 16 μW/cm$^2$] from white light of a halogen lamp as an exposure light source through a band-pass filter was irradiated on the surface of the photosensitive material (irradiation time: 80 msec.). Furthermore, a surface potential at the time at which 330 msec. has passed since the beginning of exposure was measured as a potential after exposure $V_L$ (V).

Wear resistance test

A photosensitive material obtained in the respective Examples and Comparative Examples was fit with an imaging unit of an electrostatic laser printer (Model LP-2080, manufactured by Mita Industrial Co., Ltd.) and, after rotating 150,000 times without passing a paper through it, a change in thickness of a photosensitive layer before and after rotation was determined, respectively.

These test results are shown in Tables 37 to 38, together with the above-described compound No. of the binding resin and hole transferring material used.

TABLE 37

| | Binding resin | | | VL | Wear |
|---|---|---|---|---|---|
| Ex. | Main | Blend | HTM | (V) | (μm) |
| 760 | 1-1 | — | HT1-1 | −86 | 2.4 |
| 761 | 1-1 | — | HT2-1 | −88 | 2.4 |
| 762 | 1-1 | — | HT3-1 | −85 | 2.2 |
| 763 | 1-1 | A-1 | HT1-1 | −90 | 2.5 |
| 764 | 1-2 | — | HT1-1 | −94 | 2.5 |
| 765 | 1-2 | — | HT2-1 | −92 | 2.3 |
| 766 | 1-2 | — | HT3-1 | −90 | 2.5 |
| 767 | 1-2 | A-1 | HT1-1 | −97 | 2.6 |
| 768 | 1-3 | — | HT1-1 | −88 | 2.1 |
| 769 | 1-3 | — | HT2-1 | −85 | 2.2 |
| 770 | 1-3 | — | HT3-1 | −86 | 2.4 |
| 771 | 1-3 | A-1 | HT1-1 | −85 | 2.5 |
| 772 | 2-1 | — | HT1-1 | −90 | 1.1 |
| 773 | 2-1 | — | HT2-1 | −84 | 1.4 |
| 774 | 2-1 | — | HT3-1 | −85 | 1.5 |
| 775 | 2-1 | A-1 | HT1-1 | −86 | 1.5 |
| 776 | 2-2 | — | HT1-1 | −85 | 1.3 |
| 777 | 2-2 | — | HT2-1 | −90 | 1.6 |
| 778 | 2-2 | — | HT3-1 | −85 | 1.3 |
| 779 | 2-2 | A-1 | HT1-1 | −86 | 1.4 |
| 780 | 2-3 | — | HT1-1 | −86 | 1.3 |
| 781 | 2-3 | — | HT2-1 | −84 | 1.6 |
| 782 | 2-3 | — | HT3-1 | −90 | 1.5 |
| 783 | 2-3 | A-1 | HT1-1 | −90 | 1.8 |
| 784 | 3-1 | — | HT1-1 | −66 | 2.4 |
| 785 | 3-1 | — | HT2-1 | −60 | 2.3 |
| 786 | 3-1 | — | HT3-1 | −70 | 2.6 |
| 787 | 3-1 | A-1 | HT1-1 | −71 | 2.2 |

TABLE 38

| | Binding resin | | | VL | Wear |
|---|---|---|---|---|---|
| Ex. | Main | Blend | HTM | (V) | (μm) |
| 788 | 3-2 | — | HT1-1 | −66 | 2.7 |
| 789 | 3-2 | — | HT2-1 | −71 | 2.4 |
| 790 | 3-2 | — | HT3-1 | −70 | 2.3 |
| 791 | 3-2 | A-1 | HT1-1 | −61 | 2.7 |
| 792 | 3-3 | — | HT1-1 | −64 | 2.3 |

TABLE 38-continued

| | Binding resin | | | VL | Wear |
|---|---|---|---|---|---|
| Ex. | Main | Blend | HTM | (V) | (μm) |
| 793 | 3-3 | — | HT2-1 | −69 | 2.5 |
| 794 | 3-3 | — | HT3-1 | −74 | 2.6 |
| 795 | 3-3 | A-1 | HT1-1 | −71 | 2.5 |
| Comp. Ex. 5 | A-4 | — | HT1-1 | −121 | 6.0 |
| Comp. Ex. 6 | 1-1 | — | HT14-1 | −193 | 2.5 |

Examples 796 to 831

[Multi-layer photosensitive material for digital light source (positive charging type)]

80 Parts by weight of the compound represented by the above formulas (HT1), (HT2) or (HT3) as the hole transferring material and 90 parts by weight of any one of polyester resins (1-1) to (1-3), (2-1) to (2-3) and (3-1) to (3-3) obtained in Reference Examples 1 to 9 or a mixture of this polyester resin and polycarbonate resin as the binding resin were mixed and dispersed, together with 800 parts by weight of tetrahydrofuran as the solvent, by using a ball mill to prepare a coating solution for electric charge transferring layer. Then, this coating solution was applied on an aluminum tube by a dip coating method, followed by hot-air drying at 100° C. for 60 minutes to give an electric charge transferring layer having a thickness of 15 μm.

Then, 2 parts by weight of the pigment represented by the above formula (CG1) as the electric charge generating material and 1 parts by weight of the polyester resin represented by the above general formula (1-1) as the binding resin were mixed and dispersed, together with 120 parts by weight of tetrahydrofuran, by using a ball mill to prepare a coating solution for electric charge generating layer. Then, this coating solution was applied on the above electric charge transferring layer by a dip coating method, followed by hot-air drying at 90° C. for 60 minutes to form an electric charge generating layer having a thickness of 10 μm, thereby producing a positive charging type multi-layer photosensitive material for digital light source, respectively.

When using a mixture of the polyester resin and polycarbonate resin as the binding resin, 0.7 parts by weight of the polyester resin and 0.3 parts by weight of the polycarbonate resin were used in combination.

Comparative Example 7

According to the same manner as that described in Example 796 except for using 90 parts by weight of the polycarbonate resin having a repeating unit of the above formula (A-4) as the binding resin of the electric charge transferring material, a positive charging type multi-layer photosensitive material for digital light source was produced.

Comparative Example 8

According to the same manner as that described in Examples 796 except for using the compound represented by the above formula (HT14-1) as the hole transferring material, a positive charging type multi-layer photosensitive material for digital light source was produced.

The resulting electrophotosensitive materials of the respective Examples and Comparative Examples were subjected to the photosensitivity test and wear resistance test according to the above evaluation method of the positive charging type photosensitive material for digital light source.

The test results are shown in Tables 39 and 40, together with the above-described compound No. of the binding resin and the hole transferring material (HTM) used.

TABLE 39

| Ex. | Binding resin Main | Blend | HTM | VL (V) | Wear (μm) |
|---|---|---|---|---|---|
| 796 | 1-1 | — | HT1-1 | 126 | 2.6 |
| 797 | 1-1 | — | HT2-1 | 130 | 2.5 |
| 798 | 1-1 | — | HT3-1 | 130 | 2.5 |
| 799 | 1-1 | A-1 | HT1-1 | 125 | 2.6 |
| 800 | 1-2 | — | HT1-1 | 128 | 2.3 |
| 801 | 1-2 | — | HT2-1 | 136 | 2.3 |
| 802 | 1-2 | — | HT3-1 | 131 | 2.3 |
| 803 | 1-2 | A-1 | HT1-1 | 130 | 3.0 |
| 804 | 1-3 | — | HT1-1 | 121 | 2.1 |
| 805 | 1-3 | — | HT2-1 | 128 | 2.4 |
| 806 | 1-3 | — | HT3-1 | 124 | 2.2 |
| 807 | 1-3 | A-1 | HT1-1 | 125 | 2.5 |
| 808 | 2-1 | — | HT1-1 | 132 | 1.4 |
| 809 | 2-1 | — | HT2-1 | 130 | 1.6 |
| 810 | 2-1 | — | HT3-1 | 129 | 1.7 |
| 811 | 2-1 | A-1 | HT1-1 | 128 | 1.6 |
| 812 | 2-2 | — | HT1-1 | 132 | 1.5 |
| 813 | 2-2 | — | HT2-1 | 130 | 1.6 |
| 814 | 2-2 | — | HT3-1 | 130 | 2.0 |
| 815 | 2-2 | A-1 | HT1-1 | 126 | 1.7 |
| 816 | 2-3 | — | HT1-1 | 125 | 1.4 |
| 817 | 2-3 | — | HT2-1 | 124 | 1.7 |
| 818 | 2-3 | — | HT3-1 | 126 | 1.6 |
| 819 | 2-3 | A-1 | HT1-1 | 130 | 1.9 |
| 820 | 3-1 | — | HT1-1 | 104 | 2.4 |
| 821 | 3-1 | — | HT2-1 | 109 | 1.9 |
| 822 | 3-1 | — | HT3-1 | 108 | 2.3 |
| 823 | 3-1 | A-1 | HT1-1 | 100 | 2.3 |

TABLE 40

| Ex. | Binding resin Main | Blend | HTM | VL (V) | Wear (μm) |
|---|---|---|---|---|---|
| 824 | 3-2 | — | HT1-1 | 114 | 2.2 |
| 825 | 3-2 | — | HT2-1 | 111 | 2.4 |
| 826 | 3-2 | — | HT3-1 | 109 | 2.6 |
| 827 | 3-2 | A-1 | HT1-1 | 110 | 3.0 |
| 828 | 3-3 | — | HT1-1 | 109 | 2.4 |
| 829 | 3-3 | — | HT2-1 | 108 | 2.9 |
| 830 | 3-3 | — | HT3-1 | 114 | 2.9 |
| 831 | 3-3 | A-1 | HT1-1 | 112 | 2.4 |
| Comp. Ex. 7 | A-4 | — | HT1-1 | 160 | 6.6 |
| Comp. Ex. 8 | 1-1 | — | HT14-1 | 211 | 2.5 |

Examples 832 to 867

[Multi-layer photosensitive material for analog light source (negative charging type)]

According to the same manner as that described in Examples 760 to 795 except for using 2 parts by weight of the pigment represented by the above formula (CG2) as the electric charge generating material, a negative charging type multi-layer photosensitive material for analog light source was obtained, respectively.

Comparative Example 9

According to the same manner as that described in Example 832 except for using 90 parts by weight of the polycarbonate resin having a repeating unit of the above formula (A-4) as the binding resin of the electric charge transferring material, a negative charging type multi-layer photosensitive material for analog light source was produced.

Comparative Example 10

According to the same manner as that described in Examples 832 except for using the compound represented by the above formula (HT14-1) as the hole transferring material, a negative charging type multi-layer photosensitive material for analog light source was produced.

The resulting electrophotosensitive materials of the respective Examples and Comparative Examples were subjected to the following tests and their characteristics were evaluated.

<Evaluation of negative charging photosensitive material for analog light source>

Photosensitivity test

By using a drum sensitivity tester manufactured by GENTEC Co., a voltage was applied on the surface of a photosensitive material obtained in the respective Examples and Comparative Examples to charge the surface at −700 V, respectively. Then, white light (light intensity: 147 lux second) from a halogen lamp as an exposure light source was irradiated on the surface of the photosensitive material (irradiation time: 50 msec.). Furthermore, a surface potential at the time at which 330 msec. has passed since the beginning of exposure was measured as a potential after exposure $V_L$ (V).

Wear resistance test

A photosensitive material obtained in the respective Examples and Comparative Examples was fit with an electrostatic copying machine modified for negative charging specification (Model DC-2556, manufactured by Mita Industrial Co., Ltd.) and, after rotating 150,000 times without passing a paper through it, a change in thickness of a photosensitive layer before and after rotation was determined, respectively.

These test results are shown in Tables 41 and 42, together with the above-described compound No. of the binding resin and the hole transferring material (HTM) used.

TABLE 41

| Ex. | Binding resin Main | Blend | HTM | VL (V) | Wear (μm) |
|---|---|---|---|---|---|
| 832 | 1-1 | — | HT1-1 | −94 | 1.9 |
| 833 | 1-1 | — | HT2-1 | −99 | 2.4 |
| 834 | 1-1 | — | HT3-1 | −101 | 2.2 |
| 835 | 1-1 | A-1 | HT1-1 | −93 | 1.5 |
| 836 | 1-2 | — | HT1-1 | −100 | 1.7 |
| 837 | 1-2 | — | HT2-1 | −106 | 1.9 |
| 838 | 1-2 | — | HT3-1 | −98 | 2.0 |
| 839 | 1-2 | A-1 | HT1-1 | −96 | 1.9 |
| 840 | 1-3 | — | HT1-1 | −93 | 2.1 |
| 841 | 1-3 | — | HT2-1 | −92 | 2.4 |
| 842 | 1-3 | — | HT3-1 | −99 | 2.2 |
| 843 | 1-3 | A-1 | HT1-1 | −94 | 1.9 |
| 844 | 2-1 | — | HT1-1 | −96 | 1.2 |
| 845 | 2-1 | — | HT2-1 | −101 | 1.2 |
| 846 | 2-1 | — | HT3-1 | −100 | 1.1 |
| 847 | 2-1 | A-1 | HT1-1 | −95 | 1.1 |
| 848 | 2-2 | — | HT1-1 | −93 | 1.6 |
| 849 | 2-2 | — | HT2-1 | −96 | 1.0 |
| 850 | 2-2 | — | HT3-1 | −92 | 1.3 |
| 851 | 2-2 | A-1 | HT1-1 | −91 | 1.5 |
| 852 | 2-3 | — | HT1-1 | −90 | 1.6 |
| 853 | 2-3 | — | HT2-1 | −89 | 1.5 |
| 854 | 2-3 | — | HT3-1 | −91 | 1.4 |
| 855 | 2-3 | A-1 | HT1-1 | −90 | 1.7 |
| 856 | 3-1 | — | HT1-1 | −89 | 1.9 |
| 857 | 3-1 | — | HT2-1 | −88 | 2.2 |
| 858 | 3-1 | — | HT3-1 | −86 | 2.6 |
| 859 | 3-1 | A-1 | HT1-1 | −84 | 2.4 |

TABLE 42

| Ex. | Binding resin Main | Blend | HTM | VL (V) | Wear (μm) |
|---|---|---|---|---|---|
| 860 | 3-2 | — | HT1-1 | −81 | 2.2 |
| 861 | 3-2 | — | HT2-1 | −86 | 2.4 |
| 862 | 3-2 | — | HT3-1 | −89 | 2.2 |
| 863 | 3-2 | A-1 | HT1-1 | −83 | 2.1 |
| 864 | 3-3 | — | HT1-1 | −85 | 2.4 |
| 865 | 3-3 | — | HT2-1 | −90 | 2.3 |
| 866 | 3-3 | — | HT3-1 | −86 | 2.2 |
| 867 | 3-3 | A-1 | HT1-1 | −86 | 2.1 |
| Comp. Ex. 9 | A-4 | — | HT1-1 | −139 | 5.6 |
| Comp. Ex. 10 | 1-1 | — | HT14-1 | −172 | 2.0 |

Examples 868 to 903

[Multi-layer photosensitive material for analog light source (positive charging type)]

According to the same manner as that described in Examples 796 to 831 except for using 2 parts by weight of the pigment represented by the above formula (CG2) as the electric charge generating material, a positive charging type multi-layer photosensitive material for analog light source was obtained, respectively.

Comparative Example 11

According to the same manner as that described in Example 868 except for using 90 parts by weight of the polycarbonate resin having a repeating unit of the above formula (A-4) as the binding resin of the electric charge transferring material, a positive-charging type multi-layer photosensitive material for analog light source was produced.

Comparative Example 12

According to the same manner as that described in Examples 868 except for using the compound represented by the above formula (HT14-1) as the hole transferring material, a positive-charging type multi-layer photosensitive material for analog light source was produced.

The resulting electrophotosensitive materials of the respective Examples and Comparative Examples were subjected to the photosensitivity test and wear resistance test according to the above evaluation method of the positive charging type photosensitive material for analog light source.

The test results are shown in Tables 43 and 44, together with the above-described compound No. of the binding resin and the hole transferring material (HTM) used.

TABLE 43

| Ex. | Binding resin Main | Blend | HTM | VL (V) | Wear (μm) |
|---|---|---|---|---|---|
| 868 | 1-1 | — | HT1-1 | 131 | 2.1 |
| 869 | 1-1 | — | HT2-1 | 138 | 2.0 |
| 870 | 1-1 | — | HT3-1 | 142 | 1.9 |
| 871 | 1-1 | A-1 | HT1-1 | 140 | 2.2 |
| 872 | 1-2 | — | HT1-1 | 120 | 2.1 |
| 873 | 1-2 | — | HT2-1 | 129 | 2.2 |
| 874 | 1-2 | — | HT3-1 | 126 | 2.2 |
| 875 | 1-2 | A-1 | HT1-1 | 124 | 2.5 |
| 876 | 1-3 | — | HT1-1 | 126 | 2.4 |
| 877 | 1-3 | — | HT2-1 | 121 | 2.3 |

TABLE 43-continued

| Ex. | Binding resin Main | Blend | HTM | VL (V) | Wear (μm) |
|---|---|---|---|---|---|
| 878 | 1-3 | — | HT3-1 | 127 | 2.2 |
| 879 | 1-3 | A-1 | HT1-1 | 124 | 2.2 |
| 880 | 2-1 | — | HT1-1 | 123 | 1.4 |
| 881 | 2-1 | — | HT2-1 | 129 | 1.4 |
| 882 | 2-1 | — | HT3-1 | 126 | 1.3 |
| 883 | 2-1 | A-1 | HT1-1 | 123 | 1.2 |
| 884 | 2-2 | — | HT1-1 | 128 | 1.4 |
| 885 | 2-2 | — | HT2-1 | 126 | 1.4 |
| 886 | 2-2 | — | HT3-1 | 122 | 1.4 |
| 887 | 2-2 | A-1 | HT1-1 | 130 | 1.5 |
| 888 | 2-3 | — | HT1-1 | 121 | 1.6 |
| 889 | 2-3 | — | HT2-1 | 120 | 1.5 |
| 890 | 2-3 | — | HT3-1 | 129 | 1.9 |
| 891 | 2-3 | A-1 | HT1-1 | 120 | 1.5 |
| 892 | 3-1 | — | HT1-1 | 111 | 2.2 |
| 893 | 3-1 | — | HT2-1 | 106 | 2.2 |
| 894 | 3-1 | — | HT3-1 | 114 | 2.4 |
| 895 | 3-1 | A-1 | HT1-1 | 108 | 2.4 |

TABLE 44

| Ex. | Binding resin Main | Blend | HTM | VL (V) | Wear (μm) |
|---|---|---|---|---|---|
| 896 | 3-2 | — | HT1-1 | 110 | 2.1 |
| 897 | 3-2 | — | HT2-1 | 111 | 2.6 |
| 898 | 3-2 | — | HT3-1 | 105 | 2.4 |
| 899 | 3-2 | A-1 | HT1-1 | 108 | 2.3 |
| 900 | 3-3 | — | HT1-1 | 108 | 2.3 |
| 901 | 3-3 | — | HT2-1 | 107 | 2.4 |
| 902 | 3-3 | — | HT3-1 | 106 | 2.2 |
| 903 | 3-3 | A-1 | HT1-1 | 105 | 2.3 |
| Comp. Ex. 11 | A-4 | — | HT1-1 | 180 | 5.9 |
| Comp. Ex. 12 | 1-1 | — | HT14-1 | 224 | 2.7 |

Examples 904 to 1182

[Single-layer photosensitive material for digital light source (positive charging type)]

The metal-free phthalocyanine pigment represented by the above general formula (CG1) and benzidine derivative represented by the above general formula (HT1-1) were used as the electric charge generating material and hole transferring material, respectively. In addition, the compound represented by any one of the above formulas (ET1) to (ET14) was used as the electron transferring material, respectively. Furthermore, any one of the polyester resins (1-1) to (1-3), (2-1) to (2-3) and (3-1) to (3-3) obtained in Reference Examples 1 to 9, or a mixture of this polyester resin and a polycarbonate resin was used as the binding resin. Furthermore, tetrahydrofuran was used as the solvent in which these components are dissolved.

The electron transferring material (ETM) and binding resin used were shown using the above compound number.

The amount of the respective materials to be blended is as follows:

| Components | Amount (parts by weight) |
|---|---|
| Electric charge generating material | 5 |
| Electron transferring material | 30 |
| Hole transferring material | 50 |

-continued

| Components | Amount (parts by weight) |
|---|---|
| Binding resin | 90 |
| Solvent | 800 |

When the binding resin is the above mixture, the mixing proportion of the polyester resin to polycarbonate was 70 parts by weight: 20 parts by weight.

The above respective components were mixed and dispersed for 50 hours with a ball mill to prepare a coating solution for single-layer type photosensitive layer. Then, this coating solution was applied on an aluminum tube by a dip coating method, followed by hot-air drying at 100° C. for 60 minutes to give a single-layer type photosensitive material for digital light source, which has a single-layer type photosensitive layer of 15 to 20 μm in thickness, respectively.

Comparative Example 13

According to the same manner as that described in Example 1 except for using a compound represented by the following formula (ET15-1) as the electron transferring material, a single-layer photosensitive material was produced.

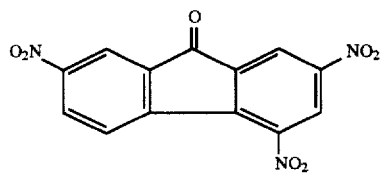

(ET15-1)

The resulting electrophotosensitive materials of the respective Examples and Comparative Examples were subjected to the photosensitivity test, wear resistance test and adhesion test according to the same manner as that described in Examples 1 to 387, and their characteristics were evaluated.

These test results are shown in Tables 45 to 53, together with the above-described compound No. of the binding resin and electron transferring material (ETM) used.

In Tables 45 to 53, the results of Examples 1, 44, 87, 130, 173, 216, 259, 302 and 345 as well as Comparative Example 1 are also shown.

TABLE 45

| | Binding resin | | | VL | Wear | Adhesion |
|---|---|---|---|---|---|---|
| Ex. | Main | Blend | ETM | (V) | (μm) | (%) |
| 1 | 1-1 | — | ET1-1 | 128 | 2.3 | 100 |
| 904 | 1-1 | — | ET1-2 | 132 | 2.1 | 100 |
| 905 | 1-1 | — | ET2-1 | 114 | 2.3 | 100 |
| 906 | 1-1 | — | ET2-2 | 110 | 2.9 | 100 |
| 907 | 1-1 | — | ET2-3 | 120 | 2.9 | 100 |
| 908 | 1-1 | — | ET2-4 | 108 | 2.7 | 100 |
| 909 | 1-1 | — | ET2-5 | 111 | 2.6 | 100 |
| 910 | 1-1 | — | ET2-6 | 110 | 2.1 | 100 |
| 911 | 1-1 | — | ET2-7 | 112 | 2.4 | 100 |
| 912 | 1-1 | — | ET3-1 | 109 | 3.0 | 100 |
| 913 | 1-1 | — | ET3-2 | 105 | 2.6 | 100 |
| 914 | 1-1 | — | ET3-3 | 100 | 2.0 | 100 |
| 915 | 1-1 | — | ET3-4 | 106 | 2.2 | 100 |
| 916 | 1-1 | — | ET3-5 | 105 | 2.0 | 100 |
| 917 | 1-1 | — | ET4-1 | 111 | 2.5 | 100 |
| 918 | 1-1 | — | ET4-2 | 103 | 2.3 | 100 |
| 919 | 1-1 | — | ET5-1 | 101 | 2.8 | 100 |
| 920 | 1-1 | — | ET5-2 | 100 | 3.2 | 100 |

TABLE 45-continued

| | Binding resin | | | VL | Wear | Adhesion |
|---|---|---|---|---|---|---|
| Ex. | Main | Blend | ETM | (V) | (μm) | (%) |
| 921 | 1-1 | — | ET6-1 | 106 | 2.5 | 100 |
| 922 | 1-1 | — | ET6-2 | 114 | 2.1 | 100 |
| 923 | 1-1 | — | ET7-1 | 120 | 2.7 | 100 |
| 924 | 1-1 | — | ET7-2 | 121 | 2.2 | 100 |
| 925 | 1-1 | — | ET8-1 | 133 | 2.2 | 100 |
| 926 | 1-1 | — | ET8-2 | 135 | 3.1 | 100 |
| 927 | 1-1 | — | ET8-3 | 131 | 2.9 | 100 |
| 928 | 1-1 | — | ET9-1 | 130 | 2.1 | 100 |
| 929 | 1-1 | — | ET10-1 | 129 | 2.7 | 100 |
| 930 | 1-1 | — | ET11-1 | 136 | 2.7 | 100 |
| 931 | 1-1 | — | ET12-1 | 136 | 2.5 | 100 |
| 932 | 1-1 | — | ET13-1 | 129 | 3.1 | 100 |
| 933 | 1-1 | — | ET14-1 | 130 | 3.0 | 100 |
| 934 | 1-1 | A-1 | ET3-4 | 106 | 2.8 | 100 |

TABLE 46

| | Binding resin | | | VL | Wear | Adhesion |
|---|---|---|---|---|---|---|
| Ex. | Main | Blend | ETM | (V) | (μm) | (%) |
| 44 | 1-2 | — | ET1-1 | 130 | 2.9 | 100 |
| 935 | 1-2 | — | ET1-2 | 136 | 3.0 | 100 |
| 936 | 1-2 | — | ET2-1 | 111 | 2.3 | 100 |
| 937 | 1-2 | — | ET2-2 | 120 | 2.6 | 100 |
| 938 | 1-2 | — | ET2-3 | 108 | 3.1 | 100 |
| 939 | 1-2 | — | ET2-4 | 106 | 2.1 | 100 |
| 940 | 1-2 | — | ET2-5 | 105 | 2.4 | 100 |
| 941 | 1-2 | — | ET2-6 | 112 | 2.4 | 100 |
| 942 | 1-2 | — | ET2-7 | 113 | 2.4 | 100 |
| 943 | 1-2 | — | ET3-1 | 114 | 2.7 | 100 |
| 944 | 1-2 | — | ET3-2 | 104 | 2.5 | 100 |
| 945 | 1-2 | — | ET3-3 | 118 | 2.8 | 100 |
| 946 | 1-2 | — | ET3-4 | 110 | 2.8 | 100 |
| 947 | 1-2 | — | ET3-5 | 106 | 3.1 | 100 |
| 948 | 1-2 | — | ET4-1 | 104 | 3.3 | 100 |
| 949 | 1-2 | — | ET4-2 | 103 | 2.3 | 100 |
| 950 | 1-2 | — | ET5-1 | 102 | 3.1 | 100 |
| 951 | 1-2 | — | ET5-2 | 116 | 3.0 | 100 |
| 952 | 1-2 | — | ET6-1 | 117 | 2.0 | 100 |
| 953 | 1-2 | — | ET6-2 | 112 | 2.7 | 100 |
| 954 | 1-2 | — | ET7-1 | 120 | 2.7 | 100 |
| 955 | 1-2 | — | ET7-2 | 121 | 2.9 | 100 |
| 956 | 1-2 | — | ET8-1 | 130 | 3.1 | 100 |
| 957 | 1-2 | — | ET8-2 | 134 | 3.2 | 100 |
| 958 | 1-2 | — | ET8-3 | 136 | 2.8 | 100 |
| 959 | 1-2 | — | ET9-1 | 130 | 2.4 | 100 |
| 960 | 1-2 | — | ET10-1 | 133 | 3.2 | 100 |
| 961 | 1-2 | — | ET11-1 | 132 | 2.9 | 100 |
| 962 | 1-2 | — | ET12-1 | 132 | 2.4 | 100 |
| 963 | 1-2 | — | ET13-1 | 136 | 2.4 | 100 |
| 964 | 1-2 | — | ET14-1 | 130 | 3.0 | 100 |
| 965 | 1-2 | A-1 | ET3-4 | 110 | 3.1 | 100 |

TABLE 47

| | Binding resin | | | VL | Wear | Adhesion |
|---|---|---|---|---|---|---|
| Ex. | Main | Blend | ETM | (V) | (μm) | (%) |
| 87 | 1-3 | — | ET1-1 | 132 | 2.4 | 100 |
| 966 | 1-3 | — | ET1-2 | 139 | 2.8 | 100 |
| 967 | 1-3 | — | ET2-1 | 114 | 2.3 | 100 |
| 968 | 1-3 | — | ET2-2 | 109 | 2.6 | 100 |
| 969 | 1-3 | — | ET2-3 | 113 | 3.1 | 100 |
| 970 | 1-3 | — | ET2-4 | 112 | 3.3 | 100 |
| 971 | 1-3 | — | ET2-5 | 118 | 2.1 | 100 |
| 972 | 1-3 | — | ET2-6 | 110 | 3.0 | 100 |
| 973 | 1-3 | — | ET2-7 | 111 | 2.5 | 100 |
| 974 | 1-3 | — | ET3-1 | 104 | 2.5 | 100 |

TABLE 47-continued

| Ex. | Binding resin Main | Blend | ETM | VL (V) | Wear (μm) | Adhesion (%) |
|---|---|---|---|---|---|---|
| 975 | 1-3 | — | ET3-2 | 106 | 2.7 | 100 |
| 976 | 1-3 | — | ET3-3 | 108 | 2.5 | 100 |
| 977 | 1-3 | — | ET3-4 | 110 | 2.7 | 100 |
| 978 | 1-3 | — | ET3-5 | 111 | 2.2 | 100 |
| 979 | 1-3 | — | ET4-1 | 114 | 3.0 | 100 |
| 980 | 1-3 | — | ET4-2 | 113 | 2.8 | 100 |
| 981 | 1-3 | — | ET5-1 | 120 | 3.3 | 100 |
| 982 | 1-3 | — | ET5-2 | 109 | 2.7 | 100 |
| 983 | 1-3 | — | ET6-1 | 111 | 2.3 | 100 |
| 984 | 1-3 | — | ET6-2 | 119 | 2.3 | 100 |
| 985 | 1-3 | — | ET7-1 | 121 | 3.1 | 100 |
| 986 | 1-3 | — | ET7-2 | 120 | 2.1 | 100 |
| 987 | 1-3 | — | ET8-1 | 139 | 2.0 | 100 |
| 988 | 1-3 | — | ET8-2 | 140 | 2.9 | 100 |
| 989 | 1-3 | — | ET8-3 | 131 | 2.4 | 100 |
| 990 | 1-3 | — | ET9-1 | 132 | 2.4 | 100 |
| 991 | 1-3 | — | ET10-1 | 130 | 3.2 | 100 |
| 992 | 1-3 | — | ET11-1 | 129 | 2.5 | 100 |
| 993 | 1-3 | — | ET12-1 | 114 | 2.8 | 100 |
| 994 | 1-3 | — | ET13-1 | 113 | 2.1 | 100 |
| 995 | 1-3 | — | ET14-1 | 122 | 2.6 | 100 |
| 996 | 1-3 | A-1 | ET3-4 | 110 | 2.6 | 100 |

TABLE 48

| Ex. | Binding resin Main | Blend | ETM | VL (V) | Wear (μm) | Adhesion (%) |
|---|---|---|---|---|---|---|
| 130 | 2-1 | — | ET1-1 | 129 | 2.0 | 100 |
| 997 | 2-1 | — | ET1-2 | 139 | 1.4 | 100 |
| 998 | 2-1 | — | ET2-1 | 114 | 1.8 | 100 |
| 999 | 2-1 | — | ET2-2 | 105 | 1.6 | 100 |
| 1000 | 2-1 | — | ET2-3 | 110 | 1.2 | 100 |
| 1001 | 2-1 | — | ET2-4 | 106 | 2.1 | 100 |
| 1002 | 2-1 | — | ET2-5 | 101 | 1.5 | 100 |
| 1003 | 2-1 | — | ET2-6 | 106 | 1.6 | 100 |
| 1004 | 2-1 | — | ET2-7 | 111 | 2.2 | 100 |
| 1005 | 2-1 | — | ET3-1 | 110 | 1.5 | 100 |
| 1006 | 2-1 | — | ET3-2 | 114 | 1.3 | 100 |
| 1007 | 2-1 | — | ET3-3 | 100 | 2.0 | 100 |
| 1008 | 2-1 | — | ET3-4 | 104 | 1.5 | 100 |
| 1009 | 2-1 | — | ET3-5 | 102 | 1.9 | 100 |
| 1010 | 2-1 | — | ET4-1 | 101 | 1.3 | 100 |
| 1011 | 2-1 | — | ET4-2 | 108 | 1.2 | 100 |
| 1012 | 2-1 | — | ET5-1 | 119 | 1.9 | 100 |
| 1013 | 2-1 | — | ET5-2 | 120 | 2.0 | 100 |
| 1014 | 2-1 | — | ET6-1 | 109 | 1.3 | 100 |
| 1015 | 2-1 | — | ET6-2 | 111 | 1.6 | 100 |
| 1016 | 2-1 | — | ET7-1 | 119 | 1.6 | 100 |
| 1017 | 2-1 | — | ET7-2 | 121 | 1.7 | 100 |
| 1018 | 2-1 | — | ET8-1 | 136 | 1.4 | 100 |
| 1019 | 2-1 | — | ET8-2 | 140 | 1.7 | 100 |
| 1020 | 2-1 | — | ET8-3 | 139 | 2.1 | 100 |
| 1021 | 2-1 | — | ET9-1 | 132 | 1.9 | 100 |
| 1022 | 2-1 | — | ET10-1 | 133 | 1.9 | 100 |
| 1023 | 2-1 | — | ET11-1 | 140 | 2.2 | 100 |
| 1024 | 2-1 | — | ET12-1 | 138 | 1.3 | 100 |
| 1025 | 2-1 | — | ET13-1 | 141 | 2.0 | 100 |
| 1026 | 2-1 | — | ET14-1 | 136 | 2.0 | 100 |
| 1027 | 2-1 | A-1 | ET3-4 | 111 | 1.8 | 100 |

TABLE 49

| Ex. | Binding resin Main | Blend | ETM | VL (V) | Wear (μm) | Adhesion (%) |
|---|---|---|---|---|---|---|
| 173 | 2-2 | — | ET1-1 | 129 | 1.7 | 100 |
| 1028 | 2-2 | — | ET1-2 | 140 | 1.3 | 100 |

TABLE 49-continued

| Ex. | Binding resin Main | Blend | ETM | VL (V) | Wear (μm) | Adhesion (%) |
|---|---|---|---|---|---|---|
| 1029 | 2-2 | — | ET2-1 | 114 | 1.8 | 100 |
| 1030 | 2-2 | — | ET2-2 | 106 | 1.8 | 100 |
| 1031 | 2-2 | — | ET2-3 | 109 | 1.8 | 100 |
| 1032 | 2-2 | — | ET2-4 | 111 | 1.4 | 100 |
| 1033 | 2-2 | — | ET2-5 | 119 | 2.0 | 100 |
| 1034 | 2-2 | — | ET2-6 | 114 | 1.5 | 100 |
| 1035 | 2-2 | — | ET2-7 | 116 | 2.1 | 100 |
| 1036 | 2-2 | — | ET3-1 | 119 | 1.2 | 100 |
| 1037 | 2-2 | — | ET3-2 | 120 | 1.7 | 100 |
| 1038 | 2-2 | — | ET3-3 | 116 | 1.9 | 100 |
| 1039 | 2-2 | — | ET3-4 | 117 | 1.4 | 100 |
| 1040 | 2-2 | — | ET3-5 | 109 | 1.6 | 100 |
| 1041 | 2-2 | — | ET4-1 | 112 | 2.0 | 100 |
| 1042 | 2-2 | — | ET4-2 | 116 | 1.2 | 100 |
| 1043 | 2-2 | — | ET5-1 | 115 | 1.7 | 100 |
| 1044 | 2-2 | — | ET5-2 | 113 | 1.7 | 100 |
| 1045 | 2-2 | — | ET6-1 | 120 | 1.5 | 100 |
| 1046 | 2-2 | — | ET6-2 | 119 | 2.0 | 100 |
| 1047 | 2-2 | — | ET7-1 | 109 | 1.5 | 100 |
| 1048 | 2-2 | — | ET7-2 | 111 | 1.9 | 100 |
| 1049 | 2-2 | — | ET8-1 | 130 | 1.8 | 100 |
| 1050 | 2-2 | — | ET8-2 | 139 | 1.5 | 100 |
| 1051 | 2-2 | — | ET8-3 | 134 | 1.5 | 100 |
| 1052 | 2-2 | — | ET9-1 | 140 | 1.5 | 100 |
| 1053 | 2-2 | — | ET10-1 | 141 | 1.6 | 100 |
| 1054 | 2-2 | — | ET11-1 | 136 | 1.3 | 100 |
| 1055 | 2-2 | — | ET12-1 | 136 | 1.3 | 100 |
| 1056 | 2-2 | — | ET13-1 | 135 | 1.7 | 100 |
| 1057 | 2-2 | — | ET14-1 | 130 | 1.7 | 100 |
| 1058 | 2-2 | A-1 | ET3-4 | 120 | 1.7 | 100 |

TABLE 50

| Ex. | Binding resin Main | Blend | ETM | VL (V) | Wear (μm) | Adhesion (%) |
|---|---|---|---|---|---|---|
| 216 | 2-3 | — | ET1-1 | 128 | 2.3 | 100 |
| 1059 | 2-3 | — | ET1-2 | 134 | 1.4 | 100 |
| 1060 | 2-3 | — | ET2-1 | 111 | 1.7 | 100 |
| 1061 | 2-3 | — | ET2-2 | 109 | 1.6 | 100 |
| 1062 | 2-3 | — | ET2-3 | 114 | 1.7 | 100 |
| 1063 | 2-3 | — | ET2-4 | 112 | 1.7 | 100 |
| 1064 | 2-3 | — | ET2-5 | 107 | 1.7 | 100 |
| 1065 | 2-3 | — | ET2-6 | 109 | 1.3 | 100 |
| 1066 | 2-3 | — | ET2-7 | 111 | 1.6 | 100 |
| 1067 | 2-3 | — | ET3-1 | 114 | 1.6 | 100 |
| 1068 | 2-3 | — | ET3-2 | 113 | 1.5 | 100 |
| 1069 | 2-3 | — | ET3-3 | 113 | 1.8 | 100 |
| 1070 | 2-3 | — | ET3-4 | 112 | 1.2 | 100 |
| 1071 | 2-3 | — | ET3-5 | 109 | 1.9 | 100 |
| 1072 | 2-3 | — | ET4-1 | 110 | 2.0 | 100 |
| 1073 | 2-3 | — | ET4-2 | 108 | 2.2 | 100 |
| 1074 | 2-3 | — | ET5-1 | 118 | 1.4 | 100 |
| 1075 | 2-3 | — | ET5-2 | 117 | 2.0 | 100 |
| 1076 | 2-3 | — | ET6-1 | 110 | 1.5 | 100 |
| 1077 | 2-3 | — | ET6-2 | 111 | 1.5 | 100 |
| 1078 | 2-3 | — | ET7-1 | 121 | 1.8 | 100 |
| 1079 | 2-3 | — | ET7-2 | 120 | 1.2 | 100 |
| 1080 | 2-3 | — | ET8-1 | 141 | 1.8 | 100 |
| 1081 | 2-3 | — | ET8-2 | 142 | 2.1 | 100 |
| 1082 | 2-3 | — | ET8-3 | 138 | 1.3 | 100 |
| 1083 | 2-3 | — | ET9-1 | 137 | 1.3 | 100 |
| 1084 | 2-3 | — | ET10-1 | 130 | 2.0 | 100 |
| 1085 | 2-3 | — | ET11-1 | 129 | 1.5 | 100 |
| 1086 | 2-3 | — | ET12-1 | 136 | 2.0 | 100 |
| 1087 | 2-3 | — | ET13-1 | 135 | 1.2 | 100 |
| 1088 | 2-3 | — | ET14-1 | 140 | 1.5 | 100 |
| 1089 | 2-3 | A-1 | ET3-4 | 120 | 1.8 | 100 |

TABLE 51

| Ex. | Binding resin Main | Blend | ETM | VL (V) | Wear (μm) | Adhesion (%) |
|---|---|---|---|---|---|---|
| 259 | 3-1 | — | ET1-1 | 120 | 2.0 | 100 |
| 1090 | 3-1 | — | ET1-2 | 126 | 2.1 | 100 |
| 1091 | 3-1 | — | ET2-1 | 98 | 2.3 | 100 |
| 1092 | 3-1 | — | ET2-2 | 100 | 2.2 | 100 |
| 1093 | 3-1 | — | ET2-3 | 101 | 2.2 | 100 |
| 1094 | 3-1 | — | ET2-4 | 94 | 2.2 | 100 |
| 1095 | 3-1 | — | ET2-5 | 95 | 2.2 | 100 |
| 1096 | 3-1 | — | ET2-6 | 108 | 3.1 | 100 |
| 1097 | 3-1 | — | ET2-7 | 101 | 3.2 | 100 |
| 1098 | 3-1 | — | ET3-1 | 102 | 2.8 | 100 |
| 1099 | 3-1 | — | ET3-2 | 99 | 2.8 | 100 |
| 1100 | 3-1 | — | ET3-3 | 94 | 2.7 | 100 |
| 1101 | 3-1 | — | ET3-4 | 104 | 2.9 | 100 |
| 1102 | 3-1 | — | ET3-5 | 103 | 3.2 | 100 |
| 1103 | 3-1 | — | ET4-1 | 102 | 2.9 | 100 |
| 1104 | 3-1 | — | ET4-2 | 100 | 2.1 | 100 |
| 1105 | 3-1 | — | ET5-1 | 104 | 2.3 | 100 |
| 1106 | 3-1 | — | ET5-2 | 103 | 3.2 | 100 |
| 1107 | 3-1 | — | ET6-1 | 110 | 3.3 | 100 |
| 1108 | 3-1 | — | ET6-2 | 111 | 2.7 | 100 |
| 1109 | 3-1 | — | ET7-1 | 114 | 2.9 | 100 |
| 1110 | 3-1 | — | ET7-2 | 112 | 3.0 | 100 |
| 1111 | 3-1 | — | ET8-1 | 125 | 2.8 | 100 |
| 1112 | 3-1 | — | ET8-2 | 130 | 2.1 | 100 |
| 1113 | 3-1 | — | ET8-3 | 131 | 2.3 | 100 |
| 1114 | 3-1 | — | ET9-1 | 130 | 2.3 | 100 |
| 1115 | 3-1 | — | ET10-1 | 125 | 2.4 | 100 |
| 1116 | 3-1 | — | ET11-1 | 126 | 2.8 | 100 |
| 1117 | 3-1 | — | ET12-1 | 127 | 2.4 | 100 |
| 1118 | 3-1 | — | ET13-1 | 136 | 2.4 | 100 |
| 1119 | 3-1 | — | ET14-1 | 141 | 3.0 | 100 |
| 1120 | 3-1 | A-1 | ET3-4 | 110 | 3.1 | 100 |

TABLE 52

| Ex. | Binding resin Main | Blend | ETM | VL (V) | Wear (μm) | Adhesion (%) |
|---|---|---|---|---|---|---|
| 302 | 3-2 | — | ET1-1 | 121 | 2.6 | 100 |
| 1121 | 3-2 | — | ET1-2 | 128 | 2.3 | 100 |
| 1122 | 3-2 | — | ET2-1 | 104 | 2.4 | 100 |
| 1123 | 3-2 | — | ET2-2 | 110 | 2.8 | 100 |
| 1124 | 3-2 | — | ET2-3 | 101 | 3.1 | 100 |
| 1125 | 3-2 | — | ET2-4 | 100 | 2.6 | 100 |
| 1126 | 3-2 | — | ET2-5 | 96 | 2.7 | 100 |
| 1127 | 3-2 | — | ET2-6 | 92 | 3.1 | 100 |
| 1128 | 3-2 | — | ET2-7 | 101 | 3.3 | 100 |
| 1129 | 3-2 | — | ET3-1 | 106 | 3.2 | 100 |
| 1130 | 3-2 | — | ET3-2 | 103 | 2.9 | 100 |
| 1131 | 3-2 | — | ET3-3 | 94 | 2.8 | 100 |
| 1132 | 3-2 | — | ET3-4 | 98 | 3.3 | 100 |
| 1133 | 3-2 | — | ET3-5 | 101 | 2.7 | 100 |
| 1134 | 3-2 | — | ET4-1 | 102 | 2.0 | 100 |
| 1135 | 3-2 | — | ET4-2 | 104 | 2.0 | 100 |
| 1136 | 3-2 | — | ET5-1 | 100 | 2.8 | 100 |
| 1137 | 3-2 | — | ET5-2 | 110 | 2.9 | 100 |
| 1138 | 3-2 | — | ET6-1 | 111 | 3.1 | 100 |
| 1139 | 3-2 | — | ET6-2 | 114 | 3.1 | 100 |
| 1140 | 3-2 | — | ET7-1 | 119 | 2.8 | 100 |
| 1141 | 3-2 | — | ET7-2 | 120 | 2.4 | 100 |
| 1142 | 3-2 | — | ET8-1 | 131 | 2.1 | 100 |
| 1143 | 3-2 | — | ET8-2 | 132 | 2.5 | 100 |
| 1144 | 3-2 | — | ET8-3 | 133 | 2.6 | 100 |
| 1145 | 3-2 | — | ET9-1 | 134 | 3.1 | 100 |
| 1146 | 3-2 | — | ET10-1 | 129 | 2.9 | 100 |
| 1147 | 3-2 | — | ET11-1 | 132 | 2.8 | 100 |
| 1148 | 3-2 | — | ET12-1 | 136 | 3.3 | 100 |
| 1149 | 3-2 | — | ET13-1 | 132 | 2.6 | 100 |
| 1150 | 3-2 | — | ET14-1 | 133 | 2.6 | 100 |
| 1151 | 3-2 | A-1 | ET3-4 | 109 | 2.6 | 100 |

TABLE 53

| Ex. | Binding resin Main | Blend | ETM | VL (V) | Wear (μm) | Adhesion (%) |
|---|---|---|---|---|---|---|
| 345 | 3-3 | — | ET1-1 | 118 | 2.9 | 100 |
| 1152 | 3-3 | — | ET1-2 | 121 | 2.6 | 100 |
| 1153 | 3-3 | — | ET2-1 | 108 | 2.1 | 100 |
| 1154 | 3-3 | — | ET2-2 | 104 | 2.8 | 100 |
| 1155 | 3-3 | — | ET2-3 | 107 | 2.0 | 100 |
| 1156 | 3-3 | — | ET2-4 | 107 | 2.8 | 100 |
| 1157 | 3-3 | — | ET2-5 | 100 | 2.3 | 100 |
| 1158 | 3-3 | — | ET2-6 | 99 | 2.7 | 100 |
| 1159 | 3-3 | — | ET2-7 | 101 | 3.0 | 100 |
| 1150 | 3-3 | — | ET3-1 | 92 | 3.0 | 100 |
| 1161 | 3-3 | — | ET3-2 | 94 | 3.3 | 100 |
| 1162 | 3-3 | — | ET3-3 | 93 | 2.6 | 100 |
| 1163 | 3-3 | — | ET3-4 | 97 | 2.6 | 100 |
| 1164 | 3-3 | — | ET3-5 | 99 | 2.1 | 100 |
| 1165 | 3-3 | — | ET4-1 | 100 | 2.3 | 100 |
| 1166 | 3-3 | — | ET4-2 | 109 | 2.9 | 100 |
| 1167 | 3-3 | — | ET5-1 | 107 | 3.2 | 100 |
| 1168 | 3-3 | — | ET5-2 | 104 | 2.4 | 100 |
| 1169 | 3-3 | — | ET6-1 | 110 | 2.4 | 100 |
| 1160 | 3-3 | — | ET6-2 | 118 | 2.5 | 100 |
| 1171 | 3-3 | — | ET7-1 | 120 | 2.5 | 100 |
| 1172 | 3-3 | — | ET7-2 | 116 | 2.5 | 100 |
| 1173 | 3-3 | — | ET8-1 | 129 | 2.2 | 100 |
| 1174 | 3-3 | — | ET8-2 | 127 | 2.2 | 100 |
| 1175 | 3-3 | — | ET8-3 | 126 | 2.8 | 100 |
| 1176 | 3-3 | — | ET9-1 | 129 | 3.1 | 100 |
| 1177 | 3-3 | — | ET10-1 | 130 | 2.7 | 100 |
| 1178 | 3-3 | — | ET11-1 | 128 | 2.4 | 100 |
| 1179 | 3-3 | — | ET12-1 | 132 | 2.3 | 100 |
| 1180 | 3-3 | — | ET13-1 | 133 | 2.8 | 100 |
| 1181 | 3-3 | — | ET14-1 | 140 | 2.2 | 100 |
| 1182 | 3-3 | A-1 | ET3-4 | 100 | 3.1 | 100 |
| Comp. Ex. 1 | A-4 | — | ET1-1 | 190 | 5.5 | 30 |
| Comp. Ex. 13 | 1-1 | — | ET15-1 | 221 | 2.6 | 100 |

Examples 1183 to 1461

[Single-layer photosensitive material for analog light source (positive charging type)]

According to the same manner as that described in Examples 904 to 1182 except for using the bisazo pigment represented by the above formula (CG2) in place of the electric charge generating material (CG1) used in Examples 904 to 1182, a single-layer photosensitive material for analog light source was produced, respectively.

Comparative Example 14

According to the same manner as that described in Example 388 except for using the compound represented by the above formula (ET15-1) as the electron transferring material, a single-layer photosensitive material was produced.

The resulting electrophotosensitive materials of the respective Examples and Comparative Examples were subjected to the photosensitivity test, wear resistance test and adhesion test according to the same manner as that described in Examples 388 to 759, and their characteristics were evaluated.

These test results are shown in Tables 54 to 62, together with the above-described compound No. of the binding resin and hole transferring material (ETM) used.

In Tables 54 to 62, the results of Examples 388, 431, 474, 517, 560, 603, 646, 689 and 717 as well as Comparative Example 3 are also shown.

TABLE 54

| Ex. | Binding resin Main | Blend | ETM | VL (V) | Wear (μm) | Adhesion (%) |
|---|---|---|---|---|---|---|
| 388 | 1-1 | — | ET1-1 | 195 | 1.7 | 100 |
| 1183 | 1-1 | — | ET1-2 | 191 | 1.9 | 100 |
| 1184 | 1-1 | — | ET2-1 | 180 | 1.1 | 100 |
| 1185 | 1-1 | — | ET2-2 | 179 | 1.5 | 100 |
| 1186 | 1-1 | — | ET2-3 | 176 | 1.2 | 100 |
| 1187 | 1-1 | — | ET2-4 | 182 | 1.3 | 100 |
| 1188 | 1-1 | — | ET2-5 | 184 | 2.4 | 100 |
| 1189 | 1-1 | — | ET2-6 | 181 | 2.4 | 100 |
| 1190 | 1-1 | — | ET2-7 | 176 | 2.1 | 100 |
| 1191 | 1-1 | — | ET3-1 | 173 | 1.8 | 100 |
| 1192 | 1-1 | — | ET3-2 | 174 | 1.8 | 100 |
| 1193 | 1-1 | — | ET3-3 | 173 | 1.7 | 100 |
| 1194 | 1-1 | — | ET3-4 | 170 | 1.3 | 100 |
| 1195 | 1-1 | — | ET3-5 | 178 | 1.1 | 100 |
| 1196 | 1-1 | — | ET4-1 | 181 | 2.1 | 100 |
| 1197 | 1-1 | — | ET4-2 | 179 | 2.3 | 100 |
| 1198 | 1-1 | — | ET5-1 | 184 | 1.9 | 100 |
| 1199 | 1-1 | — | ET5-2 | 182 | 1.8 | 100 |
| 1200 | 1-1 | — | ET6-1 | 188 | 1.7 | 100 |
| 1201 | 1-1 | — | ET6-2 | 191 | 2.1 | 100 |
| 1202 | 1-1 | — | ET7-1 | 198 | 1.6 | 100 |
| 1203 | 1-1 | — | ET7-2 | 199 | 1.6 | 100 |
| 1204 | 1-1 | — | ET8-1 | 201 | 2.3 | 100 |
| 1205 | 1-1 | — | ET8-2 | 202 | 1.5 | 100 |
| 1206 | 1-1 | — | ET8-3 | 206 | 1.3 | 100 |
| 1207 | 1-1 | — | ET9-1 | 210 | 1.2 | 100 |
| 1208 | 1-1 | — | ET10-1 | 210 | 1.1 | 100 |
| 1209 | 1-1 | — | ET11-1 | 200 | 2.3 | 100 |
| 1210 | 1-1 | — | ET12-1 | 204 | 1.3 | 100 |
| 1211 | 1-1 | — | ET13-1 | 202 | 1.9 | 100 |
| 1212 | 1-1 | — | ET14-1 | 200 | 2.2 | 100 |
| 1213 | 1-1 | A-1 | ET3-4 | 176 | 1.8 | 100 |

TABLE 55

| Ex. | Binding resin Main | Blend | ETM | VL (V) | Wear (μm) | Adhesion (%) |
|---|---|---|---|---|---|---|
| 431 | 1-2 | — | ET1-1 | 203 | 1.3 | 100 |
| 1214 | 1-2 | — | ET1-2 | 200 | 1.9 | 100 |
| 1215 | 1-2 | — | ET2-1 | 184 | 2.1 | 100 |
| 1216 | 1-2 | — | ET2-2 | 186 | 2.3 | 100 |
| 1217 | 1-2 | — | ET2-3 | 185 | 1.8 | 100 |
| 1218 | 1-2 | — | ET2-4 | 182 | 2.4 | 100 |
| 1219 | 1-2 | — | ET2-5 | 187 | 1.9 | 100 |
| 1220 | 1-2 | — | ET2-6 | 184 | 2.1 | 100 |
| 1221 | 1-2 | — | ET2-7 | 188 | 1.7 | 100 |
| 1222 | 1-2 | — | ET3-1 | 180 | 1.1 | 100 |
| 1223 | 1-2 | — | ET3-2 | 177 | 1.5 | 100 |
| 1224 | 1-2 | — | ET3-3 | 172 | 2.3 | 100 |
| 1225 | 1-2 | — | ET3-4 | 178 | 2.0 | 100 |
| 1226 | 1-2 | — | ET3-5 | 181 | 2.1 | 100 |
| 1227 | 1-2 | — | ET4-1 | 184 | 1.3 | 100 |
| 1228 | 1-2 | — | ET4-2 | 183 | 1.4 | 100 |
| 1229 | 1-2 | — | ET5-1 | 182 | 1.2 | 100 |
| 1230 | 1-2 | — | ET5-2 | 181 | 2.1 | 100 |
| 1231 | 1-2 | — | ET6-1 | 184 | 1.8 | 100 |
| 1232 | 1-2 | — | ET6-2 | 186 | 1.7 | 100 |
| 1233 | 1-2 | — | ET7-1 | 189 | 1.6 | 100 |
| 1234 | 1-2 | — | ET7-2 | 191 | 1.3 | 100 |
| 1235 | 1-2 | — | ET8-1 | 194 | 1.5 | 100 |
| 1236 | 1-2 | — | ET8-2 | 192 | 2.1 | 100 |
| 1237 | 1-2 | — | ET8-3 | 193 | 1.3 | 100 |
| 1238 | 1-2 | — | ET9-1 | 198 | 2.3 | 100 |
| 1239 | 1-2 | — | ET10-1 | 200 | 1.3 | 100 |
| 1240 | 1-2 | — | ET11-1 | 201 | 1.8 | 100 |
| 1241 | 1-2 | — | ET12-1 | 203 | 1.2 | 100 |
| 1242 | 1-2 | — | ET13-1 | 200 | 2.1 | 100 |
| 1243 | 1-2 | — | ET14-1 | 199 | 2.1 | 100 |
| 1244 | 1-2 | A-1 | ET3-4 | 184 | 1.9 | 100 |

TABLE 56

| Ex. | Binding resin Main | Blend | ETM | VL (V) | Wear (μm) | Adhesion (%) |
|---|---|---|---|---|---|---|
| 474 | 1-3 | — | ET1-1 | 197 | 1.8 | 100 |
| 1245 | 1-3 | — | ET1-2 | 194 | 1.7 | 100 |
| 1246 | 1-3 | — | ET2-1 | 181 | 1.3 | 100 |
| 1247 | 1-3 | — | ET2-2 | 186 | 1.1 | 100 |
| 1248 | 1-3 | — | ET2-3 | 185 | 2.2 | 100 |
| 1249 | 1-3 | — | ET2-4 | 180 | 1.8 | 100 |
| 1250 | 1-3 | — | ET2-5 | 190 | 1.9 | 100 |
| 1251 | 1-3 | — | ET2-6 | 182 | 1.8 | 100 |
| 1252 | 1-3 | — | ET2-7 | 179 | 2.1 | 100 |
| 1253 | 1-3 | — | ET3-1 | 176 | 2.3 | 100 |
| 1254 | 1-3 | — | ET3-2 | 172 | 1.9 | 100 |
| 1255 | 1-3 | — | ET3-3 | 178 | 1.2 | 100 |
| 1256 | 1-3 | — | ET3-4 | 177 | 1.9 | 100 |
| 1257 | 1-3 | — | ET3-5 | 171 | 2.1 | 100 |
| 1258 | 1-3 | — | ET4-1 | 181 | 1.8 | 100 |
| 1259 | 1-3 | — | ET4-2 | 183 | 1.7 | 100 |
| 1260 | 1-3 | — | ET5-1 | 186 | 2.3 | 100 |
| 1261 | 1-3 | — | ET5-2 | 185 | 2.1 | 100 |
| 1262 | 1-3 | — | ET6-1 | 179 | 1.9 | 100 |
| 1263 | 1-3 | — | ET6-2 | 182 | 1.8 | 100 |
| 1264 | 1-3 | — | ET7-1 | 190 | 1.7 | 100 |
| 1265 | 1-3 | — | ET7-2 | 186 | 1.7 | 100 |
| 1266 | 1-3 | — | ET8-1 | 185 | 2.1 | 100 |
| 1267 | 1-3 | — | ET8-2 | 186 | 2.3 | 100 |
| 1268 | 1-3 | — | ET8-3 | 190 | 2.1 | 100 |
| 1269 | 1-3 | — | ET9-1 | 186 | 2.0 | 100 |
| 1270 | 1-3 | — | ET10-1 | 192 | 1.3 | 100 |
| 1271 | 1-3 | — | ET11-1 | 191 | 2.0 | 100 |
| 1272 | 1-3 | — | ET12-1 | 194 | 1.8 | 100 |
| 1273 | 1-3 | — | ET13-1 | 193 | 1.9 | 100 |
| 1274 | 1-3 | — | ET14-1 | 191 | 2.1 | 100 |
| 1275 | 1-3 | A-1 | ET3-4 | 184 | 1.0 | 100 |

TABLE 57

| Ex. | Binding resin Main | Blend | ETM | VL (V) | Wear (μm) | Adhesion (%) |
|---|---|---|---|---|---|---|
| 517 | 2-1 | — | ET1-1 | 200 | 0.8 | 100 |
| 1276 | 2-1 | — | ET1-2 | 196 | 0.9 | 100 |
| 1277 | 2-1 | — | ET2-1 | 184 | 0.9 | 100 |
| 1278 | 2-1 | — | ET2-2 | 183 | 1.0 | 100 |
| 1279 | 2-1 | — | ET2-3 | 186 | 1.2 | 100 |
| 1280 | 2-1 | — | ET2-4 | 190 | 1.3 | 100 |
| 1281 | 2-1 | — | ET2-5 | 182 | 0.9 | 100 |
| 1282 | 2-1 | — | ET2-6 | 191 | 0.8 | 100 |
| 1283 | 2-1 | — | ET2-7 | 185 | 0.6 | 100 |
| 1284 | 2-1 | — | ET3-1 | 176 | 1.2 | 100 |
| 1285 | 2-1 | — | ET3-2 | 180 | 1.3 | 100 |
| 1286 | 2-1 | — | ET3-3 | 184 | 1.1 | 100 |
| 1287 | 2-1 | — | ET3-4 | 184 | 0.9 | 100 |
| 1288 | 2-1 | — | ET3-5 | 179 | 0.8 | 100 |
| 1289 | 2-1 | — | ET4-1 | 181 | 0.6 | 100 |
| 1290 | 2-1 | — | ET4-2 | 184 | 0.6 | 100 |
| 1291 | 2-1 | — | ET5-1 | 180 | 1.2 | 100 |
| 1292 | 2-1 | — | ET5-2 | 180 | 1.2 | 100 |
| 1293 | 2-1 | — | ET6-1 | 186 | 1.3 | 100 |
| 1294 | 2-1 | — | ET6-2 | 187 | 0.9 | 100 |
| 1295 | 2-1 | — | ET7-1 | 189 | 1.2 | 100 |
| 1296 | 2-1 | — | ET7-2 | 193 | 0.9 | 100 |
| 1297 | 2-1 | — | ET8-1 | 186 | 1.3 | 100 |
| 1298 | 2-1 | — | ET8-2 | 184 | 0.9 | 100 |
| 1299 | 2-1 | — | ET8-3 | 189 | 1.1 | 100 |
| 1300 | 2-1 | — | ET9-1 | 192 | 1.2 | 100 |
| 1301 | 2-1 | — | ET10-1 | 194 | 0.8 | 100 |
| 1302 | 2-1 | — | ET11-1 | 194 | 0.9 | 100 |
| 1303 | 2-1 | — | ET12-1 | 188 | 0.9 | 100 |
| 1304 | 2-1 | — | ET13-1 | 192 | 1.1 | 100 |
| 1305 | 2-1 | — | ET14-1 | 190 | 1.1 | 100 |
| 1306 | 2-1 | A-1 | ET3-4 | 180 | 1.3 | 100 |

TABLE 58

| Ex. | Binding resin Main | Binding resin Blend | ETM | VL (V) | Wear (μm) | Adhesion (%) |
|---|---|---|---|---|---|---|
| 560 | 2-2 | — | ET1-1 | 192 | 0.9 | 100 |
| 1307 | 2-2 | — | ET1-2 | 190 | 1.2 | 100 |
| 1308 | 2-2 | — | ET2-1 | 179 | 1.3 | 100 |
| 1309 | 2-2 | — | ET2-2 | 186 | 1.1 | 100 |
| 1310 | 2-2 | — | ET2-3 | 185 | 0.9 | 100 |
| 1311 | 2-2 | — | ET2-4 | 178 | 1.0 | 100 |
| 1312 | 2-2 | — | ET2-5 | 182 | 1.2 | 100 |
| 1313 | 2-2 | — | ET2-6 | 180 | 1.1 | 100 |
| 1314 | 2-2 | — | ET2-7 | 180 | 0.9 | 100 |
| 1315 | 2-2 | — | ET3-1 | 171 | 0.8 | 100 |
| 1316 | 2-2 | — | ET3-2 | 176 | 0.6 | 100 |
| 1317 | 2-2 | — | ET3-3 | 175 | 1.2 | 100 |
| 1318 | 2-2 | — | ET3-4 | 173 | 0.9 | 100 |
| 1319 | 2-2 | — | ET3-5 | 176 | 1.3 | 100 |
| 1320 | 2-2 | — | ET4-1 | 184 | 1.4 | 100 |
| 1321 | 2-2 | — | ET4-2 | 182 | 0.8 | 100 |
| 1322 | 2-2 | — | ET5-1 | 181 | 1.2 | 100 |
| 1323 | 2-2 | — | ET5-2 | 192 | 1.3 | 100 |
| 1324 | 2-2 | — | ET6-1 | 190 | 0.9 | 100 |
| 1325 | 2-2 | — | ET6-2 | 186 | 1.3 | 100 |
| 1326 | 2-2 | — | ET7-1 | 192 | 0.9 | 100 |
| 1327 | 2-2 | — | ET7-2 | 194 | 1.0 | 100 |
| 1328 | 2-2 | — | ET8-1 | 193 | 1.0 | 100 |
| 1329 | 2-2 | — | ET8-2 | 186 | 1.3 | 100 |
| 1330 | 2-2 | — | ET8-3 | 192 | 1.1 | 100 |
| 1331 | 2-2 | — | ET9-1 | 191 | 0.8 | 100 |
| 1332 | 2-2 | — | ET10-1 | 190 | 0.7 | 100 |
| 1333 | 2-2 | — | ET11-1 | 196 | 0.6 | 100 |
| 1334 | 2-2 | — | ET12-1 | 186 | 0.8 | 100 |
| 1335 | 2-2 | — | ET13-1 | 199 | 1.2 | 100 |
| 1336 | 2-2 | — | ET14-1 | 204 | 1.1 | 100 |
| 1337 | 2-2 | A-1 | ET3-4 | 177 | 1.1 | 100 |

TABLE 59

| Ex. | Binding resin Main | Binding resin Blend | ETM | VL (V) | Wear (μm) | Adhesion (%) |
|---|---|---|---|---|---|---|
| 603 | 2-3 | — | ET1-1 | 198 | 0.6 | 100 |
| 1338 | 2-3 | — | ET1-2 | 199 | 0.9 | 100 |
| 1339 | 2-3 | — | ET2-1 | 181 | 1.3 | 100 |
| 1340 | 2-3 | — | ET2-2 | 182 | 1.2 | 100 |
| 1341 | 2-3 | — | ET2-3 | 186 | 1.1 | 100 |
| 1342 | 2-3 | — | ET2-4 | 183 | 1.0 | 100 |
| 1343 | 2-3 | — | ET2-5 | 181 | 0.9 | 100 |
| 1344 | 2-3 | — | ET2-6 | 177 | 0.7 | 100 |
| 1345 | 2-3 | — | ET2-7 | 184 | 1.2 | 100 |
| 1346 | 2-3 | — | ET3-1 | 176 | 1.4 | 100 |
| 1347 | 2-3 | — | ET3-2 | 177 | 0.9 | 100 |
| 1348 | 2-3 | — | ET3-3 | 174 | 1.2 | 100 |
| 1349 | 2-3 | — | ET3-4 | 179 | 1.3 | 100 |
| 1350 | 2-3 | — | ET3-5 | 181 | 0.9 | 100 |
| 1351 | 2-3 | — | ET4-1 | 183 | 0.8 | 100 |
| 1352 | 2-3 | — | ET4-2 | 182 | 1.3 | 100 |
| 1353 | 2-3 | — | ET5-1 | 186 | 1.2 | 100 |
| 1354 | 2-3 | — | ET5-2 | 184 | 0.9 | 100 |
| 1355 | 2-3 | — | ET6-1 | 184 | 1.1 | 100 |
| 1356 | 2-3 | — | ET6-2 | 182 | 0.9 | 100 |
| 1357 | 2-3 | — | ET7-1 | 187 | 0.8 | 100 |
| 1358 | 2-3 | — | ET7-2 | 189 | 0.8 | 100 |
| 1359 | 2-3 | — | ET8-1 | 192 | 1.3 | 100 |
| 1360 | 2-3 | — | ET8-2 | 190 | 1.2 | 100 |
| 1361 | 2-3 | — | ET8-3 | 194 | 1.4 | 100 |
| 1362 | 2-3 | — | ET9-1 | 193 | 1.2 | 100 |
| 1363 | 2-3 | — | ET10-1 | 191 | 1.1 | 100 |
| 1364 | 2-3 | — | ET11-1 | 196 | 0.8 | 100 |
| 1365 | 2-3 | — | ET12-1 | 194 | 0.9 | 100 |
| 1366 | 2-3 | — | ET13-1 | 190 | 1.2 | 100 |
| 1367 | 2-3 | — | ET14-1 | 194 | 1.1 | 100 |
| 1368 | 2-3 | A-1 | ET3-4 | 182 | 1.3 | 100 |

TABLE 60

| Ex. | Binding resin Main | Binding resin Blend | ETM | VL (V) | Wear (μm) | Adhesion (%) |
|---|---|---|---|---|---|---|
| 646 | 3-1 | — | ET1-1 | 195 | 1.9 | 100 |
| 1369 | 3-1 | — | ET1-2 | 190 | 1.3 | 100 |
| 1370 | 3-1 | — | ET2-1 | 184 | 0.9 | 100 |
| 1371 | 3-1 | — | ET2-2 | 179 | 0.8 | 100 |
| 1372 | 3-1 | — | ET2-3 | 176 | 1.3 | 100 |
| 1373 | 3-1 | — | ET2-4 | 173 | 1.2 | 100 |
| 1374 | 3-1 | — | ET2-5 | 176 | 1.2 | 100 |
| 1375 | 3-1 | — | ET2-6 | 175 | 1.0 | 100 |
| 1376 | 3-1 | — | ET2-7 | 181 | 1.0 | 100 |
| 1377 | 3-1 | — | ET3-1 | 176 | 1.0 | 100 |
| 1378 | 3-1 | — | ET3-2 | 175 | 1.0 | 100 |
| 1379 | 3-1 | — | ET3-3 | 179 | 1.0 | 100 |
| 1380 | 3-1 | — | ET3-4 | 180 | 0.9 | 100 |
| 1381 | 3-1 | — | ET3-5 | 172 | 0.8 | 100 |
| 1382 | 3-1 | — | ET4-1 | 184 | 1.2 | 100 |
| 1383 | 3-1 | — | ET4-2 | 183 | 1.3 | 100 |
| 1384 | 3-1 | — | ET5-1 | 188 | 1.3 | 100 |
| 1385 | 3-1 | — | ET5-2 | 181 | 0.9 | 100 |
| 1386 | 3-1 | — | ET6-1 | 186 | 0.7 | 100 |
| 1387 | 3-1 | — | ET6-2 | 185 | 0.8 | 100 |
| 1388 | 3-1 | — | ET7-1 | 184 | 0.6 | 100 |
| 1389 | 3-1 | — | ET7-2 | 186 | 1.4 | 100 |
| 1390 | 3-1 | — | ET8-1 | 191 | 0.6 | 100 |
| 1391 | 3-1 | — | ET8-2 | 190 | 1.0 | 100 |
| 1392 | 3-1 | — | ET8-3 | 186 | 1.0 | 100 |
| 1393 | 3-1 | — | ET9-1 | 193 | 0.9 | 100 |
| 1394 | 3-1 | — | ET10-1 | 192 | 0.8 | 100 |
| 1395 | 3-1 | — | ET11-1 | 191 | 1.2 | 100 |
| 1396 | 3-1 | — | ET12-1 | 189 | 0.9 | 100 |
| 1397 | 3-1 | — | ET13-1 | 201 | 1.2 | 100 |
| 1398 | 3-1 | — | ET14-1 | 204 | 1.3 | 100 |
| 1399 | 3-1 | A-1 | ET3-4 | 186 | 1.1 | 100 |

TABLE 61

| Ex. | Binding resin Main | Binding resin Blend | ETM | VL (V) | Wear (μm) | Adhesion (%) |
|---|---|---|---|---|---|---|
| 689 | 3-2 | — | ET1-1 | 185 | 1.1 | 100 |
| 1400 | 3-2 | — | ET1-2 | 186 | 1.0 | 100 |
| 1401 | 3-2 | — | ET2-1 | 174 | 1.0 | 100 |
| 1402 | 3-2 | — | ET2-2 | 175 | 2.1 | 100 |
| 1403 | 3-2 | — | ET2-3 | 176 | 2.3 | 100 |
| 1404 | 3-2 | — | ET2-4 | 179 | 2.3 | 100 |
| 1405 | 3-2 | — | ET2-5 | 182 | 1.5 | 100 |
| 1406 | 3-2 | — | ET2-6 | 180 | 1.5 | 100 |
| 1407 | 3-2 | — | ET2-7 | 176 | 1.9 | 100 |
| 1408 | 3-2 | — | ET3-1 | 171 | 2.1 | 100 |
| 1409 | 3-2 | — | ET3-2 | 170 | 1.9 | 100 |
| 1410 | 3-2 | — | ET3-3 | 170 | 1.7 | 100 |
| 1411 | 3-2 | — | ET3-4 | 174 | 1.6 | 100 |
| 1412 | 3-2 | — | ET3-5 | 170 | 1.7 | 100 |
| 1413 | 3-2 | — | ET4-1 | 176 | 1.8 | 100 |
| 1414 | 3-2 | — | ET4-2 | 175 | 1.9 | 100 |
| 1415 | 3-2 | — | ET5-1 | 177 | 2.0 | 100 |
| 1416 | 3-2 | — | ET5-2 | 180 | 2.3 | 100 |
| 1417 | 3-2 | — | ET6-1 | 181 | 2.4 | 100 |
| 1418 | 3-2 | — | ET6-2 | 183 | 2.1 | 100 |
| 1419 | 3-2 | — | ET7-1 | 184 | 1.8 | 100 |
| 1420 | 3-2 | — | ET7-2 | 180 | 1.2 | 100 |
| 1421 | 3-2 | — | ET8-1 | 185 | 1.3 | 100 |
| 1422 | 3-2 | — | ET8-2 | 191 | 1.0 | 100 |
| 1423 | 3-2 | — | ET8-3 | 190 | 1.1 | 100 |
| 1424 | 3-2 | — | ET9-1 | 186 | 1.0 | 100 |
| 1425 | 3-2 | — | ET10-1 | 189 | 2.1 | 100 |
| 1426 | 3-2 | — | ET11-1 | 191 | 2.3 | 100 |
| 1427 | 3-2 | — | ET12-1 | 185 | 0.9 | 100 |
| 1428 | 3-2 | — | ET13-1 | 186 | 1.2 | 100 |
| 1429 | 3-2 | — | ET14-1 | 180 | 1.2 | 100 |
| 1430 | 3-2 | A-1 | ET3-4 | 172 | 1.1 | 100 |

TABLE 62

| Ex. | Binding resin Main | Blend | ETM | VL (V) | Wear (μm) | Adhesion (%) |
|---|---|---|---|---|---|---|
| 717 | 3-3 | — | ET1-1 | 196 | 1.5 | 100 |
| 1431 | 3-3 | — | ET1-2 | 199 | 1.1 | 100 |
| 1432 | 3-3 | — | ET2-1 | 181 | 2.0 | 100 |
| 1433 | 3-3 | — | ET2-2 | 184 | 2.0 | 100 |
| 1434 | 3-3 | — | ET2-3 | 188 | 2.0 | 100 |
| 1435 | 3-3 | — | ET2-4 | 179 | 2.0 | 100 |
| 1436 | 3-3 | — | ET2-5 | 184 | 2.3 | 100 |
| 1437 | 3-3 | — | ET2-6 | 183 | 1.8 | 100 |
| 1438 | 3-3 | — | ET2-7 | 187 | 1.7 | 100 |
| 1439 | 3-3 | — | ET3-1 | 179 | 1.6 | 100 |
| 1440 | 3-3 | — | ET3-2 | 176 | 1.5 | 100 |
| 1441 | 3-3 | — | ET3-3 | 177 | 1.9 | 100 |
| 1442 | 3-3 | — | ET3-4 | 174 | 2.1 | 100 |
| 1443 | 3-3 | — | ET3-5 | 178 | 2.2 | 100 |
| 1444 | 3-3 | — | ET4-1 | 181 | 2.1 | 100 |
| 1445 | 3-3 | — | ET4-2 | 180 | 2.3 | 100 |
| 1446 | 3-3 | — | ET5-1 | 176 | 1.9 | 100 |
| 1447 | 3-3 | — | ET5-2 | 175 | 1.9 | 100 |
| 1448 | 3-3 | — | ET6-1 | 179 | 1.8 | 100 |
| 1449 | 3-3 | — | ET6-2 | 180 | 1.7 | 100 |
| 1450 | 3-3 | — | ET7-1 | 184 | 2.1 | 100 |
| 1451 | 3-3 | — | ET7-2 | 185 | 2.4 | 100 |
| 1452 | 3-3 | — | ET8-1 | 183 | 1.9 | 100 |
| 1453 | 3-3 | — | ET8-2 | 184 | 1.8 | 100 |
| 1454 | 3-3 | — | ET8-3 | 182 | 1.7 | 100 |
| 1455 | 3-3 | — | ET9-1 | 184 | 1.6 | 100 |
| 1456 | 3-3 | — | ET10-1 | 185 | 1.5 | 100 |
| 1457 | 3-3 | — | ET11-1 | 191 | 1.3 | 100 |
| 1458 | 3-3 | — | ET12-1 | 174 | 1.8 | 100 |
| 1459 | 3-3 | — | ET13-1 | 180 | 1.9 | 100 |
| 1460 | 3-3 | — | ET14-1 | 184 | 2.1 | 100 |
| 1461 | 3-3 | — | ET3-4 | 179 | 2.2 | 100 |
| Comp. Ex. 3 | A-4 | — | ET1-1 | 242 | 5.5 | 30 |
| Comp. Ex. 14 | 1-1 | — | ET15-1 | 222 | 1.9 | 100 |

Examples 1462 to 1506

[Multi-layer photosensitive material for digital light source (positive charging type)]

2 Parts by weight of the pigment represented by the above formula (CG1) as the electric charge generating material and 1 part by weight of a polyvinyl butyral as the binding resin were mixed and dispersed, together with 120 parts by weight of dichloromethane as the solvent, using a ball mill to prepare a coating solution for electric charge generating layer. Then, this coating solution was applied on an aluminum tube by a dip coating method, followed by hot-air drying at 100° C. for 60 minutes to give an electric charge generating layer having a thickness of 0.5 μm.

Then, 80 parts by weight of the hole transferring material represented by the above formulas (ET1), (ET2), (ET3) or (ET5) and 90 parts by weight of any one of polyester resins (1-1) to (1-3), (2-1) to (2-3) and (3-1) to (3-3) obtained in Reference Examples 1 to 9 or a mixture of this polyester resin and polycarbonate resin as the binding resin were mixed and dispersed, together with 800 parts by weight of tetrahydrofuran, by using a ball mill to prepare a coating solution for electric charge transferring layer. Then, this coating solution was applied on the above electric charge generating layer by a dip coating method, followed by hot-air drying at 100° C. for 60 minutes to form an electric charge transferring material having a thickness of 15 μm, thereby producing a positive charging type multi-layer photosensitive material for digital light source, respectively.

When using a mixture of the polyester resin and polycarbonate resin as the binding resin, 70 parts by weight of the polyester resin and 20 parts by weight of the polycarbonate resin were used in combination.

Comparative Example 15

According to the same manner as that described in Examples 1462 except for using 90 parts by weight of the polycarbonate resin having a repeating unit of the above formula (A-4) as the binding resin of the electric charge transferring material, a positive charging type multi-layer photosensitive material for digital light source was produced.

Comparative Example 16

According to the same manner as that described in Examples 1462 except for using the compound represented by the above formula (ET15-1) as the electron transferring material, a positive charging type multi-layer photosensitive material for digital light source was produced.

The resulting electrophotosensitive materials of the respective Examples and Comparative Examples were subjected to the photosensitivity test and wear resistance test according to the above evaluation test of the positive charging photosensitive material for digital light source.

The test results are shown in Tables 63 and 64, together with the above-described compound No. of the binding resin and electron transferring material used.

TABLE 63

| Ex. | Binding resin Main | Blend | ETM | VL (V) | Wear (μm) |
|---|---|---|---|---|---|
| 1462 | 1-1 | — | ET1-1 | 164 | 2.7 |
| 1463 | 1-1 | — | ET2-1 | 160 | 2.6 |
| 1464 | 1-1 | — | ET3-4 | 158 | 2.1 |
| 1465 | 1-1 | — | ET5-1 | 160 | 2.4 |
| 1466 | 1-1 | A-1 | ET1-1 | 163 | 2.4 |
| 1467 | 1-2 | — | ET1-1 | 182 | 2.8 |
| 1468 | 1-2 | — | ET2-1 | 174 | 2.5 |
| 1469 | 1-2 | — | ET3-4 | 172 | 2.4 |
| 1470 | 1-2 | — | ET5-1 | 173 | 2.3 |
| 1471 | 1-2 | A-1 | ET1-1 | 169 | 2.2 |
| 1472 | 1-3 | — | ET1-1 | 180 | 2.6 |
| 1473 | 1-3 | — | ET2-1 | 174 | 2.7 |
| 1474 | 1-3 | — | ET3-4 | 172 | 2.8 |
| 1475 | 1-3 | — | ET5-1 | 169 | 3.0 |
| 1476 | 1-3 | A-1 | ET1-1 | 174 | 3.0 |
| 1477 | 2-1 | — | ET1-1 | 167 | 1.4 |
| 1478 | 2-1 | — | ET2-1 | 170 | 1.8 |
| 1479 | 2-1 | — | ET3-4 | 174 | 1.7 |
| 1480 | 2-1 | — | ET5-1 | 172 | 1.6 |
| 1481 | 2-1 | A-1 | ET1-1 | 179 | 1.5 |
| 1482 | 2-2 | — | ET1-1 | 172 | 1.3 |
| 1483 | 2-2 | — | ET2-1 | 170 | 1.2 |
| 1484 | 2-2 | — | ET3-4 | 169 | 1.4 |
| 1485 | 2-2 | — | ET5-1 | 173 | 1.6 |
| 1486 | 2-2 | A-1 | ET1-1 | 170 | 1.8 |

TABLE 64

| Ex. | Binding resin Main | Blend | ETM | VL (V) | Wear (μm) |
|---|---|---|---|---|---|
| 1487 | 2-3 | — | ET1-1 | 163 | 2.0 |
| 1488 | 2-3 | — | ET2-1 | 160 | 1.9 |
| 1489 | 2-3 | — | ET3-4 | 169 | 2.1 |
| 1490 | 2-3 | — | ET5-1 | 172 | 2.0 |
| 1491 | 2-3 | A-1 | ET1-1 | 170 | 1.9 |
| 1492 | 3-1 | — | ET1-1 | 159 | 3.0 |
| 1493 | 3-1 | — | ET2-1 | 160 | 3.2 |
| 1494 | 3-1 | — | ET3-4 | 162 | 2.6 |
| 1495 | 3-1 | — | ET5-1 | 155 | 2.5 |
| 1496 | 3-1 | A-1 | ET1-1 | 146 | 2.8 |

TABLE 64-continued

| Ex. | Binding resin Main | Blend | ETM | VL (V) | Wear (μm) |
|---|---|---|---|---|---|
| 1497 | 3-2 | — | ET1-1 | 151 | 2.7 |
| 1498 | 3-2 | — | ET2-1 | 150 | 2.6 |
| 1499 | 3-2 | — | ET3-4 | 154 | 2.5 |
| 1500 | 3-2 | — | ET5-1 | 152 | 2.8 |
| 1501 | 3-2 | A-1 | ET1-1 | 153 | 2.6 |
| 1502 | 3-3 | — | ET1-1 | 160 | 2.7 |
| 1503 | 3-3 | — | ET2-1 | 154 | 2.5 |
| 1504 | 3-3 | — | ET3-4 | 152 | 2.3 |
| 1505 | 3-3 | — | ET5-1 | 157 | 2.4 |
| 1506 | 3-3 | A-1 | ET1-1 | 156 | 2.4 |
| Comp. Ex. 15 | A-4 | — | ET1-1 | 212 | 5.7 |
| Comp. Ex. 16 | 1-1 | — | ET15-1 | 244 | 2.4 |

Examples 1507 to 1551

[Multi-layer photosensitive material for analog light source (positive charging type)]

According to the same manner as that described in Examples 1462 to 1506 except for using 2 parts by weight of the pigment represented by the above formula (CG2) as the electric charge generating material, a positive charging type multi-layer photosensitive material for analog light source was obtained, respectively.

Comparative Example 17

According to the same manner as that described in Example 1507 except for using 90 parts by weight of the polycarbonate resin having a repeating unit of the above formula (A-4) as the binding resin of the electric charge transferring material, a positive charging type multi-layer photosensitive material for analog light source was produced.

Comparative Example 18

According to the same manner as that described in Example 1507 except for using the compound represented by the above formula (ET15-1) as the electron transferring material, a positive charging type multi-layer photosensitive material for analog light source was produced.

The resulting electrophotosensitive materials of the respective Examples and Comparative Examples were subjected to the photosensitivity test and wear resistance test according to the evaluation test of the positive charging photosensitive material for analog light source.

The test results are shown in Tables 65 and 66, together with the above-described compound No. of the binding resin and electron transferring material used.

TABLE 65

| Ex. | Binding resin Main | Blend | ETM | VL (V) | Wear (μm) |
|---|---|---|---|---|---|
| 1507 | 1-1 | — | ET1-1 | 186 | 2.0 |
| 1508 | 1-1 | — | ET2-1 | 175 | 1.9 |
| 1509 | 1-1 | — | ET3-4 | 177 | 2.2 |
| 1510 | 1-1 | — | ET5-1 | 172 | 2.4 |
| 1511 | 1-1 | A-1 | ET1-1 | 188 | 2.1 |
| 1512 | 1-2 | — | ET1-1 | 180 | 2.4 |
| 1513 | 1-2 | — | ET2-1 | 169 | 2.3 |
| 1514 | 1-2 | — | ET3-4 | 172 | 2.3 |
| 1515 | 1-2 | — | ET5-1 | 175 | 2.3 |

TABLE 65-continued

| Ex. | Binding resin Main | Blend | ETM | VL (V) | Wear (μm) |
|---|---|---|---|---|---|
| 1516 | 1-2 | A-1 | ET1-1 | 185 | 2.1 |
| 1517 | 1-3 | — | ET1-1 | 181 | 1.9 |
| 1518 | 1-3 | — | ET2-1 | 166 | 2.0 |
| 1519 | 1-3 | — | ET3-4 | 172 | 1.8 |
| 1520 | 1-3 | — | ET5-1 | 174 | 1.9 |
| 1521 | 1-3 | A-1 | ET1-1 | 188 | 1.9 |
| 1522 | 2-1 | — | ET1-1 | 190 | 1.6 |
| 1523 | 2-1 | — | ET2-1 | 175 | 1.8 |
| 1524 | 2-1 | — | ET3-4 | 173 | 1.7 |
| 1525 | 2-1 | — | ET5-1 | 175 | 1.5 |
| 1526 | 2-1 | A-1 | ET1-1 | 183 | 1.4 |
| 1527 | 2-2 | — | ET1-1 | 183 | 1.5 |
| 1528 | 2-2 | — | ET2-1 | 179 | 1.3 |
| 1529 | 2-2 | — | ET3-4 | 170 | 1.7 |
| 1530 | 2-2 | — | ET5-1 | 174 | 1.9 |
| 1531 | 2-2 | A-1 | ET1-1 | 183 | 1.6 |

TABLE 66

| Ex. | Binding resin Main | Blend | ETM | VL (V) | Wear (μm) |
|---|---|---|---|---|---|
| 1532 | 2-3 | — | ET1-1 | 190 | 1.3 |
| 1533 | 2-3 | — | ET2-1 | 174 | 1.2 |
| 1534 | 2-3 | — | ET3-4 | 177 | 1.8 |
| 1535 | 2-3 | — | ET5-1 | 180 | 1.7 |
| 1536 | 2-3 | A-1 | ET1-1 | 188 | 1.2 |
| 1537 | 3-1 | — | ET1-1 | 178 | 2.0 |
| 1538 | 3-1 | — | ET2-1 | 166 | 1.8 |
| 1539 | 3-1 | — | ET3-4 | 165 | 1.7 |
| 1540 | 3-1 | — | ET5-1 | 170 | 1.5 |
| 1541 | 3-1 | A-1 | ET1-1 | 177 | 2.1 |
| 1542 | 3-2 | — | ET1-1 | 175 | 2.0 |
| 1543 | 3-2 | — | ET2-1 | 170 | 1.9 |
| 1544 | 3-2 | — | ET3-4 | 166 | 1.8 |
| 1545 | 3-2 | — | ET5-1 | 165 | 1.7 |
| 1546 | 3-2 | A-1 | ET1-1 | 175 | 1.9 |
| 1547 | 3-3 | — | ET1-1 | 171 | 2.4 |
| 1548 | 3-3 | — | ET2-1 | 170 | 2.3 |
| 1549 | 3-3 | — | ET3-4 | 163 | 2.1 |
| 1550 | 3-3 | — | ET5-1 | 164 | 2.0 |
| 1551 | 3-3 | A-1 | ET1-1 | 174 | 2.2 |
| Comp. Ex. 17 | A-4 | — | ET1-1 | 230 | 6.1 |
| Comp. Ex. 18 | 1-1 | — | ET15-1 | 290 | 2.4 |

What is claimed is:

1. An electrophotosensitive material comprising a conductive substrate and a photosensitive layer provided on the conductive substrate, the photosensitive layer comprising:

(I) a binding resin comprising a polyester resin which is a linear polymer obtained by using a dihydroxy compound represented by the formula 1:

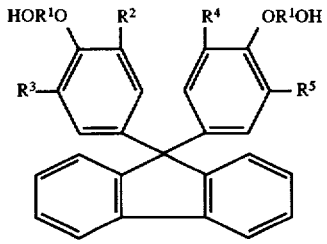

(1)

wherein $R^1$ is an alkylene group having 2 to 4 carbon atoms, and $R^2$, $R^3$, $R^4$ and $R^5$ are the same or different and indicate a hydrogen atom, an alkyl group having 1 to 4 carbon atoms, an aryl group or an aralkyl group;

(II) an electric charge generating material; and (III) at least one of a hole transferring material selected from the group consisting of compounds (HT1) to (HT13) represented by the formulas:

(HT1)

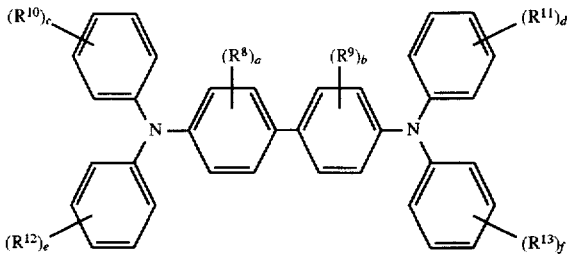

wherein $R^8$, $R^9$, $R^{10}$, $R^{11}$, $R^{12}$ and $R^{13}$ are the same or different and indicate a halogen atom, an alkyl group, an alkoxy group or an aryl group, the alkyl group and the alkoxy group can be substituted by halogen, amino, hydroxyl, optionally esterified carboxyl, cyano or alkoxy having 1 to 6 carbon atoms, the aryl group can be substituted by halogen, amino, hydroxyl, optionally esterified carboxyl, cyano, alkyl having 1 to 6 carbon atoms, alkoxy having 1 to 6 carbon atoms or alkenyl having 2 to 6 carbon atoms which can have an aryl group; and a, b, c, d, e and f are the same or different and indicate an integer of 0 to 5, (HT2)

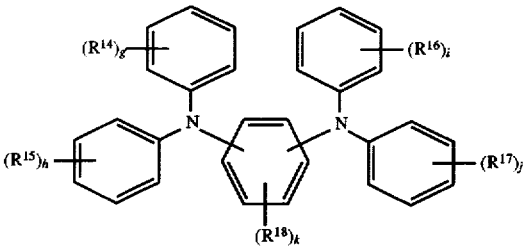

wherein $R^{14}$, $R_{15}$, $R^{16}$, $R^{17}$ and $R^{18}$ are the same or different and indicate a halogen atom, an alkyl group, an alkoxy group or an aryl group, the alkyl group and the alkoxy group can be substituted by halogen, amino, hydroxyl, optionally esterified carboxyl, cyano or alkoxy having 1 to 6 carbon atoms, the aryl group can be substituted by halogen, amino, hydroxyl, optionally esterified carboxyl, cyano, alkyl having 1 to 6 carbon atoms, alkoxy having 1 to 6 carbon atoms or alkenyl having 2 to 6 carbon atoms which may have an aryl group; and g, h, i, j and k are the same or different and indicate an integer of 0 to 5, (HT3)

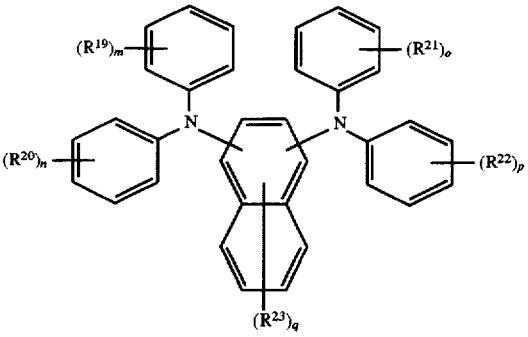

wherein $R^{19}$, $R^{20}$, $R^{21}$, and $R^{22}$ are the same or different and indicate a halogen atom, an alkyl group, an alkoxy group or an aryl group, the alkyl group and the alkoxy group can be substituted by halogen, amino, hydroxyl, optionally esterified carboxyl, cyano or alkoxy having 1 to 6 carbon atoms, and the aryl group can be substituted by halogen, amino, hydroxyl, optionally esterified carboxyl, cyano, alkyl having 1 to 6 carbon atoms, alkoxy having 1 to 6 carbon atoms or alkenyl having 2 to 6 carbon atoms which may have an aryl group; $R^{23}$ are the same or different and indicate a halogen atom, a cyano group, a nitro group, an alkyl group, an alkoxy group or an aryl group, the alkyl group and the alkoxy group can be substituted by halogen, amino, hydroxyl, optionally esterified carboxyl, cyano, or alkoxy having 1 to 6 carbon atoms and the aryl group can be substituted by halogen, amino, a hydroxyl, optionally esterified carboxyl, cyano, alkyl having 1 to 6 carbon atoms, alkoxy having 1 to 6 carbon atoms or alkenyl having 2 to 6 carbon atoms which may have an aryl group; m, n, o and p are the same or different and indicate an integer of 0 to 5; and q is an integer of 0 to 6, (HT4)

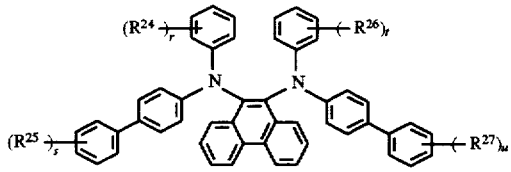

wherein $R^{24}$, $R^{25}$, $R^{26}$, and $R^{27}$ are the same or different and indicate a halogen atom, an alkyl group, an alkoxy group or an aryl group, the alkyl group and the alkoxy group can be substituted by halogen, amino, hydroxyl, optionally esterified carboxyl, cyano, or alkoxy having 1 to 6 carbon atoms, and the aryl group can be substituted by halogen, amino, hydroxyl, optionally esterified carboxyl, cyano, alkyl having 1 to 6 carbon atoms, alkoxy having 1 to 6 carbon atoms or alkenyl having 2 to 6 carbon atoms which may have an aryl group; and r, s, t and u are the same or different and indicate an integer of 0 to 5, (HT5)

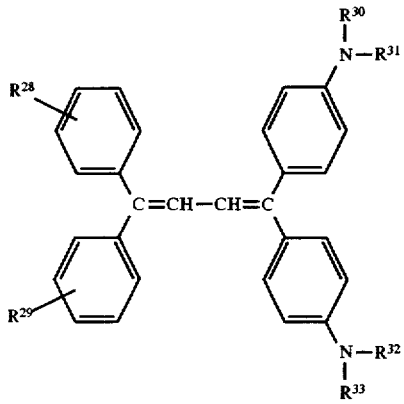

wherein $R^{28}$ and $R^{29}$ are the same or different and indicate a hydrogen atom, a halogen atom, an alkyl group or an alkoxy group; and $R^{30}$, $R^{31}$, $R^{32}$ and $R^{33}$ are the same or different and indicate a hydrogen atom, an alkyl group or an aryl group, (HT6)

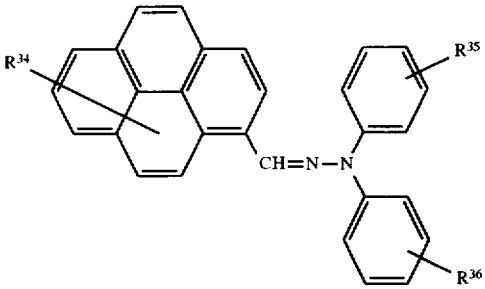

wherein $R^{34}$, $R^{35}$ and $R^{36}$ are the same or different and indicate a hydrogen atom, a halogen atom, an alkyl group or an alkoxy group.

(HT7)

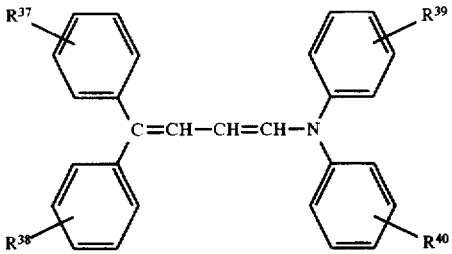

wherein $R^{37}$, $R^{38}$, $R^{39}$ and $R^{40}$ are the same or different and indicate a hydrogen atom, a halogen atom, an alkyl group or an alkoxy group.

(HT8)

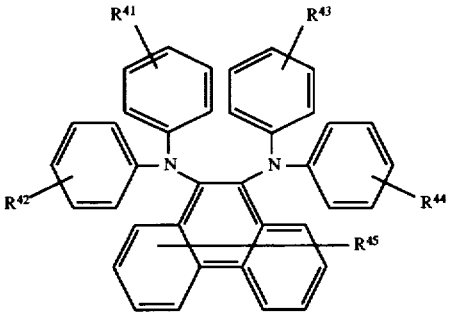

wherein $R^{41}$, $R^{42}$, $R^{43}$, $R^{44}$ and $R^{45}$ are the same or different and indicate a hydrogen atom, a halogen atom, an alkyl group or an alkoxy group.

(HT9)

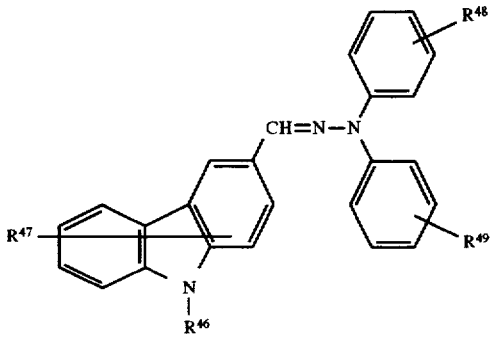

wherein $R^{46}$ is a hydrogen atom or an alkyl group; and $R^{47}$, $R^{48}$ and $R^{49}$ are the same or different and indicate a hydrogen atom, a halogen atom, an alkyl group or an alkoxy group.

(HT10)

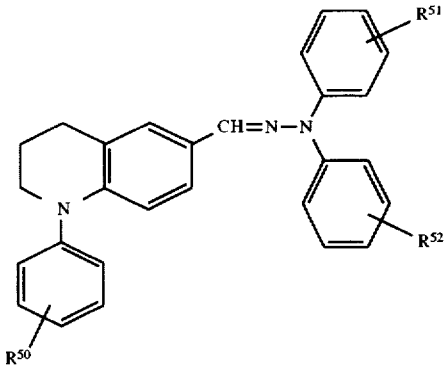

wherein $R^{50}$, $R^{51}$ and $R^{52}$ are the same or different and indicate a hydrogen atom, a halogen atom, an alkyl group or an alkoxy group.

(HT11)

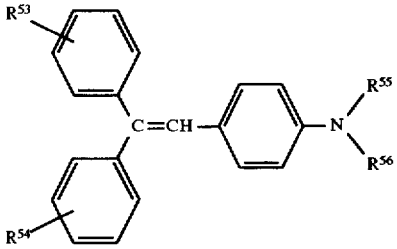

wherein $R^{53}$ and $R^{54}$ are the same or different and indicate a hydrogen atom, a halogen atom, an alkyl group or an alkoxy group; and $R^{55}$ and $R^{56}$ are the same or different and indicate a hydrogen atom, an alkyl group or an aryl group.

(HT12)

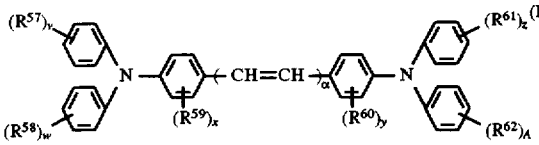

wherein $R^{57}$, $R^{58}$, $R^{59}$, $R^{60}$, $R^{61}$ and $R^{62}$ are the same or different and indicate an alkyl group or an alkoxy group, or an aryl group; α is an integer of 1 to 10; and v, w, x, y, z and A are the same or different and indicate 0 to 2, and (HT13)

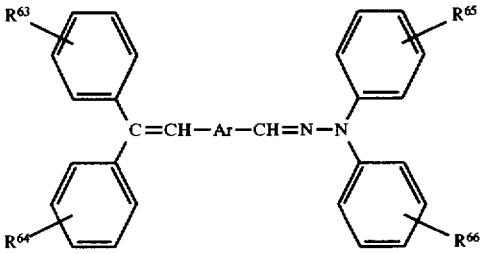

wherein $R^{63}$, $R^{64}$, $R^{65}$, and $R^{66}$ are the same or different and indicate a hydrogen atom, a halogen atom, an alkyl group or an alkoxy group; Ar is a group (Ar1), (Ar2) or (Ar3) represented by the formulas:

(Ar1)

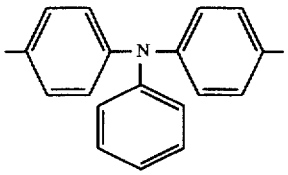

(Ar2)

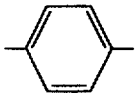

-continued (Ar3)

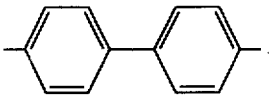

2. An electrophotosensitive material according to claim 1, wherein the binding resin comprises the polyester resin which is the linear polymer obtained by using the dihydroxy compound represented by the formula (1), and a polycarbonate resin.

3. An electrophotosensitive material according to claim 1, wherein the photosensitive layer is a single layer.

* * * * *